US006090513A

United States Patent [19]

Niino et al.

[11] Patent Number: 6,090,513

[45] Date of Patent: Jul. 18, 2000

[54] ECLECTROPHOTOGRAPHIC LIGHT-RECEIVING MEMBER AND PROCESS FOR ITS PRODUCTION

[75] Inventors: Hiroaki Niino; Koji Hitsuishi, both of Nara; Satoshi Kojima, Kyoto, all of Japan

[73] Assignee: Canon Kabushiki Kaisha, Tokyo, Japan

[21] Appl. No.: 08/999,839

[22] Filed: Mar. 27, 1997

Related U.S. Application Data

[63] Continuation of application No. 08/429,294, Apr. 25, 1995, abandoned.

[30] Foreign Application Priority Data

| | | | |
|---|---|---|---|
| Apr. 27, 1994 | [JP] | Japan | 6-089052 |
| Apr. 27, 1994 | [JP] | Japan | 6-089053 |
| Apr. 27, 1994 | [JP] | Japan | 6-089054 |
| Apr. 27, 1994 | [JP] | Japan | 6-089055 |

[51] Int. Cl.[7] ..... G03G 5/085

[52] U.S. Cl. ..... 430/65; 430/84; 430/95

[58] Field of Search ..... 430/64, 65, 84, 430/95

[56] References Cited

U.S. PATENT DOCUMENTS

| | | | |
|---|---|---|---|
| 4,265,991 | 5/1981 | Hirai et al. | 430/64 |
| 4,409,311 | 10/1983 | Kawamura et al. | 430/95 |
| 4,607,936 | 8/1986 | Miyakawa et al. | 355/3 DR |
| 4,650,736 | 3/1987 | Saitoh et al. | 430/57 |
| 4,659,639 | 4/1987 | Mizuno et al. | 430/65 |
| 4,696,884 | 9/1987 | Saitoh et al. | 430/58 |
| 4,705,733 | 11/1987 | Saitoh et al. | 430/57 |
| 4,735,883 | 4/1988 | Honda et al. | 430/69 |
| 4,788,120 | 11/1988 | Shirai et al. | 430/66 |
| 5,278,015 | 1/1994 | Iwamoto et al. | 430/95 |
| 5,382,487 | 1/1995 | Fukuda et al. | 430/57 |

FOREIGN PATENT DOCUMENTS

| | | |
|---|---|---|
| 0045204 | 3/1982 | European Pat. Off. . |
| 0454456 | 10/1991 | European Pat. Off. . |
| 3046509 | 8/1981 | Germany . |
| 3927353 | 5/1990 | Germany . |
| 57-115556 | 7/1982 | Japan . |

OTHER PUBLICATIONS

Kanoh et al., "Chemical Vapor Deposition of Amorphous Silicaon Using Tetrasilane", Jap. J. Appl. Phys. vol. 32, No. 6A (pp. 2613–2619) 1993.

Patent Abstracts of Japan, vol. 11, No. 287 (p.617) [2734] Sep. 1987 of JPA 62–083756.

*Primary Examiner*—John Goodrow

*Attorney, Agent, or Firm*—Fitzpatrick, Cella, Harper & Scinto

[57] ABSTRACT

An electrophotographic light-receiving member comprising a conductive support and a light-receiving layer having a photoconductive layer showing a photoconductivity, formed on the conductive support and formed of a non-monocrystalline material mainly composed of a silicon atom and containing at least one of a hydrogen atom and a halogen atom, wherein said photoconductive layer contains from 10 atomic % to 30 atomic % of hydrogen, the characteristic energy of exponential tail obtained from light absorption spectra at light-incident portions at least of the photoconductive layer is from 50 meV to 60 meV, and the density of states of localization in the photoconductive layer is from $1\times10^{14}$ $cm^{-3}$ to $1\times10^{16}$ $cm^{-3}$. Since the in-gap levels of the photoconductive layer has been controlled, the light-receiving member can be improved in environmental stability and exposure memory at the same time and have superior potential characteristics and image characteristics.

37 Claims, 17 Drawing Sheets

ECLECTROPHOTOGRAPHIC LIGHT-RECEIVING MEMBER AND PROCESS FOR ITS PRODUCTION

This application is a continuation of application Ser. No. 08/429,294 filed Apr. 25, 1995, now abandoned.

BACKGROUND OF THE INVENTION

1. Field of the Invention

The present invention relates to an electrophotographic light-receiving member having a sensitivity to electromagnetic waves such as light (which herein refers to light in a broad sense and includes ultraviolet rays, visible rays, infrared rays, X-rays, γ-rays, etc.), and also relates to a process for its production.

2. Related Background Art

In the field of image formation, photoconductive materials that form light-receiving layers in light-receiving members are required to have properties such that they are highly sensitive, have a high SN ratio [light current (Ip)/dark current (Id)], have absorption spectra suited to spectral characteristics of electromagnetic waves to be radiated, have a high response to light, have the desired dark resistance and are harmless to human bodies when used. In particular, in the case of electrophotographic light-receiving members set in electrophotographic apparatus used in offices, the harmlessness in their use is an important point.

Photoconductive materials having good properties in these respects include amorphous silicon hydrides (hereinafter "a-Si:H"). For example, U.S. Pat. No. 4,265,991 discloses its application in electrophotographic light-receiving members.

In such electrophotographic light-receiving members having a-Si:H, it is common to form photoconductive layers comprised of a-Si, by film forming processes such as vacuum deposition, sputtering, ion plating, heat-assisted CVD, light-assisted CVD and plasma-assisted CVD while heating conductive supports at 50° C. to 350° C. In particular, the plasma-assisted CVD, i.e., a process in which material gases are decomposed by direct-current, high-frequency or microwave glow discharging to form a-Si deposited films on the support, has been put into practical use as a preferred process.

German Patent Application Laid-open No. 30 46 509 discloses an electrophotographic light-receiving member having an a-Si photoconductive layer containing a halogen atom as a constituent (hereinafter "a-Si:X"photoconductive layer). This publication reports that incorporation of 1 to 40 atom % of halogen atoms into a-Si enables achievement of a high thermal resistance, and also electrical and optical properties preferable for a photoconductive layer of an electrophotographic light-receiving member.

Japanese Patent Application Laid-open No. 57-115556 also discloses a technique in which a surface barrier layer formed of a non-photoconductive amorphous material containing silicon atoms and carbon atoms is provided on a photoconductive layer formed of an amorphous material mainly composed of silicon atoms, in order to achieve improvements in photoconductive members having a photoconductive layer formed of an a-Si deposited film, in respect of their electrical, optical and photoconductive properties such as dark resistance, photosensitivity and response to light and service environmental properties such as moisture resistance and also in respect of stability with time. U.S. Pat. No. 4,659,639 discloses a technique concerning a photosensitive member superposingly provided with a light-transmitting insulating overcoat layer containing amorphous silicon, carbon, oxygen and fluorine. U.S. Pat. No. 4,788,120 discloses a technique in which an amorphous material containing silicon atoms, carbon atoms and 41 to 70 atom % of hydrogen atoms as constituents is used to form a surface layer.

U.S. Pat. No. 4,409,311 discloses that a highly sensitive and highly resistant, electrophotographic photosensitive member can be obtained by using in a photoconductive layer an a-Si:H containing 10 to 40 atom % of hydrogen and having absorption peaks at 2,100 $cm^{-1}$ and 2,000 $cm^{-1}$ in an infrared absorption spectrum which peaks are in a ratio of 0.2 to 1.7 as the coefficient of absorption.

Meanwhile, U.S. Pat. No. 4,607,936 discloses a technique in which, aiming at an improvement in image quality of an amorphous silicon photosensitive member, image forming steps such as charging, exposure, development and transfer are carried out while maintaining temperature at 30 to 40° C. in the vicinity of the surface of the photosensitive member to thereby prevent the surface of the photosensitive member from undergoing a decrease in surface resistance which is due to water absorption on that surface and also smeared images from occurring concurrently therewith.

These techniques have achieved improvements in electrical, optical and photoconductive properties and service environmental properties of electrophotographic light-receiving members, and also have concurrently brought about an improvement in image quality.

The electrophotographic light-receiving members having a photoconductive layer comprised of an a-Si material have individually achieved improvements in properties in respect of electrical, optical and photoconductive properties such as dark resistance, photosensitivity and response to light and service environmental properties and also in respect of stability with time, and running performance (durability). Under existing circumstance, however, there is room for further improvements to make overall properties better.

In particular, there is rapid progress in making electrophotographic apparatus with higher image quality, higher speed and higher running performance, and the electrophotographic light-receiving members are required to have improved in electrical properties and photoconductive properties and also to maintain their running performance over a longer period of time in every environment while maintaining charge performance and sensitivity.

Then, as a result of improvements made on optical exposure devices, developing devices, transfer devices and so forth in order to improve image characteristics of electrophotographic apparatus, the electrophotographic light-receiving members are now also required to be more improved in image characteristics than ever.

Under such circumstances, although the conventional techniques as noted above have made it possible to improve properties to a certain degree in respect of the subjects stated above, they can not be said to be satisfactory in regard to the further improvements in charge performance and image quality. In particular, as the subjects for making amorphous silicon light-receiving members have much higher image quality, it has now become more desirable to decrease exposure memory such as blank memory and ghost.

For example, hitherto, in order to prevent smeared images caused by photosensitive members, a drum heater for keeping a photosensitive member warm is set inside a copying machine to keep the surface temperature of the photosensitive member at about 40° C., as disclosed in U.S. Pat. No.

4,607,936. In conventional photosensitive members, however, the dependence of charge performance on temperature, called temperature-dependent properties, that is ascribable to the formation of pre-exposure carriers or heat-energized carriers is so great that, in the actual service environment inside copying machines, photosensitive members could not avoid being used in the state where they have a lower charge performance than that originally possessed by the photosensitive members. For example, the charge performance may drop by nearly 100 V in the state where the photosensitive members are heated to about 40° C. by a drum heater, compared with the case when used at room temperature.

At night when copying machines are not used, the drum heater is kept electrified in conventional cases so as to prevent the smeared images that are caused when ozone products formed by corona discharging of a charging assembly are adsorbed on the surface of a photosensitive member. Nowadays, however, it has become popular not to electrify copying machines at night for the purpose of saving natural resources and saving electric power.

When copies are continuously taken in such a state, the surrounding temperature of the photosensitive member inside a copying machine gradually rises to make charge performance lower with a rise of the temperature, causing the problem of a change in image density during the copying.

Namely, when the photosensitive member is continuously used, the surface temperature thereof rises as a result of charging and exposure to cause a lowering of charge performance, resulting in a change in image density during the copying to cause a lowering of image quality. Hence, in order to mount it in an ultra-high speed machine (copying on, e.g., 80 sheets or more per minute), it is necessary to decrease the temperature-dependent properties.

Meanwhile, in conventional photosensitive members, when the same original is continuously and repeatedly copied, a decrease in image density may occur or fog may occur because of exposure fatigue of photosensitive members as a result of imagewise exposure.

For example, when the same original is continuously and repeatedly copied, a change in image density (gradual increase or decrease in density) may occur because of accumulation of carriers or accumulation of charged carriers as a result of exposure (i.e., charge potential shift in continuous charging).

The exposure memory such as blank memory and what is called ghost have also come into question for the improvement of image quality; the blank memory being a phenomenon which causes a density difference on copied images, caused by what is called blank exposure that is applied to the photosensitive member at paper feed intervals during continuous copying in order to save toner, and the ghost being a phenomenon in which an image remaining after the imagewise exposure in previous copying (after-image) is produced on an image in the subsequent copying.

From the viewpoints of preventing the exposure memory, making an apparatus smaller in size, and considering ecological problems and saving energy, there is a demand for imagewise exposure assemblies having a smaller amount of exposure and a smaller size. Improvements in photosensitivity of photosensitive members, however, must be further advanced in order to meet such a demand.

In addition, in conventional photosensitive members, when the amount of exposure is increased so that an image with a strong contrast can be obtained from a color-background original, photo-carriers are produced in a large quantity because of application of intense exposure to cause a phenomenon in which the photo-carriers gather to and flow into portions to which they can readily move. This phenomenon has caused the problem of smeared images in intense exposure, what is called smeared EV, which causes blurred letters or characters.

Accordingly, in designing electrophotographic light-receiving members, it is required to achieve improvements from the overall viewpoints of layer configuration and chemical composition of each layer of electrophotographic light-receiving members so that the problems as discussed above can be solved, and also to achieve more improvements in properties of the a-Si materials themselves.

SUMMARY OF THE INVENTION

The present invention aims to solve of the problems involved in electrophotographic light-receiving members having the conventional light-receiving layer formed of a-Si as stated above.

That is, a main object of the present invention is to provide an electrophotographic light-receiving member having a light-receiving layer formed of a non-monocrystalline material mainly composed of silicon atoms, that is substantially always stable almost without dependence of electrical, optical and photoconductive properties on service environments, has superior resistance to exposure fatigue, has superior running performance and moisture resistance without causing any deterioration when repeatedly used, can be almost free from residual potential and also can achieve a good image quality, and a process for its production.

Another object of the present invention is to provide an electrophotographic light-receiving member having a light-receiving layer formed of a non-monocrystalline material mainly composed of silicon atoms, that has attained a decrease in temperature-dependent properties and exposure memory and has been improved in photosensitivity to achieve a dramatic improvement in image quality.

Still another object of the present invention is to provide an electrophotographic light-receiving member having a light-receiving layer formed of a non-monocrystalline material mainly composed of silicon atoms, that has attained a decrease in temperature-dependent properties and exposure memory and has been improved in photosensitivity to achieve a dramatic improvement in image quality.

A further object of the present invention is to provide an electrophotographic light-receiving member having a light-receiving layer formed of a non-monocrystalline material mainly composed of silicon atoms, that has attained a decrease in temperature-dependent properties and smeared images in intense exposure to achieve a dramatic improvement in image quality.

A still further object of the present invention is to provide an electrophotographic light-receiving member having a light-receiving layer formed of a non-monocrystalline material mainly composed of silicon atoms, that has attained a decrease in temperature-dependent properties to achieve a dramatic improvement in environmental resistance (resistance to the effects of the temperature inside copying machines and the outermost surface temperature of the light-receiving member), whereby images can be made highly stable even in continuous copying, and also has attained a decrease in exposure memory and charge potential shift in continuous charging to achieve a dramatic improvement in image quality, and a process for its production.

The present invention provides an electrophotographic light-receiving member comprising a conductive support and a light-receiving layer having a photoconductive layer showing photoconductivity, formed on the conductive support and formed of a non-monocrystalline material mainly composed of a silicon atom and containing at least one of a hydrogen atom and a halogen atom; wherein the photoconductive layer contains from 10 atom % to 30 atom % of hydrogen, the characteristic energy of exponential tail obtained from light absorption spectra at light-incident portions at least of the photoconductive layer is 50 meV to 60 meV, and the density of states of localization in the photoconductive layer is $1\times10^{14}$ $cm^{-3}$ to $1\times10^{16}$ $cm^{-3}$.

The present invention also provides an electrophotographic light-receiving member comprising a conductive support and a light-receiving layer having a photoconductive layer showing photoconductivity, formed on the conductive support and formed of a non-monocrystalline material mainly composed of a silicon atom and containing at least one of a hydrogen atom and a halogen atom; wherein the temperature dependence of charge performance in the light-receiving layer is within ±2 V/degree.

The present invention still also provides a process for producing an electrophotographic light-receiving member comprising a conductive support and a light-receiving layer having a photoconductive layer showing photoconductivity, formed on the conductive support and formed of a non-monocrystalline material mainly composed of a silicon atom and containing at least one of a hydrogen atom and a halogen atom; wherein the process comprising forming the photoconductive layer while controlling a discharge power so as to be A×B watt, and controlling the flow rate of a gas containing at least one of Group IIIb of the periodic table elements selected from B, Al, Ga, In or Tl and Group Vb of the periodic table elements selected from P, As, Sb or Bi so as to be A×C ppm, where A represents the total of the flow rates of a material gas and a dilute gas, B represents a constant of from 0.2 to 0.7 and C represents a constant of from $5\times10^{-4}$ to $5\times10^{-3}$, to thereby afford a temperature dependence of charge performance in the light-receiving layer, within ±2 V/degree.

DESCRIPTION OF THE PREFERRED EMBODIMENTS

Figure 1A:
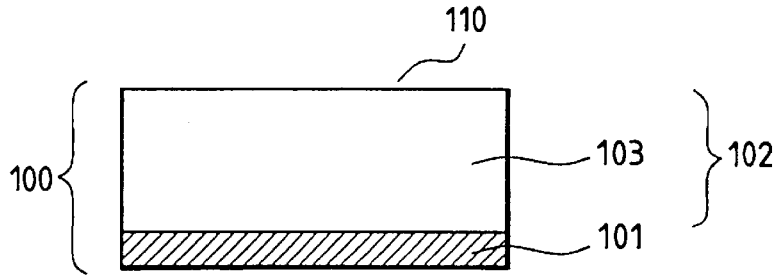
FIGS. 1A to 1D are each a schematic view of layer configuration to illustrate an example of the layer configuration of a preferred embodiment of the electrophotographic light-receiving member according to the present invention.

In band gaps of a-Si:H, there are commonly a tail (bottom) level ascribable to a structural disorder of Si—Si bonds and a deep level ascribable to structural imperfections of Si unbonded arms (dangling bonds) or the like. These levels are known to act as capture and recombination centers of electrons and holes to cause a lowering of properties of devices.

As methods for measuring the state of localized levels in such band gaps, deep-level spectroscopy, isothermal volume-excess spectroscopy, photothermal polarization spectroscopy, photoacoustic spectroscopy and the constant photocurrent method are commonly used. In particular, the constant photocurrent method (hereinafter "CPM") is useful as a method for simply measuring sub-gap light absorption spectra on the basis of localized levels of a-Si:H.

The present inventors have investigated the correlation between the characteristic energy at the exponential tail (Urbach tail) (hereinafter "Eu") or the density of states of localization (hereinafter "DOS") and properties of photosensitive members under various conditions. As a result, they have discovered that the Eu and DOS closely correlate with temperature-dependent properties and exposure memory of a-Si photosensitive members, and thus have achieved the present invention.

As the cause of a lowering of charge performance which occurs when the photosensitive member is heated by a drum heater or the like, it is considered that carriers thermally excited are led by electric fields formed at the time of charging to move toward the surface while repeating their capture to and release from the localized levels of band tails and deep localized levels in band gaps, and consequently cancel surface charges. Here, the carriers having reached the surface while passing through a charging assembly have little impact on the lowering of charge performance, but the carriers having been captured in the deep levels reach the surface after they have passed through the charging assembly, to cancel the surface charges, and hence this is observed as temperature-dependent properties. The carriers thermally excited after they have passed through the charging assembly also cancel the surface charges to cause a lowering of charge performance. Accordingly, in order to decrease the temperature-dependent properties, it is necessary to hinder the thermally excited carriers from being produced in the service temperature range of the photosensitive member and at the same time to improve the mobility of carriers.

The exposure memory is also caused when the photo-carriers produced by blank exposure or imagewise exposure are captured in the localized levels in band gaps and the carriers remain in the photoconductive layer. More specifically, among photo-carriers produced in a certain process of copying, the carriers having remained in the photoconductive layer are swept out by the electric fields formed by surface charges at the time of subsequent charging or thereafter and the potential at the portions exposed to light become lower than other portions, so that a density difference occurs on images. Hence, the mobility of carriers must be improved so that they can move through the photoconductive layer at one process of copying without allowing the photo-carriers to remain in the layer.

Thus, the controlling of Eu and DOS as in the present invention makes it possible to hinder the thermally excited carriers from being produced and also to decrease the proportion of thermally excited carriers or photo-carriers captured in the localized levels, so that the mobility of carriers can be remarkably improved. As the result, the temperature-dependent properties in the service temperature range of the electrophotographic light-receiving member can be remarkably decreased and at the same time the occurrence of exposure memory can be prevented. Hence, the stability of electrophotographic light-receiving members to service the environment can be improved, and high-quality images affording a sharp halftone and having a high resolution can be stably obtained.

Moreover, in the present invention, the intensity ratio of absorption peaks ascribable to Si—$H_2$ bonds and Si—H bonds is specified, whereby the mobility of carriers through layers of light-receiving members can be made uniform, so that the fine density difference in halftone images, what is called coarse images, can be decreased.

Hence, the electrophotographic light-receiving member of the present invention, designed to have such constitution, can settle all the problems previously discussed and exhibits very good electrical, optical and photoconductive properties, image quality, running performance and service environmental properties.

Meanwhile, in the photo-carriers produced upon exposure, electrons move toward the surface and holes toward the support side while repeating their capture to and release from the localized levels in band gaps as previously described. In that course, as also previously described, the exposure memory is caused when the photo-carriers produced by blank exposure or imagewise exposure are captured in the localized levels in band gaps and the carriers remain in the photoconductive layer. More specifically, among photo-carriers produced in a certain process of copying, the carriers having remained in the photoconductive layer are swept out by the electric fields formed by surface charges at the time of subsequent charging or thereafter and the potential at the portions exposed to light become lower than other portions, so that a density difference occurs on images. Hence, the mobility of carriers must be improved so that they can move through the photoconductive layer at one process of copying without allowing the photo-carriers to remain in the layer. Accordingly, taking note of the facts that the photo-carriers are mainly produced at positions relatively near to the surface and that electrons move toward the surface and holes toward the support side and the mobility of holes is very smaller than that of electrons, the present inventors have found that, in order to decrease the exposure memory and improve photosensitivity, it is necessary to increase the mobility of holes in the direction of the support.

Thus, the controlling of Eu and DOS so as to make their film in-plane average values constant as in the present invention and also making them distribute so as to decrease toward the support side makes it possible to hinder the thermally excited carriers from being produced, to decrease the proportion of carriers captured in the localized levels, and also to remarkably improve the mobility of holes toward the support side in the layer thickness direction. As the result, the temperature-dependent properties in the service temperature range of the electrophotographic light-receiving member can be remarkably decreased and at the same time a decrease in exposure memory and an improvement in photosensitivity can be achieved. Hence, the stability of electrophotographic light-receiving members to service the environment can be improved, and high-quality images affording a sharp halftone and having a high resolution can be stably obtained.

The electrophotographic light-receiving member of the present invention, designed to have such constitution, can settle all the problems previously discussed and exhibits very good electrical, optical and photoconductive properties, image quality, running performance and service environmental properties.

The photo-carriers produced upon exposure move toward the surface while repeating their capture to and release from the localized levels in band gaps as previously described. However, if the readiness for the carriers to move in the film in-plane direction is different, the carriers may gather to portions to which they can readily move, when photo-carriers are produced in a large quantity because of application of intense exposure. This causes the smeared EV, where the images obtained become blurred. Hence, it is necessary to hinder as far as possible the photo-carriers from moving in the photoconductive layer in its film in-plane direction and to improve the mobility of carriers so that the greater part of them can move only in the layer thickness direction.

Thus, the controlling of Eu and DOS so as to make their film in-plane average values constant as in the present invention and also making them distribute so as to decrease toward the surface makes it possible to hinder the thermally excited carriers from being produced, to decrease the proportion of carriers captured in the localized levels, and also to remarkably improve the mobility of carriers in the layer thickness direction. As the result, the temperature-dependent properties in the service temperature range of the electrophotographic light-receiving member can be remarkably decreased and at the same time the occurrence of exposure memory in intense exposure can be prevented. Hence, the stability of electrophotographic light-receiving members to service the environment can be improved, and high-quality images affording a sharp halftone and having a high resolution can be stably obtained.

The electrophotographic light-receiving member of the present invention, designed to have such constitution, can settle all the problems previously discussed and exhibits very good electrical, optical and photoconductive properties, image quality, running performance and service environmental properties.

The electrophotographic light-receiving member of the present invention will be described below in detail.

FIGS. 1A to 1D are each a schematic view to illustrate an example of preferable layer configuration of the electrophotographic light-receiving member according to the present invention.

The electrophotographic light-receiving member shown in FIG. 1A, denoted by reference numeral 100, comprises a support 101 for the light-receiving member, and a light-receiving layer 102 provided thereon. The light-receiving layer 102 has a photoconductive layer 103 having a photoconductivity, formed of, e.g., an a-Si(H,X) which is a kind of the non-monocrystalline material containing at least one of a hydrogen atom and a halogen atom and a silicon atom.

Figure 1B:
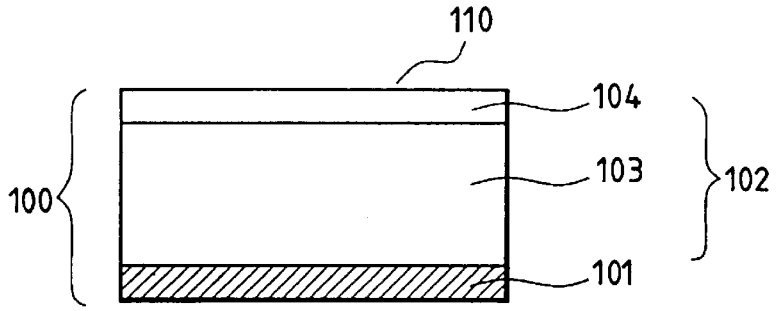

FIG. 1B is a schematic view to illustrate another example of layer configuration of the electrophotographic light-receiving member according to the present invention. The electrophotographic light-receiving member 100 shown in FIG. 1B comprises a support 101 for the light-receiving member, and a light-receiving layer 102 provided thereon. The light-receiving layer 102 has a photoconductive layer 103 having a photoconductivity, formed of, e.g., the a-Si(H, X), and an amorphous silicon type surface layer 104.

Figure 1C:
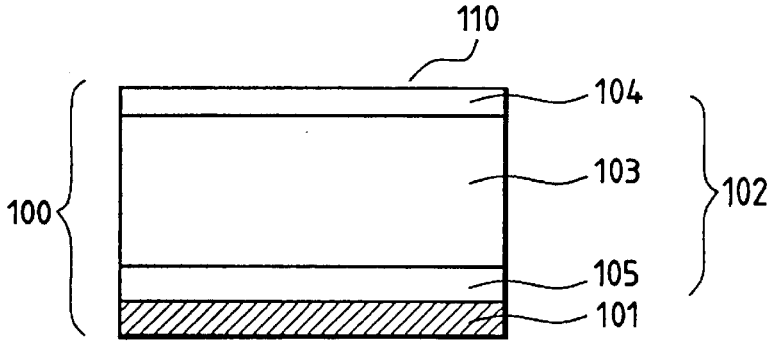

FIG. 1C is a schematic view to illustrate still another example of layer configuration of the electrophotographic light-receiving member according to the present invention. The electrophotographic light-receiving member 100 shown in FIG. 1C comprises a support 101 for the light-receiving member, and a light-receiving layer 102 provided thereon. The light-receiving layer 102 has a photoconductive layer 103 having a photoconductivity, formed of, e.g., the a-Si(H, X), an amorphous silicon type surface layer 104 and an amorphous silicon type charge injection blocking layer 105.

Figure 1D:
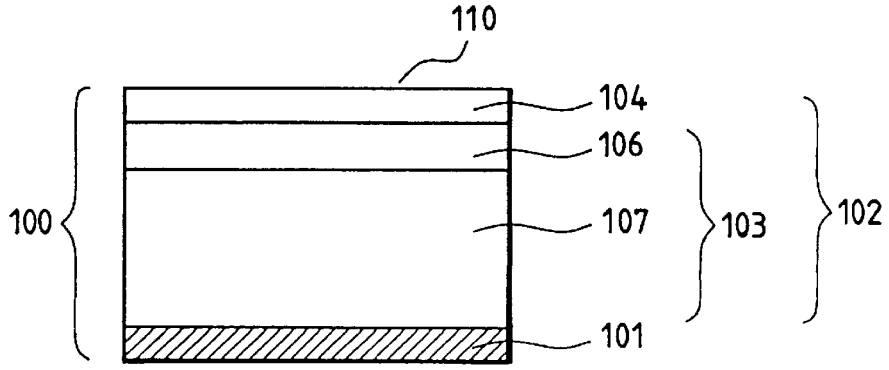

FIG. 1D is a schematic view to illustrate a further example of layer configuration of the electrophotographic light-receiving member according to the present invention. The electrophotographic light-receiving member 100 shown in FIG. 1D comprises a support 101 for the light-receiving member, and a light-receiving layer 102 provided thereon. The light-receiving layer 102 has an a-Si(H,X) charge generation layer 106 and a charge transport layer 107 that constitute the photoconductive layer 103, and an amorphous silicon type surface layer 104.

Support

The support used in the present invention may be either conductive or electrically insulating. The conductive support may include those made of, for example, a metal such as Al, Cr, Mo, Au, In, Nb, Te, V, Ti, Pt, Pb or Fe, or an alloy of any of these, as exemplified by stainless steel. The electrically insulating material may include a film or sheet of synthetic resin such as polyester, polyethylene, polycarbonate, cellulose acetate, polypropylene, polyvinyl chloride, polystyrene or polyamide, or glass or ceramic. In the present invention, an electrically insulating support made of any of these the surface of which has been subjected to conductive treatment at least on the side on which the light-receiving layer is formed may also be used as the support.

The support 101 used in the present invention may have the shape of a cylinder with a smooth plane or finely uneven surface, or a sheet-like endless belt. Its thickness may be appropriately determined so that the electrophotographic light-receiving member 100 can be formed as desired. In instances in which the electrophotographic light-receiving member 100 is required to have a flexibility, the support 101 may be made as thin as possible so long as it can function well as a support. In typical instances, however, the support 101 may have a thickness of 10 $\mu$m or more in view of its manufacture and handling, mechanical strength or the like.

When images are recorded using coherent light such as laser light, the surface of the support 101 may be made uneven so that any faulty images due to what is called interference fringes appearing in visible images can be canceled. The uneveness made on the surface of the support 101 can be produced by the known methods as disclosed in U.S. Pat. No. 4,650,736, U.S. Pat. No. 4,696,884 and U.S. Pat. No. 4,705,733.

As another method for canceling the faulty images due to interference fringes occurring when the coherent light such as laser light is used, the surface of the support 101 may be made uneven by making a plurality of sphere-traced concavities on the surface of the support 101. More specifically, the surface of the support 101 is made more finely uneven than the resolving power required for the electrophotographic light-receiving member 100, and also such uneveness is formed by a plurality of sphere-traced concavities. The uneveness formed by a plurality of sphere-traced concavities on the surface of the support 101 can be produced by the known method as disclosed in U.S. Pat. No. 4,735,883.

Photoconductive Layer

In the present invention, the photoconductive layer 103 that is formed on the support 101 in order to effectively achieve the object thereof and constitutes at least part of the light-receiving layer 102 is prepared by, e.g., a vacuum deposited film forming process under conditions appropriately numerically set in accordance with film forming parameters so as to achieve the desired performances, and under appropriate selection of materials gases used. Stated specifically, it can be formed by various thin-film deposition processes as exemplified by glow discharging including AC discharge CVD such as low-frequency CVD, high-frequency CVD or microwave CVD, DC discharge CVD; and sputtering, vacuum metallizing, ion plating, light CVD and heat CVD. When these thin-film deposition processes are employed, suitable ones are selected according to the conditions for manufacture, the extent of a load on capital investment in equipment, the scale of manufacture and the properties and performances desired on electrophotographic light-receiving members produced. Glow discharging, sputtering and ion plating are preferred in view of their relative easiness to control conditions in the manufacture of electrophotographic light-receiving members having the desired performances.

When, for example, the photoconductive layer 103 is formed by glow discharging, basically an Si-feeding material gas capable of feeding silicon atoms (Si), and an H-feeding material gas capable of feeding hydrogen atoms (H) and/or an X-feeding material gas capable of feeding halogen atoms (X) may be introduced in the desired gaseous state into a reactor whose inside can be evacuated, and glow discharge may be caused to take place in the reactor so that the layer comprised of a-Si(H,X) is formed on a given support 101 previously set at a given position.

In the present invention, the photoconductive layer 103 is required to contain hydrogen atoms and/or halogen atoms. This is because they are contained in order to compensate unbonded arms of silicon atoms in the layer and are essential and indispensable for improving layer quality, in particular, for improving photoconductivity and charge retentivity. The hydrogen atoms or halogen atoms or the total of hydrogen atoms and halogen atoms may preferably be in a content of from 10 to 30 atomic % (hereinafter "atom %"), and more preferably from 15 to 25 atom %, based on the total of the silicon atoms and the hydrogen atoms and/or halogen atoms.

The material that can serve as the Si-feeding gas used in the present invention may include gaseous or gasifiable silicon hydrides (silanes) such as $SiH_4$ $Si_2$ $H_6$, $Si_3H_8$ and $Si_4H_{10}$, which can be effectively used. In view of the readiness in handling for layer formation and Si-feeding efficiency, the material may preferably include $SiH_4$ and $Si_2H_6$.

To structurally incorporate the hydrogen atoms into the photoconductive layer 103 to be formed and in order to make it more easy to control the percentage of the hydrogen atoms to be incorporated, to obtain film properties that achieve the object of the present invention, the films must be formed in an atmosphere in which these gases are further mixed with a desired amount of $H_2$ and/or He or a gas of a silicon compound containing hydrogen atoms. Each gas may be mixed not only alone in a single species but also in a combination of plural species in a desired mixing ratio, without any problems.

An effective material gas for feeding halogen atoms used in the present invention may preferably include gaseous or gasifiable halogen compounds as exemplified by halogen gases, halides, halogen-containing interhalogen compounds and silane derivatives substituted with a halogen. The material may also include gaseous or gasifiable, halogen-containing silicon hydride compounds constituted of silicon atoms and halogen atoms, which can also be effective. Halogen compounds that can be preferably used in the present invention may specifically include fluorine gas ($F_2$) and interhalogen compounds comprising BrF, ClF, $ClF_3$, $BrF_3$, $BrF_5$, $IF_3$, $IF_7$ or the like. Silicon compounds containing halogen atoms, that is silane derivatives substituted with halogen atoms, may specifically include silicon fluorides such as $SiF_4$ and $Si_2F_6$, which are preferable examples.

In order to control the quantity of the hydrogen atoms and/or halogen atoms incorporated in the photoconductive layer 103, for example, the temperature of the support 101, the quantity of materials used to incorporate the hydrogen atoms and/or halogen atoms, the discharge power and so forth may be controlled.

In the present invention, the photoconductive layer 103 may preferably contain atoms capable of controlling its conductivity as occasion calls. The atoms capable of controlling the conductivity may be contained in the photoconductive layer 103 in an evenly uniformly distributed state, or may be contained partly in such a state that they are distributed non-uniformly in the layer thickness direction.

The atoms capable of controlling the conductivity may include impurities, as are used in the field of semiconductors, and it is possible to use atoms belonging to Group IIIb of the periodic table (hereinafter "Group IIIb atoms") capable of imparting p-type conductivity or atoms belonging to Group Vb of the periodic table (hereinafter "Group Vb atoms") capable of imparting n-type conductivity.

The Group IIIb atoms may specifically include boron (B), aluminum (Al), gallium (Ga), indium (In) and thallium (Ti). In particular, B, Al and Ga are preferred. The Group Vb atoms may specifically include phosphorus (P), arsenic (As), antimony (Sb) and bismuth (Bi). In particular, P and As are preferred.

The atoms capable of controlling the conductivity, contained in the photoconductive layer 103, may preferably be in an amount of from $1\times10^{-2}$ to $1\times10^{3}$ atomic ppm (hereinafter "atom ppm"), more preferably from $5\times10^{-2}$ to $5\times10^{2}$ atom ppm, and most preferably from $1\times10^{-1}$ to $1\times10^{2}$ atom ppm.

In order to structurally incorporate the atoms capable of controlling the conductivity, e.g., Group IIIb atoms or Group Vb atoms, a starting material for incorporating Group IIIb atoms or a starting material for incorporating Group Vb atoms may be fed, when the layer is formed, into the reactor in a gaseous state together with other gases used to form the photoconductive layer 103. Those which can be used as the starting material for incorporating Group IIIb atoms or the starting material for incorporating Group Vb atoms should be selected from those which are gaseous at normal temperature and normal pressure or at least those which can be readily gasified under conditions for the formation of the photoconductive layer.

Such a starting material for incorporating Group IIIb atoms may specifically include, as a material for incorporating boron atoms, boron hydrides such as $B_2H_6$, $B4H_{10}$, $B_5H_9$, $B_5H_{11}$ and $B_6H_{10}$, and boron halides such as $BF_3$, $BCl_3$ and $BBr_3$. The material may also include $GaCl_3$ and $Ga(CH_3)_3$. In particular, $B_2H_6$ is one of the preferred materials from the viewpoint of handling.

The material that can be effectively used as the starting material for incorporating Group Vb atoms may include, as a material for incorporating phosphorus atoms, phosphorus hydrides such as $PH_3$ and $P_2H_4$ and phosphorus halides such as $PF_3$, $PF_5$, $PCl_3$, $PCl_5$, $PBr_3$ and $PI_3$. The material that can be effectively used as the starting material for incorporating Group Vb atoms may also include $AsH_3$, $AsF_3$, $AsCl_3$, $AsBr_3$, $AsF_5$, $SbH_3$, $SbF_5$, $SbCl_5$, $BiH_3$ and $BiBr_3$.

These starting materials for incorporating the atoms capable of controlling the conductivity may be optionally diluted with a gas such as $H_2$ and/or He when used.

In the present invention, it is also effective to incorporate carbon atoms, oxygen atoms and/or nitrogen atoms. The carbon atoms, oxygen atoms and/or nitrogen atoms may preferably be in a content of from $1\times10^{-5}$ to 10 atom %, more preferably from $1\times10^{-4}$ to 8 atom %, and most preferably from $1\times10^{-3}$ to 5 atom %, based on the total of the silicon atoms, carbon atoms, oxygen atoms and nitrogen atoms. The carbon atoms, oxygen atoms and/or nitrogen atoms may be evenly distributed in the photoconductive layer, or may be partly non-uniformly distributed to change its content in the layer thickness direction of the photoconductive layer.

In the present invention, the thickness of the photoconductive layer 103 may be appropriately determined according to the properties or performance to be obtained and the properties or performance required. The layer may preferably be formed in a thickness of from 20 to 50 μm, more preferably from 23 to 45 μm, and still more preferably from 25 to 40 μm. If the layer thickness is smaller than 20 μm, the electrophotographic performances such as charge performance and sensitivity may become unsatisfactory for practical use. If it is larger than 50 μm, it may take a longer time to form photoconductive layers, resulting in an increase in production cost.

In order to form the photoconductive layer 103 that can achieve the object of the present invention and has the desired film properties, the mixing proportion of Si-feeding gas and dilute gas, the gas pressure inside the reactor, the discharge power and the support temperature must be appropriately set as desired.

The flow rate of $H_2$ and/or He optionally used as dilute gas may be appropriately selected within an optimum range in accordance with the designing of layer configuration, and $H_2$ and/or He may preferably be controlled within the range of from 3 to 20 times, more preferably from 4 to 15 times, and still more preferably from 5 to 10 times, based on the Si-feeding gas. The flow rate may preferably be controlled so as to be made constant within the value range.

When He is introduced, the total flow rate ($H_2$+He) of dilute gases may preferably be controlled within the above range and in which the flow rate of He may preferably be controlled to be 50% or less of the total flow rate.

The gas pressure inside the reactor may also be appropriately selected within an optimum range in accordance with the designing of layer configuration. The pressure may preferably be in the range of from $1\times10^{-4}$ to 10 Torr, more preferably from $5\times10^{-4}$ to 5 Torr, and still more preferably from $1\times10^{-3}$ to 1 Torr.

The discharge power may also be appropriately selected within an optimum range in accordance with the designing of layer configuration, where the ratio of the discharge power to the flow rate of Si-feeding gas may preferably be set in the range of from 2 to 7, more preferably from 2.5 to 6, and still more preferably from 3 to 5.

The temperature of the support 101 may also be appropriately selected within an optimum range in accordance with the designing of layer configuration. The temperature may preferably be set in the range of from 200 to 350° C., more preferably from 230 to 330° C., and still more preferably from 250 to 310° C.

As a method of forming films in such a manner that the values of Eu and DOS increase from the support side toward the surface side, while keeping constant the mixing ratio (diluting ratio) of, e.g., $SiH_4$ to hydrogen and/or He the discharge power (W/flow) and/or the support temperature (Ts) may preferably be continuously changed with respect to the flow rate of $SiH_4$.

In such a case, the discharge power may also be appropriately selected within an optimum range in accordance with the designing of layer configuration, where the discharge power with respect to the flow rate of Si-feeding gas may be changed so as to become continuously smaller from the support side toward the surface side preferably in the range of from 2 to 8 times, more preferably from 2.5 to 7 times, and still more preferably from 3 to 6 times.

The temperature of the support 101 may also be appropriately selected within an optimum range in accordance with the designing of layer configuration, where the temperature may be changed so as to become continuously lower from the support side toward the surface side preferably in the range of from 200 to 370° C., more preferably from 230 to 360° C., and still more preferably from 250 to 350° C.

As for a method of forming films in such a manner that the values of Eu and DOS decrease from the support side toward the surface side, while keeping constant the mixing ratio (diluting ratio) of, e.g., $SiH_4$ to hydrogen and/or He the discharge power (W/flow) and/or the support temperature (Ts) may preferably be continuously changed with respect to the flow rate of $SiH_4$.

In such a case, the discharge power may also be appropriately selected within an optimum range in accordance with the designing of layer configuration, where the discharge power with respect to the flow rate of Si-feeding gas may be changed so as to become continuously smaller from the support side toward the surface side preferably in the range of from 2 to 8 times, more preferably from 2.5 to 7 times, and still more preferably from 3 to 6 times.

The temperature of the support 101 may also be appropriately selected within an optimum range in accordance with the designing of layer configuration, where the temperature may be changed so as to become continuously lower from the support side toward the surface side preferably in the range of from 200 to 370° C., more preferably from 230 to 360° C., and still more preferably from 250 to 350° C.

In order to effectively make treatment of the outermost film surface, the discharge power may be controlled within a specific range with respect to the total of the flow rates of material gas and dilute gas and also the flow rate of the gas containing the elements belonging to Group IIIb or Group Vb of the periodic table may be controlled within a specific range with respect to the total of the flow rates of material gas and dilute gas, whereby as aimed in the present invention the temperature-dependent properties, the exposure memory and the charge potential shift in continuous charging can be decreased to achieve a dramatic improvement in image quality.

As previously stated, when, for example, the photoconductive layer 103 is formed by glow discharging, basically an Si-feeding material gas capable of feeding silicon atoms (Si), an H-feeding material gas capable of feeding hydrogen atoms (H) and/or an X-feeding material gas capable of feeding halogen atoms (X) may be introduced in the desired gaseous state into a reactor whose inside can be evacuated, and glow discharge may be caused to take place in the reactor so that the layer comprised of a-Si(H,X) is formed on a given support 101 previously set at a given position.

In this instance, assume that A represents the sum of the flow rates of a material gas and a dilute gas, B represents a constant of from 0.2 to 0.7 and C represents a constant of from $5\times10^{-4}$ to $5\times10^{-3}$, the discharging power may preferably be controlled so as to be A×B watt, and also the flow rate of a gas containing an element belonging to Group IIIb or Group Vb of the periodic table may preferably be controlled so as to be A×C ppm.

As for the content of atoms capable of controlling the conductivity, contained in the photoconductive layer 103, it may also be controlled so as to be in a specific range with respect to the total of the flow rates of material gas and dilute gas, whereby the object of the present invention can be effectively achieved. Stated more specifically, assume that A represents the total of the flow rates of a material gas and a dilute gas and C represents a constant of from $5\times10^{-4}$ to $5\times10^{-3}$, the flow rate of a gas containing an element belonging to Group IIIb or Group Vb of the periodic table may preferably be controlled so as to be A×C ppm.

In the present invention, preferable numerical values for the support temperature and gas pressure necessary to form the photoconductive layer may be in the ranges as defined above. In typical instances, these conditions can not be independently separately determined. Optimum values should be determined on the basis of mutual and systematic relationships so that the light-receiving member having the desired properties can be formed.

Surface Layer

In the present invention, the surface layer 104 of an amorphous silicon type may preferably be further formed on the photoconductive layer 103 formed on the support 101 in the manner as described above. This surface layer 104 has a free surface 110, and is provided so that the object of the present invention can be achieved mainly with regard to moisture resistance, performance on continuous repeated use, electrical breakdown strength, service environmental properties and running performance.

In the present invention, the photoconductive layer 103 constituting the light-receiving layer 102 and the amorphous material forming the surface layer 104 each have common constituents, silicon atoms, and hence a chemical stability is well ensured at the interface between layers.

The surface layer 104 may be formed using any materials so long as they are amorphous silicon type materials, as exemplified by an amorphous silicon containing a hydrogen atom (H) and/or a halogen atom (X) and further containing a carbon atom (hereinafter "a-SiC(H,X)), an amorphous silicon containing a hydrogen atom (H) and/or a halogen atom (X) and further containing an oxygen atom (hereinafter "a-SiO(H,X)), an amorphous silicon containing a hydrogen atom (H) and/or a halogen atom (X) and further containing a nitrogen atom (hereinafter "a-SiN(H,X)), and an amorphous silicon containing a hydrogen atom (H) and/or a halogen atom (X) and further containing at least one of a carbon atom, an oxygen atom and a nitrogen atom (hereinafter "a-SiCON(H,X)), any of which can be preferably used.

In the present invention, in order to effectively achieve the object thereof, the surface layer 104 is prepared by a vacuum deposited film forming process under conditions appropriately numerically set in accordance with film forming parameters so as to achieve the desired performances. Stated specifically, it can be formed by various thin-film deposition processes as exemplified by glow discharging including AC discharge CVD such as low-frequency CVD, high-frequency CVD or microwave CVD, and DC discharge CVD; and sputtering, vacuum metallizing, ion plating, light CVD and heat CVD. When these thin-film deposition processes are employed, suitable ones are selected according to the conditions for manufacture, the extent of a load on capital investment in equipment, the scale of manufacture and the properties and performances desired on electrophotographic light-receiving members produced. In view of productivity of light-receiving members, it is preferable to use the same deposition process as the photoconductive layer.

When, for example, the surface layer 104 comprised of a-SiC(H,X) is formed by glow discharging, basically an Si-feeding material gas capable of feeding silicon atoms (Si), a C-feeding material gas capable of feeding carbon atoms (C), and an H-feeding material gas capable of feeding hydrogen atoms (H) and/or an X-feeding material gas capable of feeding halogen atoms (X) may be introduced in the desired gaseous state into a reactor whose inside can be evacuated, and glow discharge may be caused to take place in the reactor so that the layer comprised of a-SiC(H,X) is formed on the support 101 previously set at a given position and on which the photoconductive layer 103 has been formed.

As materials for the surface layer in the present invention, any amorphous materials containing silicon may be used. Compounds with silicon atoms containing at least one element selected from carbon, nitrogen and oxygen are preferred. In particular, those mainly composed of a-SiC are preferred.

Especially when the surface layer is formed of a-SiC as a main constituent, its carbon content may preferably be in the range of from 30% to 90% based on the total of silicon atoms and carbon atoms.

In the present invention, the surface layer 104 is required to contain hydrogen atoms and/or halogen atoms. This is because they are contained in order to compensate unbonded arms of constituent atoms such as silicon atoms and are essential and indispensable for improving layer quality, in particular, for improving photoconductivity and charge retentivity. The hydrogen atoms may preferably be in a content of from 30 to 70 atom %, more preferably from 35 to 65 atom %, and still more preferably from 40 to 60 atom %, based on the total amount of constituent atoms. The fluorine atoms may preferably be in a content of from 0.01 to 15 atom %, more preferably from 0.1 to 10 atom %, and still more preferably from 0.6 to 4 atom %.

The light-receiving member formed to have the hydrogen content and/or fluorine content within these ranges is well applicable as a product hitherto unavailable and remarkably superior in its practical use. More specifically, any defects or imperfections (mainly comprised of dangling bonds of silicon atoms or carbon atoms) present inside the surface layer are known to have ill influences on the properties required for electrophotographic light-receiving members. For example, charge performance may deteriorate because of the injection of charges from the free surface; charge performance may vary because of changes in surface structure in a service environment, e.g., in an environment of high humidity; and the injection of charges into the surface layer on account of the photoconductive layer at the time of corona discharging or irradiation with light may cause a phenomenon of after images during repeated use because of entrapment of charges in the defects inside the surface layer. These can be given as the ill influences.

However, the controlling of the hydrogen content in the surface layer so as to be 30% by weight or more brings about a great decrease in the defects inside the surface layer, so that all the above problems can be solved and dramatic improvements can be achieved in respect of electrical properties and high-speed continuous-use performance compared with conventional cases.

On the other hand, if the hydrogen content in the surface layer is more than 71 atom %, the hardness of the surface layer may become lower, and hence the layer can not endure the repeated use in some instances. Thus, the controlling of hydrogen content in the surface layer within the range set out above is one of the very important factors for obtaining much superior electrophotographic performance as desired. The hydrogen content in the surface layer can be controlled according to the flow rate (ratio) of material gases, the support temperature, the discharge power, the gas pressure and so forth.

The controlling of fluorine content in the surface layer so as to be within the range of 0.01 atom % or more also makes it possible to effectively generate the bonds between silicon atoms and carbon atoms in the surface layer. As a function of the fluorine atoms in the surface layer, it also becomes possible to effectively prevent the bonds between silicon atoms and carbon atoms from breaking because of damage caused by coronas or the like.

On the other hand, if the fluorine content in the surface layer is more than 15 atom %, it becomes almost ineffective to generate the bonds between silicon atoms and carbon atoms in the surface layer and to prevent the bonds between silicon atoms and carbon atoms from breaking because of damage caused by coronas or the like. Moreover, residual potential and image memory may become remarkably seen because the excessive fluorine atoms inhibit the mobility of carriers in the surface layer. Thus, the controlling of fluorine content in the surface layer within the range set out above is one of important factors for obtaining the desired electrophotographic performance. The fluorine content in the surface layer can be controlled according to the flow rate (flow ratio) of material gases, the support temperature, the discharge power, the gas pressure and so forth.

Materials that can serve as material gases for feeding silicon (Si), used to form the surface layer in the present invention, may include gaseous or gasifiable silicon hydrides (silanes) such as $SiH_4$, $Si_2H_6$, $Si_3H_8$ and $Si_4H_{10}$, which can be effectively used. In view of readiness in handling for layer formation and Si-feeding efficiency, the material may preferably include $SiH_4$ and $Si_2H_6$. These Si-feeding material gases may be used optionally after their dilution with a gas such as $H_2$, He, Ar or Ne.

Materials that can serve as material gases for feeding carbon (C) may include gaseous or gasifiable hydrocarbons such as $CH_4$, $C_2H_2$, $C_2H_6$, $C_3H_8$ and $C_4H_{10}$. In view of the readiness in handling for layer formation and C-feeding efficiency, the material may preferably include $CH_4$, $C_2H_2$ and $C_2H_6$. These C-feeding material gases may be used optionally after their dilution with a gas such as $H_2$, He, Ar or Ne.

Materials that can serve as material gases for feeding nitrogen or oxygen may include gaseous or gasifiable compounds such as $NH_3$, NO, $NH_2O$, $NO_2$, $O_2$, CO, $CO_2$ and $N_2$. These nitrogen- or oxygen-feeding material gases may be used optionally after their dilution with a gas such as $H_2$, He, Ar or Ne.

To make it more easy to control the percentage in which the hydrogen atoms are incorporated into the surface layer 104 to be formed, the films may preferably be formed in an atmosphere in which these gases are further mixed with a desired amount of hydrogen gas or a gas of a silicon compound containing hydrogen atoms. Each gas may be mixed not only alone in a single species but also in a combination of plural species in a desired mixing ratio, without any problems.

A material effective as a material gas for feeding halogen atoms may preferably include gaseous or gasifiable halogen compounds as exemplified by halogen gases, halides, halogen-containing interhalogen compounds and silane derivatives substituted with a halogen. The material may also include gaseous or gasifiable, halogen-containing silicon hydride compounds constituted of silicon atoms and halogen atoms, which can be also effective. Halogen compounds that can be preferably used in the present invention may specifically include fluorine gas ($F_2$) and interhalogen compounds comprising BrF, ClF, $ClF_3$, $BrF_3$, $BrF_5$, $IF_3$, $IF_7$ or the like. Silicon compounds containing halogen atoms, that is, silane derivatives substituted with halogen atoms, may specifically include silicon fluorides such as $SiF_4$ and $Si_2F_6$, which are preferable examples.

In order to control the quantity of the hydrogen atoms and/or halogen atoms incorporated in the surface layer 104, for example, the temperature of the support 101, the quantity of materials used to incorporate the hydrogen atoms and/or halogen atoms, the discharge power and so forth may be controlled.

The carbon atoms, oxygen atoms and/or nitrogen atoms may be evenly distributed in the surface layer, or may be partly non-uniformly distributed so as for its content to change in the layer thickness direction of the surface layer.

In the present invention, the surface layer 104 may preferably also contain atoms capable of controlling its conductivity as occasion calls. The atoms capable of controlling the conductivity may be contained in the surface layer 104 in an evenly uniformly distributed state, or may be contained partly in such a state that they are distributed non-uniformly in the layer thickness direction.

The atoms capable of controlling the conductivity may include impurities, as are used in the field of semiconductors, and it is possible to use atoms belonging to Group IIIb of the periodic table (hereinafter "Group IIIb atoms") capable of imparting p-type conductivity or atoms belonging to Group Vb of the periodic table (hereinafter "Group Vb atoms") capable of imparting n-type conductivity.

The Group IIIb atoms may specifically include boron (B), aluminum (Al), gallium (Ga), indium (In) and thallium (Tl). In particular, B, Al and Ga are preferred. The Group Vb atoms may specifically include phosphorus (P), arsenic (As), antimony (Sb) and bismuth (Bi). In particular, P and As are preferred.

The atoms capable of controlling the conductivity, contained in the surface layer 104, may preferably be in an amount of from $1\times10^{-3}$ to $1\times10^{3}$ atom ppm, more preferably from $1\times10^{-2}$ to $5\times10^{2}$ atom ppm, and most preferably from $1\times10^{-1}$ to $1\times10^{2}$ atom ppm.

In order to structurally incorporate the atoms capable of controlling the conductivity, e.g., Group IIIb atoms or Group Vb atoms, a starting material for incorporating Group IIIb atoms or a starting material for incorporating Group Vb atoms may be fed, when the layer is formed, into the reactor in a gaseous state together with other gases used to form the surface layer 104. Those which can be used as the starting material for incorporating Group IIIb atoms or starting material for incorporating Group Vb atoms should be selected from those which are gaseous at normal temperature and normal pressure or at least those which can be readily gasified under conditions for the formation of the photoconductive layer. Such a starting material for incorporating Group IIIb atoms may specifically include, as a material for incorporating boron atoms, boron hydrides such as $B_2H_6$, $B_4H_{10}$, $B_5H_9$, $B_5H_{11}$ and $B_6H_{10}$, and boron halides such as $BF_3$, $BCl_3$ and $BBr_3$. The material may also include $GaCl_3$ and $Ga(CH_3)_3$.

The material that can be effectively used as the starting material for incorporating Group Vb atoms may include, as a material for incorporating phosphorus atoms, phosphorus hydrides such as $PH_3$ and $P_2H_4$ and phosphorus halides such as $PF_3$, $PF_5$, $PCl_3$, $PCl_5$, $PBr_3$ and $PI_3$. The material that can be effectively used as the starting material for incorporating Group Vb atoms may also include $AsH_3$, $AsF_3$, $AsCl_3$, $AsBr_3$, $AsF_5$, $SbH_3$, $SbF_5$, $SbCl_5$, $BiH_3$ and $BiBr_3$.

These starting materials for incorporating the atoms capable of controlling the conductivity may be used optionally after their dilution with a gas such as $H_2$, He, Ar or Ne.

The surface layer 104 in the present invention may preferably be formed in a thickness of from 0.01 to 3 $\mu$m, more preferably from 0.05 to 2 $\mu$m, and still more preferably from 0.1 to 1 $\mu$m. If the layer thickness is smaller than 0.01

μm, the surface layer tends to become lost because of friction or the like during the use of the light-receiving member. If it is larger than 3 μm, a lowering of electrophotographic performance such as an increase in residual potential may occur.

The surface layer 104 according to the present invention is carefully formed so that the required performances can be imparted as desired. More specifically, from the structural viewpoint, the material constituted of i) at least one element selected from the group consisting of Si, C, N and O and ii) H and/or X takes the form of from crystal such as polycrystal or microcrystal to amorphous (generically termed as "non-monocrystal") depending on the conditions for its formation. From the viewpoint of electric properties, it exhibits the nature of conductive to semiconductive and up to insulating, and also the nature of from photoconductive to non-photoconductive. Accordingly, in the present invention, the conditions for its formation are severely selected as desired so that a compound having the desired properties as intended can be formed.

For example, in order to provide the surface layer 104 mainly for the purpose of improving its breakdown strength, the compound is prepared as a non-monocrystalline material having a remarkable electrical insulating behavior in the service environment.

When the surface layer 104 is provided mainly for the purpose of improving the performance on continuous repeated use and service environmental properties, the compound is formed as a non-monocrystalline material having become lower in its degree of the above electrical insulating properties to a certain extent and having a certain sensitivity to the light with which the layer is irradiated.

In order to form the surface layer 104 having the desired properties that can achieve the object of the present invention, the temperature of the support 101 and the gas pressure inside the reactor must be appropriately set as desired.

The temperature (Ts) of the support 101 may be appropriately selected within an optimum range in accordance with the designing of layer configuration. In typical instances, the temperature may preferably be set in the range of from 200 to 350° C., more preferably from 230 to 330° C., and still more preferably from 250 to 310° C.

The gas pressure inside the reactor may also be appropriately selected within an optimum range in accordance with the designing of layer configuration. The pressure may preferably be in the range of from $1\times10^{-4}$ to 10 Torr, more preferably from $5\times10^{-4}$ to 5 Torr, and still more preferably from $1\times10^{-3}$ to 1 Torr.

In the present invention, preferable numerical values for the support temperature and gas pressure necessary to form the surface layer may be in the ranges as defined above. In typical instances, these conditions can not be independently separately determined. Optimum values should be determined on the basis of mutual and systematic relationships so that the light-receiving member having the desired properties can be formed.

In the present invention, an intermediate layer (a lower surface layer) having a smaller content of carbon atoms, oxygen atoms and nitrogen atoms than the surface layer may be further provided between the photoconductive layer and the surface layer. This is effective for further improving performances such as charge performance.

Between the surface layer 104 and the photoconductive layer 103, there may also be provided a region in which the content of carbon atoms, oxygen atoms and/or nitrogen atoms changes in the manner that it decreases toward the photoconductive layer 103. This makes it possible to improve the adhesion between the surface layer and the photoconductive layer, and further decrease an influence of interference due to reflected light at the interface between the layers.

Charge Injection Blocking Layer

In the electrophotographic light-receiving member of the present invention, it is more effective to provide between the conductive support and the photoconductive layer a charge injection blocking layer having the function to block the injection of charges from the conductive support side. More specifically, the charge injection blocking layer has the function to prevent charges from being injected from the support side to the photoconductive layer side when the light-receiving layer is subjected to charging in a certain polarity on its free surface, and exhibits no such function when subjected to charging in a reverse polarity, which is called polarity dependence. In order to impart such function, atoms capable of controlling its conductivity are incorporated in a relatively large content compared with those in the photoconductive layer.

The atoms capable of controlling the conductivity, contained in that layer, may be evenly uniformly distributed in the layer, or may be evenly contained in the layer thickness but contained partly in such a state that they are distributed non-uniformly. In the case when they are distributed in a non-uniform concentration, they may preferably be contained so as to be distributed in a larger quantity on the support side.

In any case, however, in the in-plane direction parallel to the surface of the support, it is necessary for such atoms to be evenly contained in a uniform distribution so that the properties in the in-plane direction can also be made uniform.

The atoms capable of controlling the conductivity, incorporated in the charge injection blocking layer, may include impurities, as are used in the field of semiconductors, and it is possible to use atoms belonging to Group IIIb of the periodic table (hereinafter "Group IIIb atoms") capable of imparting p-type conductivity or atoms belonging to Group Vb of the periodic table (hereinafter "Group Vb atoms") capable of imparting n-type conductivity.

The Group IIIb atoms may specifically include boron (B), aluminum (Al), gallium (Ga), indium (In) and thallium (Tl). In particular, B, Al and Ga are preferred. The Group Vb atoms may specifically include phosphorus (P), arsenic (As), antimony (Sb) and bismuth (Bi). In particular, P and As are preferred.

The atoms capable of controlling the conductivity, contained in the charge injection blocking layer in the present invention, may preferably-be in an amount of from 10 to $1\times10^4$ atom ppm, more preferably from 50 to $5\times10^3$ atom ppm, and still more preferably from $1\times10^2$ to $3\times10^3$ atom ppm, which may be appropriately determined as desired so that the object of the present invention can be effectively achieved.

The charge injection blocking layer may be further incorporated with at least one kind of carbon atoms, nitrogen atoms and oxygen atoms. This enables further improvement of the adhesion between the charge injection blocking layer and other layers provided in direct contact therewith.

The carbon atoms, nitrogen atoms or oxygen atoms contained in that layer may be evenly uniformly distributed in the layer, or may be evenly contained in the layer thickness direction but contained partly in such a state that they are distributed non-uniformly. In any case, however, in the in-plane direction parallel to the surface of the support, it is necessary for such atoms to be evenly contained in a uniform distribution so that the properties in the in-plane direction can also be made uniform.

The carbon atoms, nitrogen atoms and/or oxygen atoms contained in the whole layer region of the charge injection blocking layer in the present invention may preferably be in an amount, as an amount of one kind thereof or as a total of two or more kinds, of from $1\times10^{-3}$ to 50 atom %, more preferably from $5\times10^{-3}$ to 30 atom %, and still more preferably from $1\times10^{-2}$ to 10 atom %, which may be appropriately determined so that the object of the present invention can be effectively achieved.

Hydrogen atoms and/or halogen atoms may be contained in the charge injection blocking layer in the present invention, which are effective for compensating unbonded arms of constituent atoms to improve film quality. The hydrogen atoms or halogen atoms or the total of hydrogen atoms and halogen atoms in the charge injection blocking layer may preferably be in a content of from 1 to 50 atom %, more preferably from 5 to 40 atom %, and still more preferably from 10 to 30 atom %.

The charge injection blocking layer 105 in the present invention may preferably be formed in a thickness of from 0.1 to 5 $\mu$m, more preferably from 0.3 to 4 $\mu$m, and still more preferably from 0.5 to 3 $\mu$m. If the layer thickness is smaller than 0.1 $\mu$m, the ability to block the injection of charges from the support may become insufficient to obtain no satisfactory charge performance. Even if it is made larger than 5 $\mu$m, the time taken to form the layer becomes longer to cause an increase in production cost, rather than a substantial improvement in electrophotographic performance.

To form the charge injection blocking layer in the present invention, the same vacuum deposition process as in the formation of the photoconductive layer previously described may be employed.

In order to form the charge injection blocking layer 105 having the properties that can achieve the object of the present invention, the mixing proportion of Si-feeding gas and dilute gas, the gas pressure inside the reactor, the discharge power and the temperature of the support 10 must be appropriately set.

The flow rate of $H_2$ and/or He as dilute gas may be appropriately selected within an optimum range in accordance with the designing of layer configuration, and $H_2$ and/or He may preferably be controlled within the range of from 1 to 20 times, more preferably from 3 to 15 times, and still more preferably from 5 to 10 times, based on the Si-feeding gas.

The gas pressure inside the reactor may also be appropriately selected within an optimum range in accordance with the designing of layer configuration. The pressure may preferably be in the range of from $1\times10^{-4}$ to 10 Torr, more preferably from $5\times10^{-4}$ to 5 Torr, and still more preferably from $1\times10^{-3}$ to 1 Torr.

The discharge power may also be appropriately selected within an optimum range in accordance with the designing of layer configurations, where the ratio of the discharge power to the flow rate of Si-feeding gas may preferably be set in the range of from 1 to 7, more preferably from 2 to 6, and still more preferably from 3 to 5.

The temperature of the support 101 may also be appropriately selected within an optimum range in accordance with the designing of layer configurations. The temperature may preferably be set in the range of from 200 to 350° C., more preferably from 230 to 330° C., and still more preferably from 250 to 310° C.

In the present invention, preferable numerical values for the dilute gas mixing ratio, gas pressure, discharge power and support temperature necessary to form the charge injection blocking layer may be in the ranges as defined above. In typical instances, these conditions can not be independently separately determined. Optimum values should be determined on the basis of mutual and systematic relationships so that the surface layer having the desired properties can be formed.

In addition to the foregoing, in the electrophotographic light-receiving member of the present invention, the light-receiving layer 102 may preferably have, on its side of the support 101, a layer region in which at least aluminum atoms, silicon atoms and hydrogen atoms and/or halogen atoms are contained in such a state that they are distributed non-uniformly in the layer thickness direction.

In the electrophotographic light-receiving member of the present invention, for the purpose of further improving the adhesion between the support 101 and the photoconductive layer 103 or charge injection blocking layer 105, an adherent layer may be provided which is formed of, e.g., $Si_3N_4$, $SiO_2$, SiO, or an amorphous material mainly composed of silicon atoms and containing hydrogen atoms and/or halogen atoms and carbon atoms and/or oxygen atoms and/or nitrogen atoms. A light absorption layer may also be provided for preventing occurrence of interference fringes due to the light reflected from the support.

Apparatus and film forming methods for forming the light-receiving layer will be described below in detail.

Figure 2:
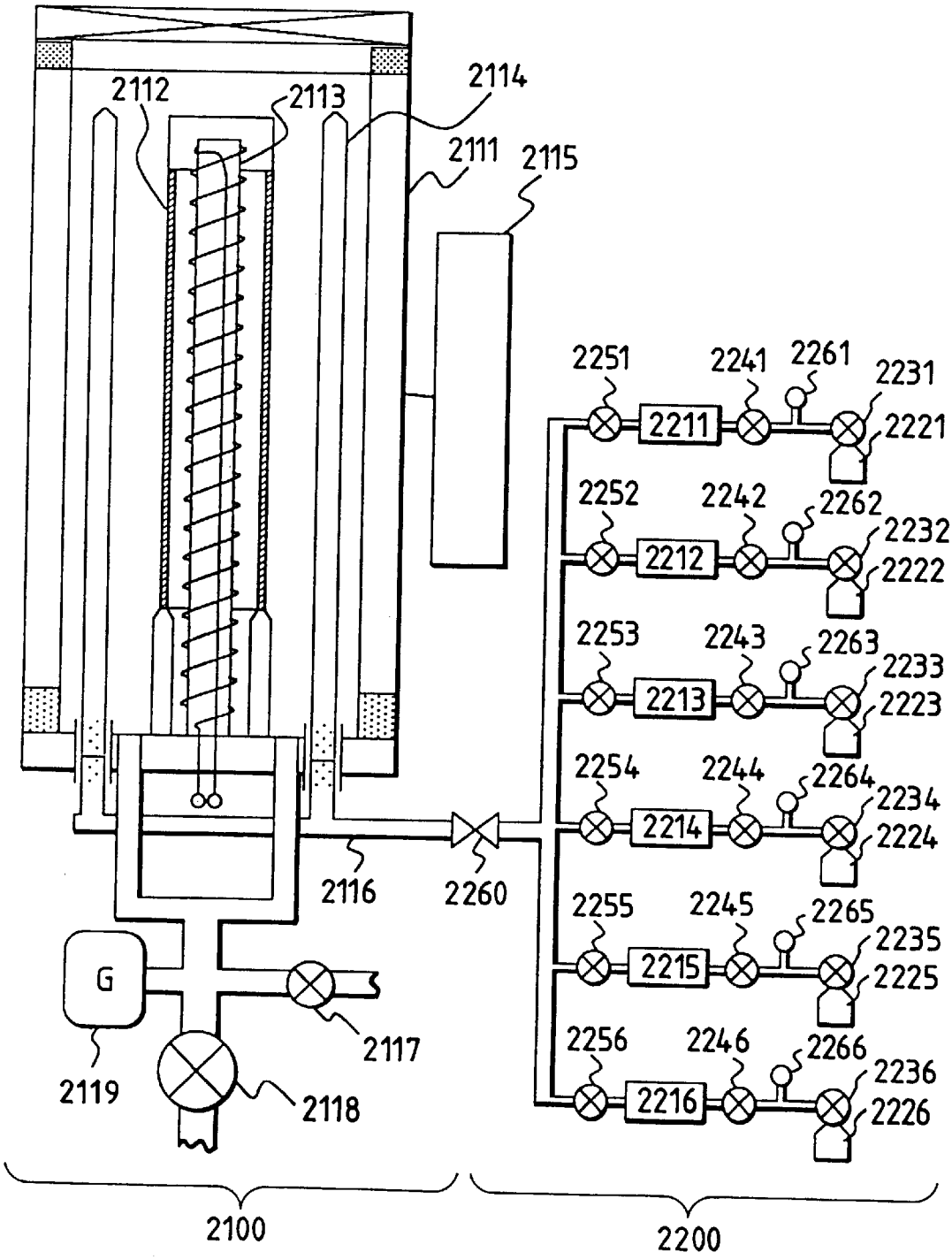
FIG. 2 is a diagrammatic view of an example of an apparatus used to form the light-receiving layer of the electrophotographic light-receiving member of the present invention, which is an apparatus for producing electrophotographic light-receiving members by a glow discharge process using RF band high frequency.

FIG. 2 diagrammatically illustrates the constitution of a preferred example of an apparatus for producing the electrophotographic light-receiving member by high-frequency plasma-assisted CVD making use of frequencies of RF bands (hereinafter simply "RF-PCVD"). The production apparatus shown in FIG. 2 is constituted in the following way.

This apparatus is mainly constituted of a deposition system 2100, a material gas feed system 2220 and an exhaust system (not shown) for evacuating the inside of a reactor 2111. In the reactor 2111 in the deposition system 2100, a cylindrical support 2112, a support heater 2113 and a material gas feed pipe (not shown) are provided. A high-frequency matching box 2115 is also connected to the reactor.

The material gas feed system 2220 is constituted of gas cylinders 2221 to 2226 for material gases such as $SiH_4$, $GeH_4$, $H_2$, $CH_4$, $B_2H_6$ and $PH_3$, valves 2231 to 2236, 2241 to 2246 and 2251 to 2256, and mass flow controllers 2211 to 2216. The gas cylinders for the respective material gases are connected to a gas feed pipe 2114 in the reactor 2111 through a valve 2260.

Using this apparatus, deposited films can be formed, e.g., in the following way.

The cylindrical support 2112 is set in the reactor 2111, and the inside of the reactor 2111 is evacuated by means of an exhaust device (not shown). Subsequently, the temperature of the support 2112 is controlled at a given temperature of, e.g., from 200° C. to 350° C. by means of the heater 2113 for heating the support.

Before material gases for forming deposited films are flowed into the reactor 2111, gas cylinder valves 2231 to 2236 and a leak valve 2117 of the reactor are checked to make sure that they are closed, and also flow-in valves 2241 to 2246, flow-out valves 2251 to 2256 and an auxiliary valve 2260 are checked to make sure that they are opened. Then, firstly a main valve 2118 is opened to evacuate the insides of the reactor 2111 and a gas pipe 2116.

Next, at the time a vacuum gauge 2119 has been read to indicate a pressure of about $5\times10^{-6}$ Torr, the auxiliary valve 2260 and the flow-out valves 2251 to 2256 are closed.

Thereafter, gas cylinder valves 2231 to 2236 are opened so that gases are respectively introduced from gas cylinders 2221 to 2226, and each gas is controlled to have a pressure of 2 kg/cm$^2$ by operating pressure controllers 2261 to 2266. Next, the flow-in valves 2241 to 2246 are slowly opened so that gases are respectively introduced into mass flow controllers 2211 to 2216.

After the film formation is thus ready to start, the respective layers are formed according to the following procedure.

At the time the cylindrical support 2112 has had a given temperature, some necessary flow-out valves 2251 to 2256 and the auxiliary valve 2260 are slowly opened so that given gases are fed into the reactor 2111 from the gas cylinders 2221 to 2226 through a gas feed pipe 2114. Next, the mass flow controllers 2211 to 2216 are operated so that each material gas is adjusted to flow at a given rate. In that course, the opening of the main valve 2118 is so adjusted that the pressure inside the reactor 2111 comes to be a given pressure of not higher than 1 Torr, while watching the vacuum gauge 2119. At the time the inner pressure has become stable, an RF power source (not shown) with a frequency of 13.56 MHz is set at the desired electric power, and an RF power is supplied to the inside of the reactor 2111 through the high-frequency matching box 2115 to cause glow discharge to take place. The material gases fed into the reactor are decomposed by the discharge energy thus produced, so that a given deposited film mainly composed of silicon is formed on the support 2112. After a film with a given thickness has been formed, the supply of RF power is stopped, and the flow-out valves are closed to stop gases from flowing into the reactor. The formation of a deposited film is thus completed.

The same operation is repeated plural times, whereby a light-receiving layer with the desired multi-layer structure can be formed.

When the corresponding layers are formed, the flow-out valves other than those for necessary gases are all closed. Also, in order to prevent the corresponding gases from remaining in the reactor 2111 and in the pipe extending from the flow-out valves 2251 to 2256 to the reactor 2111, the flow-out valves 2251 to 2256 are closed, the auxiliary valve 2260 is opened and then the main valve 2118 is full-opened so that the inside of the system is once evacuated to a high vacuum; this may be optionally operated.

In order to achieve uniform film formation, it is effective to rotate the support 2112 at a given speed by means of a driving mechanism (not shown) while the films are formed.

The gas species and valve operations described above are changed according to the conditions under which each layer is formed.

A process for producing electrophotographic light-receiving members by high-frequency plasma-assisted CVD making use of frequencies of VHF bands (hereinafter simply "VHF-PCVD") will be described below.

Figure 3:
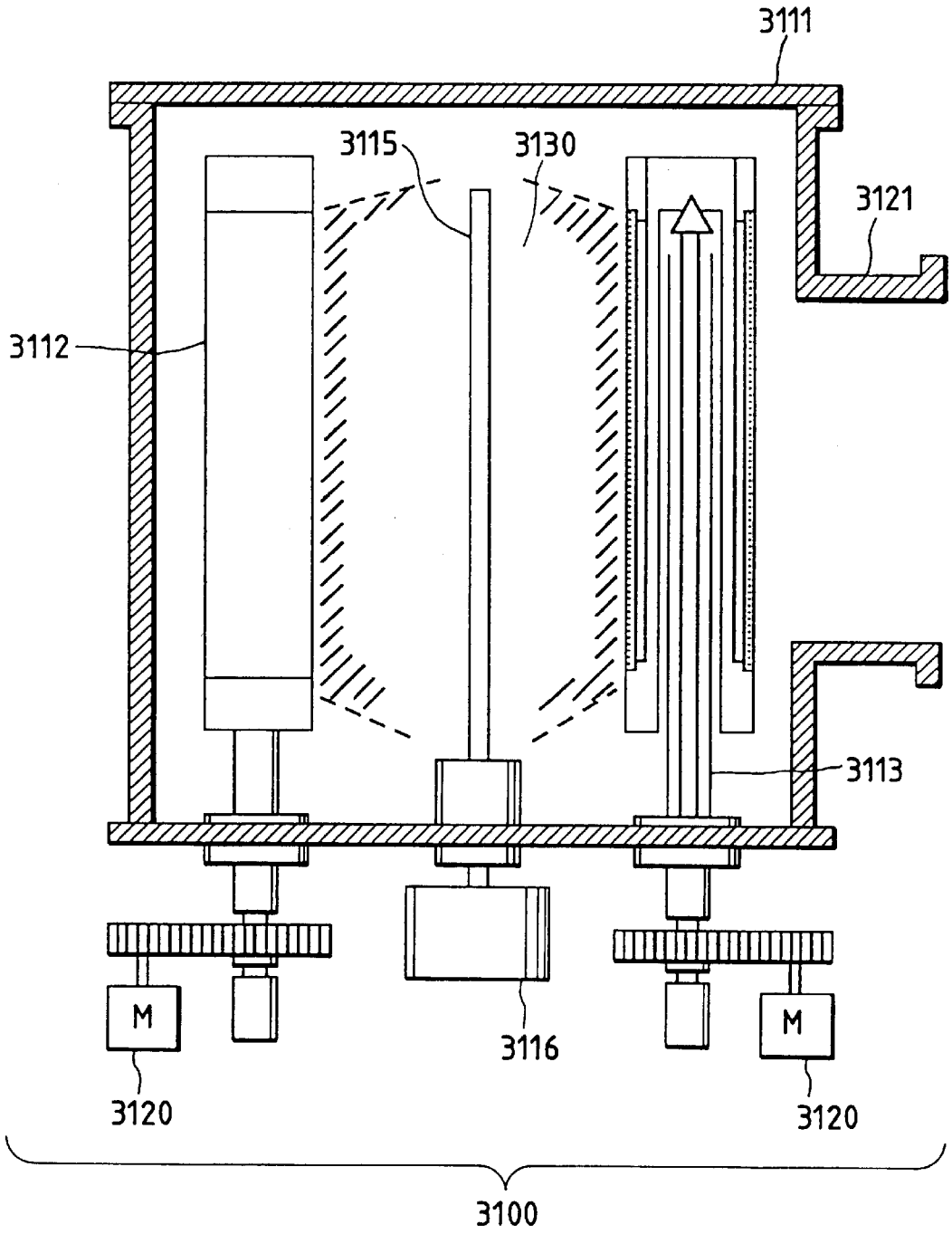
FIG. 3 is a diagrammatic view of an example of an apparatus used to form the light-receiving layer of the electrophotographic light-receiving member of the present invention, which is an apparatus for producing electrophotographic light-receiving members by a glow discharge process using VHF band high frequency.

The deposition system 2100 according to the RF-PCVD in the production apparatus shown in FIG. 2 may be replaced with the deposition system 3100 as shown in FIG. 3, to connect it to the material gas feed system 2220. Thus, an apparatus for producing electrophotographic light-receiving members by VHF-PCVD can be set up.

This apparatus is mainly constituted of a reactor 3111, a material gas feed system 2220 and an exhaust system (not shown) for evacuating the inside of the reactor. In the reactor 3111, cylindrical supports 3112, support heaters 3113, a material gas feed pipe (not shown) and an electrode 3115 are provided. A high-frequency matching box 3115 is also connected to the electrode. The inside of the reactor 3111 communicates with an exhaust pipe 3121 to be connected to an exhaust system (not shown).

The material gas feed system 2220 is constituted of gas cylinders 2221 to 2226 for material gases such as $SiH_4$, $GeH_4$, $H_2$, $CH_4$, $B_2H_6$ and $PH_3$, valves 2231 to 2236, 2241 to 2246 and 2251 to 2256, and mass flow controllers 2211 to 2216. The gas cylinders for the respective material gases are connected to the gas feed pipe (not shown) in the reactor 3111 through the valve 2260. Space 3130 surrounded by the cylindrical supports 3112 forms a discharge space.

Using this apparatus operated by VHF-PCVD, deposited films can be formed in the following way.

First, cylindrical supports 3112 are set in the reactor 3111. The supports 3112 are each rotated by means of a driving mechanism 3120. The inside of the reactor 3111 is evacuated through an exhaust tube 3121 by means of an exhaust device as exemplified by a diffusion pump, to control the pressure inside the reactor 3111 to be not higher than, e.g., $1\times10^{-7}$ Torr. Subsequently, the temperature of each cylindrical support 3112 is controlled at a given temperature of, e.g., from 200° C. to 350° C. by means of the heater 3113 for heating the support.

Before material gases for forming deposited films are flowed into the reactor 3111, gas cylinder valves 2231 to 2236 and the leak valve (not shown) of the reactor are checked to make sure that they are closed, and also flow-in valves 2241 to 2246, flow-out valves 2251 to 2256 and the auxiliary valve 2260 are checked to make sure that they are opened. Then, the main valve (not shown) is opened to evacuate the insides of the reactor 3111 and the gas pipe 2116.

Next, at the time the vacuum gauge (not shown) has been read to indicate a pressure of about $5\times10^{-6}$ Torr, the auxiliary valve 2260 and the flow-out valves 2251 to 2256 are closed.

Thereafter, gas cylinder valves 2231 to 2236 are opened so that gases are respectively introduced from gas cylinders 2221 to 2226, and each gas is controlled to have a pressure of 2 kg/cm$^2$ by operating pressure controllers 2261 to 2266. Next, the flow-in valves 2241 to 2246 are slowly opened so that gases are respectively introduced into mass flow controllers 2211 to 2216.

After the film formation is thus ready to start, the respective layers are formed according to the following procedure.

At the time each support 3112 has had a given temperature, some necessary flow-out valves 2251 to 2256 and the auxiliary valve 2260 are slowly opened so that given gases are fed to the discharge space 3130 in the reactor 3111 from the gas cylinders 2221 to 2226 through a gas feed pipe (not shown). Next, the mass flow controllers 2211 to 2216 are operated so that each material gas is adjusted to flow at a given rate. In that course, the opening of the main valve (not shown) is so adjusted that the pressure inside the reactor 3111 comes to be a given pressure of not higher than 1 Torr, while watching the vacuum gauge (not shown).

At the time the inner pressure has become stable, a VHF power source (not shown) with a frequency of, e.g., 500 MHz is set at the desired electric power, and a VHF power is supplied to the discharge space 3130 through a matching box 3116 to cause glow discharge to take place. Thus, in the discharge space 3130 surrounded by the supports 3112, the material gases fed into it are excited by discharge energy to undergo dissociation, so that a given deposited film is formed on each conductive support 3112. At this time, the support is rotated at the desired rotational speed by means of a support rotating motor 3120 so that the layer can be uniformly formed.

After a film with a given thickness has been formed on each support, the supply of VHF power is stopped, and the flow-out valves are closed to stop gases from flowing into the reactor. The formation of deposited films is thus completed.

The same operation is repeated plural times, whereby light-receiving layers with the desired multi-layer structure can be formed.

When the corresponding layers are formed, the flow-out valves other than those for necessary gases are all closed. Also, in order to prevent the corresponding gases from remaining in the reactor 3111 and in the pipe extending from the flow-out valves 2251 to 2256 to the reactor 3111, the flow-out valves 2251 to 2256 are closed, the auxiliary valve 2260 is opened and then the main valve (not shown) is full-opened so that the inside of the system is once evacuated to a high vacuum; this may be optionally operated.

The gas species and valve operations described above are changed according to the conditions under which each layer is formed.

In either RF-PCVD or VHF-PCVD, the support temperature at the time of the formation of deposited films may, in particular, preferably be set at 200° C. to 350° C., more preferably 230° C. to 330° C., and still more preferably 250° C. to 310° C.

In the case when the Eu and DOS are changed in the layer thickness direction in forming the photoconductive layer, for example, the operation to continuously change the ratio of $SiH_4$ flow rate to discharge power and the operation to continuously change the support temperature may be added to the operations described above.

The support may be heated by any means so long as it is a heating element of a vacuum type, including, e.g., electrical resistance heaters such as a sheathed-heater winding heater, a plate heater and a ceramic heater, heat radiation lamp heating elements such as a halogen lamp and an infrared lamp, and heating elements comprising a heat exchange means employing a liquid, gas or the like as a hot medium. As surface materials of the heating means, metals such as stainless steel, nickel, aluminum and copper, ceramics, heat-resistant polymer resins or the like may be used.

As another method that may be used, a container exclusively used for heating may be provided in addition to the reactor and the support having been heated therein may be transported into the reactor in vacuum.

The pressure in the discharge space especially in the VHF-PCVD may preferably be set at 1 mTorr to 500 mTorr, more preferably 3 mTorr to 300 mTorr, and still more preferably 5 mTorr to 100 mTorr.

In the VHF-PCVD, the electrode 3115 provided in the discharge space may have any size and shape so long as it may cause no disorder of discharge. In view of practical use, it may preferably have the cylindrical shape with a diameter of 1 mm to 10 cm. Here, the length of the electrode may also be arbitrarily set so long as it is long enough for the electric field to be uniformly applied to the support.

The electrode may be made of any material so long as its surface has a conductivity. For example, metals such as stainless steel, Al, Cr, Mo, Au, In, Nb, Te, V, Ti, Pt, Pb and Fe, alloys of any of these, or glass or ceramic whose surface has been conductive treated with any of these.

EXAMPLES

Examples of the present invention will be described below with reference to FIGS. 2 and 3.

Example 1

Using the apparatus shown in FIG. 2, for producing electrophotographic light-receiving members by RF-PCVD, a light-receiving layer comprised of a charge injection blocking layer, a photoconductive layer and a surface layer was formed on a mirror-finished cylindrical aluminum support of 108 mm diameter under conditions, e.g., as shown in Table 1, to produce a light-receiving member. Various light-receiving members were also produced in the same manner but changing the mixing ratio of $SiH_4$ to $H_2$ and discharge power for the photoconductive layer.

The light-receiving members thus produced were each set in an electrophotographic apparatus (a copying machine NP6150, manufactured by Canon Inc., modified for testing), and images were reproduced to evaluate the dependence of charge performance on temperature (temperature-dependent properties), the exposure memory and the smeared images. To evaluate the temperature-dependent properties, the temperature of the light-receiving member was changed to range from room temperature to about 45° C., at which the charge performance was measured, and changes in charge performance per 1° C. of this temperature change were measured. A change of 2 V/degree or below was judged to be acceptable. To evaluate the exposure memory and the smeared images, images reproduced were visually judged according to four ranks of 1: very good, 2: good, 3: no problem in practical use, and 4: a little problematic in practical use in some instances. As the result, the ranks 1 and 2 were judged to be acceptable.

Meanwhile, on glass substrates (7059; available from Corning Glass Works) and silicon (Si) wafers which were provided on a cylindrical sample holder, a-Si films of about 1 $\mu$m in thickness were deposited under the same conditions as in forming the photoconductive layer. On the deposited films formed on the glass substrates, Al comb electrodes were formed by vapor deposition, and the characteristic energy at the exponential tail (Eu) and the density of states of localization (DOS) were measured by CPM. In respect of the deposited films on the silicon wafers, the hydrogen content was measured by FTIR (Fourier transformation infrared absorption spectroscopy).

As the result, the photoconductive layer formed under the conditions as shown in Table 1 had a hydrogen content of 27 atom %, an Eu of 57 meV and a DOS of $3.2\times10^{15}$ $cm^{-3}$.

In the case when the ratio of discharge power with respect to the flow rate of $SiH_4$ (RF power) was fixed and the mixing ratio of $H_2$ to $SiH_4$ ($H_2/SiH_4$) was increased, the both Eu and DOS tended to almost monotonously decrease until the mixing ratio was increased up to about 10. In particular, the DOS remarkably tended to decrease. Then, in the case when their mixing ratio was increased more than that, the Eu and DOS decreased at a slow rate. On the other hand, in the case when the mixing ratio of $H_2$ to $SiH_4$ was fixed and the ratio of discharge power with respect to the flow rate of $SiH_4$ (power) was increased, the both Eu and DOS tended to increase. In particular, the Eu remarkably tended to increase.

Figure 4:
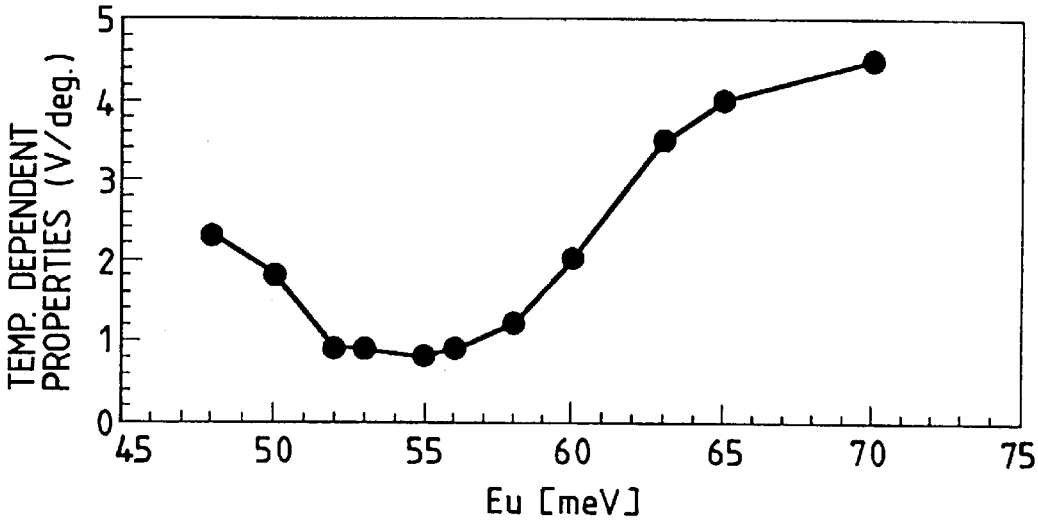
FIGS. 4, 10, 16, 24 and 28 each show the relationship between characteristic energy at Urbach tail (Eu) and temperature dependent properties of photoconductive layers in various electrophotographic light-receiving members.
Figure 5:
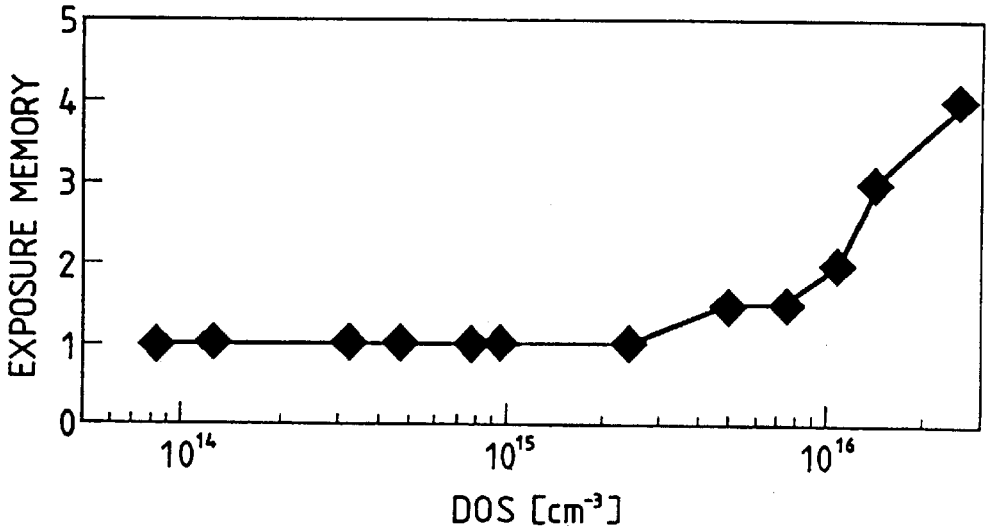
FIG. 5 shows the relationship between density of states of localization (DOS) and exposure memory of photoconductive layers in various electrophotographic light-receiving members.
Figure 6:
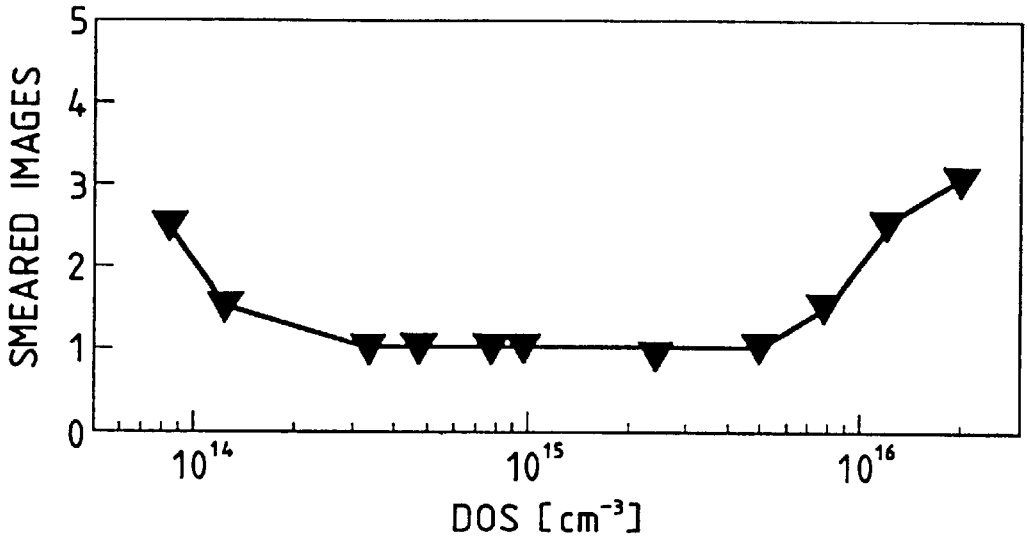
FIG. 6 shows the relationship between density of states of localization (DOS) and smeared images of photoconductive layers in various electrophotographic light-receiving members.

The relationship between the Eu and the temperature-dependent properties is shown in FIG. 4, and the relationship between the DOS and the exposure memory and smeared images are shown in FIGS. 5 and 6, respectively. In all samples, the hydrogen content was in the range of from 10 to 30 atom %. As is clear from FIGS. 4, 5 and 6, it was found necessary to control the Eu to be not less than 50 meV to not more than 60 meV, and the DOS not less than $1\times10^{14}$ $cm^{-3}$ to less than $1\times10^{16}$ $cm^{-3}$, in order to obtain good electrophotographic performances.

The light-receiving members produced were each set in the above electrophotographic apparatus, and images were reproduced through a process comprised of charging, exposure, development, transfer and cleaning. As a result, it was possible to obtain very good images.

Example 2

In the present Example, an intermediate layer (an upper blocking layer) made to have a smaller carbon atom content than the surface layer and incorporated with the atoms capable of controlling conductivity type was provided between the photoconductive layer and the surface layer. Conditions under which an electrophotographic light-receiving member was produced here were as shown in Table 2.

Except for the foregoing, Example 1 was repeated.

In the present Example, the results obtained on the Eu and DOS of the photoconductive layer formed under the conditions shown in Table 2 were 55 meV and $2\times10^{15}$ $cm^{-3}$, respectively. The electrophotographic light-receiving members similarly produced were also negatively charged to make the same evaluation as in Example 1. As a result, good electrophotographic performances like those in Example 1 were obtained.

That is, also in the case when the intermediate layer (an upper blocking layer) was provided, it was found necessary to control the Eu to be not less than 50 meV to not more than 60 meV, and the DOS not less than $1\times10^{14}$ $cm^{-3}$ to less than $1\times10^{16}$ $cm^{-3}$, in order to obtain good electrophotographic performances.

In the same manner as in Example 1, the light-receiving members produced were each set in the electrophotographic apparatus NP6150, manufactured by Canon Inc., modified for testing, and images were reproduced through a process comprised of charging, exposure, development, transfer and cleaning. As a result, it was possible to obtain very good images.

Example 3

In the present Example, a surface layer containing silicon atoms and carbon atoms in the state they were distributed non-uniformly in the layer thickness direction was provided in place of the surface layer in Example 1. Conditions under which an electrophotographic light-receiving member was produced here were as shown in Table 3.

Except for the foregoing, Example 1 was repeated.

In the present Example, the results obtained on the Eu and DOS of the photoconductive layer formed under the conditions shown in Table 3 were 50 meV and $8\times10^{14}$ $cm^{-3}$, respectively. The electrophotographic light-receiving members similarly produced were also evaluated in the same manner as in Example 1. As a result, good electrophotographic performances like those in Example 1 were obtained.

That is, also in the case when the surface layer containing silicon atoms and carbon atoms in the state they were distributed non-uniformly in the layer thickness direction was provided, it was found necessary to control the Eu to be not less than 50 meV to not more than 60 meV, and the DOS not less than $1\times10^{14}$ $cm^{-3}$ to less than $1\times10^{16}$ $cm^{-3}$, in order to obtain good electrophotographic performances.

In the same manner as in Example 1, the light-receiving members produced were each set in the electrophotographic apparatus NP6150, manufactured by Canon Inc., modified for testing, and images were reproduced through a process comprised of charging, exposure, development, transfer and cleaning. As a result, it was possible to obtain very good images.

Example 4

In the present Example, as a light absorbing layer for preventing occurrence of interference fringes due to light reflected from the support, an infrared (IR) absorbing layer formed of amorphous silicon germanium was provided between the support and the charge injection blocking layer. Conditions under which an electrophotographic light-receiving member was produced here were as shown in Table 4.

Except for the foregoing, Example 1 was repeated.

In the present Example, the results obtained on the Eu and DOS of the photoconductive layer formed under the conditions shown in Table 4 were 60 meV and $5\times10^{15}$ $cm^{-3}$, respectively. The electrophotographic light-receiving members similarly produced were also evaluated in the same manner as in Example 1. As a result, good electrophotographic performances like those in Example 1 were obtained.

That is, also in the case when the IR absorbing layer was provided, it was found necessary to control the Eu to be not less than 50 meV to not more than 60 mev, and the DOS not less than $1\times10^{14}$ $cm^{-3}$ to less than $1\times10^{16}$ $cm^{-3}$, in order to obtain good electrophotographic performances.

In the same manner as in Example 1, the light-receiving members produced were each set in the electrophotographic apparatus NP6150, manufactured by Canon Inc., modified for testing, and images were reproduced through a process comprised of charging, exposure, development, transfer and cleaning. As a result, it was possible to obtain very good images.

Example 5

In the present Example, the apparatus shown in FIG. 3, for producing electrophotographic light-receiving members by VHF-PCVD in place of the RF-PCVD in Example 1 was used. A light-receiving layer comprised of a charge injection blocking layer, a photoconductive layer and a surface layer was formed on a mirror-finished cylindrical aluminum support of 108 mm diameter as in Example 1 under conditions as shown in Table 5, to produce a light-receiving member. Various light-receiving members were also produced in the same manner but changing the mixing ratio of $SiH_4$ to $H_2$, discharge power, support temperature and internal pressure for the photoconductive layer.

Except for the foregoing, Example 1 was repeated.

The light-receiving members thus produced were each set in an electrophotographic apparatus (a copying machine NP6150, manufactured by Canon Inc., modified for testing), and images were reproduced to evaluate the dependence of charge performance on temperature (temperature-dependent properties) and the exposure memory (blank memory and ghost). The temperature-dependent properties and the exposure memory were evaluated in the same manner as in Example 1. Uneven density (coarseness) of halftone images was also evaluated according to the four ranks like the exposure memory. As result, the ranks 1 and 2 were judged to be acceptable.

Meanwhile, on glass substrates (7059; available from Corning Glass Works) and silicon (Si) wafers which were provided on a cylindrical sample holder, a-Si films of about 1 $\mu$m in layer thickness were deposited under the same conditions as in forming the photoconductive layer. On the deposited films formed on the glass substrates, Al comb electrodes were formed by vapor deposition, and the characteristic energy at the exponential tail (Eu) and the density of states of localization (DOS) were measured by CPM. In respect of the deposited films on the silicon wafers, the hydrogen content and the absorption peak intensity ratio of Si—$H_2$ bonds to Si—H bonds were measured by FTIR.

As a result, in the photoconductive layer formed under the conditions as shown in Table 5, the hydrogen content was 25 atom %, the Si—$H_2$/Si—H was 0.35, and the Eu and DOS were 59 meV and $4.3\times10^{15}$ $cm^{-3}$, respectively.

In the case when the ratio of discharge power with respect to $SiH_4$ (RF power) was fixed and the mixing ratio of $SiH_4$ to $H_2$ ($H_2/SiH_4$) was increased, like Example 1 the both Eu and DOS tended to almost monotonously decrease until the mixing ratio was increased up to about 10. In particular, the DOS remarkably tended to decrease. Then, in the case when their mixing ratio was increased more than that, the Eu and DOS decreased at a slow rate. On the other hand, in the case when the mixing ratio of $SiH_4$ to $H_2$ was fixed and the ratio of discharge power with respect to $SiH_4$ (power) was increased, the both Eu and DOS tended to increase. In particular, the Eu remarkably tended to increase. Also, in the case when the support temperature was raised, the Eu and DOS tended to drop, though slowly, and the Si—$H_2$/Si—H tended to decrease.

Here, the relationship between the Eu and the temperature-dependent properties and the relationship between the DOS and the exposure memory and smeared images were similar to those in Example 1, and it was found necessary to control the Eu to be not less than 50 meV to not more than 60 meV, and the DOS not less than $1\times10^{14}$ $cm^{-3}$ to less than $1\times10^{16}$ $cm^{-3}$, in order to obtain good electrophotographic performances.

Figure 7:
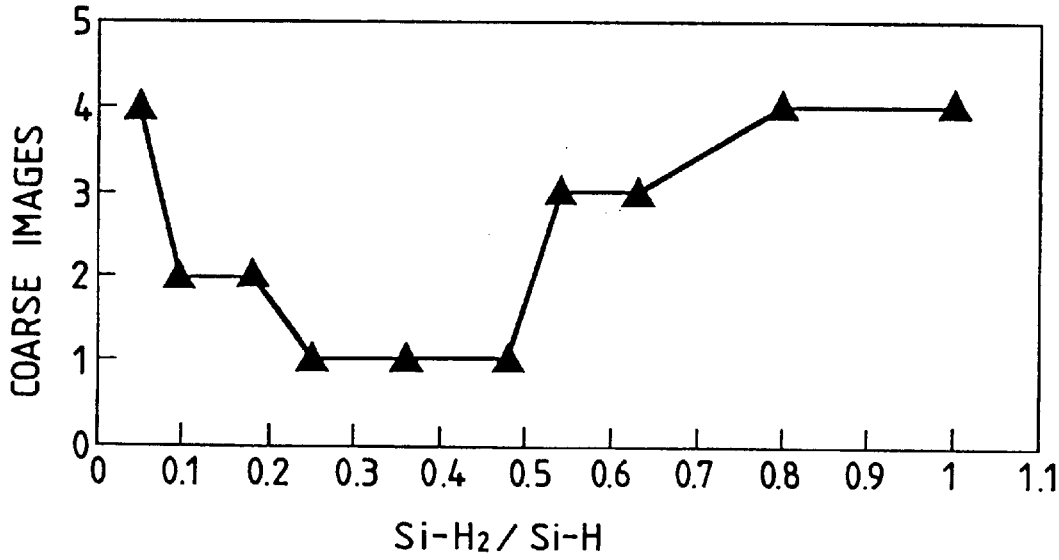
FIG. 7 shows the relationship between the absorption peak intensity ratio of Si—$H_2$ bonds to Si—H bonds and halftone uneven density (coarse images) of photoconductive layers in various electrophotographic light-receiving members.

From the relationship between Si—$H_2$/Si—H and sensitivity as shown in FIG. 7, it was also found preferable to control the Si—$H_2$/Si—H to be not less than 0.1 to not more than 0.5.

In the same manner as in Example 1, the light-receiving members produced were each set in the electrophotographic apparatus NP6150, manufactured by Canon Inc., modified for testing, and images were reproduced through a process comprised of charging, exposure, development, transfer and cleaning. As a result, it was possible to obtain very good images.

Example 6

In the present Example, as surface layer constituent atoms, nitrogen atoms were incorporated in the surface layer in place of carbon atoms. Conditions under which an electrophotographic light-receiving member was produced here were as shown in Table 6.

Except the foregoing, Example 5 was repeated.

In the present Example, the Eu, DOS and Si—$H_2$/Si—H of the photoconductive layer formed under the conditions shown in Table 6 were 53 meV, $5\times10^{14}$ $cm^{-3}$ and 0.29, respectively. The electrophotographic light-receiving members similarly produced were also evaluated in the same manner as in Example 1. As a result, good electrophotographic performances like those in Example 1 were obtained.

That is, also in the case when nitrogen atoms were incorporated in the surface layer in place of carbon atoms, it was found preferable to control the Eu to be not less than 50 meV to not more than 60 meV, and the DOS not less than $1\times10^{14}$ $cm^{-3}$ to less than $1\times10^{16}$ $cm^{-3}$, and also to control the Si—$H_2$/Si—H to be not less than 0.1 to not more than 0.5, in order to obtain good electrophotographic performances.

In the same manner as in Example 1, the light-receiving members produced were each set in the electrophotographic apparatus NP6150, manufactured by Canon Inc., modified for testing, and images were reproduced through a process comprised of charging, exposure, development, transfer and cleaning. As a result, it was possible to obtain very good images.

Example 7

In the present Example, the charge injection blocking layer was omitted and the photoconductive layer was constituted of a first layer region containing carbon atoms in the state they were distributed non-uniformly in the layer thickness direction and a second layer region containing substantially no carbon atoms. Conditions under which an electrophotographic light-receiving member was produced here were as shown in Table 7.

Except for the foregoing, Example 5 was repeated.

In the present Example, the Eu, DOS and Si—$H_2$/Si—H of the photoconductive layer formed under the conditions shown in Table 7 were 56 meV, $1.3\times10^{15}$ $cm^{-3}$ and 0.38, respectively. The electrophotographic light-receiving members similarly produced were also evaluated in the same manner as in Example 1. As a result, good electrophotographic performances like those in Example 1 were obtained.

That is, also in the case when the charge injection blocking layer was omitted and the photoconductive layer was constituted of a first layer region containing carbon atoms in the state they were distributed non-uniformly in the layer thickness direction and a second layer region containing substantially no carbon atoms, it was found preferable to control the Eu to be not less than 50 meV to not more than 60 meV, and the DOS not less than $1\times10^{14}$ $cm^{-3}$ to less than $1\times10^{16}$ $cm^{-3}$, and also to control the Si—$H_2$/Si—H to be not less than 0.1 to not more than 0.5, in order to obtain good electrophotographic performances.

In the same manner as in Example 1, the light-receiving members produced were each set in the electrophotographic apparatus NP6150, manufactured by Canon Inc., modified for testing, and images were reproduced through a process comprised of charging, exposure, development, transfer and cleaning. As a result, it was possible to obtain very good images.

Example 8

In the present Example, an intermediate layer (a lower surface layer) made to have a smaller carbon atom content than the surface layer was provided between the photoconductive layer and the surface layer and at the same time the photoconductive layer was functionally separated into two layers comprised of a charge generation layer and a charge transport layer. Conditions under which an electrophotographic light-receiving member was produced here were as shown in Table 8.

Except for the foregoing, Example 5 was repeated.

In the present Example, the Eu, DOS and Si—$H_2$/Si—H of the photoconductive layer formed under the conditions shown in Table 8 were 59 meV, $3\times10^{15}$ $cm^{-3}$ and 0.45, respectively. The electrophotographic light-receiving members similarly produced were also evaluated in the same manner as in Example 1. As a result, good electrophotographic performances like those in Example 1 were obtained.

That is, also in the case when an intermediate layer (a lower surface layer) made to have a smaller carbon atom content than the surface layer was provided between the photoconductive layer and the surface layer and at the same time the photoconductive layer was functionally separated into two layers comprised of a charge generation layer and a charge transport layer, it was found preferable to control the Eu to be not less than 50 meV to not more than 60 meV, and the DOS not less than $1\times10^{14}$ $cm^{-3}$ to less than $1\times10^{16}$ $cm^{-3}$, and also to control the Si—$H_2$/Si—H to be not less than 0.1 to not more than 0.5, in order to obtain good electrophotographic performances.

In the same manner as in Example 1, the light-receiving members produced were each set in the electrophotographic apparatus NP6150, manufactured by Canon Inc., modified for testing, and images were reproduced through a process comprised of charging, exposure, development, transfer and cleaning. As a result, it was possible to obtain very good images.

Example 9

Using the apparatus shown in FIG. 2, for producing electrophotographic light-receiving members by RF-PCVD, a light-receiving layer comprised of a charge injection blocking layer, a photoconductive layer and a surface layer was formed on a mirror-finished cylindrical aluminum support of 108 mm diameter under conditions as shown in Table 9, to produce a light-receiving member. In that course, the conditions for forming the photoconductive layer were continuously changed in the layer thickness direction as shown in Table 10. The discharge power in the conditions for forming the photoconductive layer was also continuously changed in the layer thickness direction at powers 3 to 8 times the flow rate of $SiH_4$. Thus, several kinds of light-receiving members were produced. Here, the Eu and DOS of the photoconductive layer were measured at three points in the film forming conditions, i.e., at the support side, the middle portion and the surface side, to take sample values, which were simply averaged to obtain averages in film.

The light-receiving members thus produced were each set in an electrophotographic apparatus (a copying machine NP6150, manufactured by Canon Inc., modified for testing), and images were reproduced to evaluate the dependence of charge performance on temperature (temperature-dependent properties), the exposure memory (blank memory and ghost) and the sensitivity. To evaluate the temperature-dependent properties, the temperature of the light-receiving member was changed to range from room temperature to about 45° C., at which the charge performance was measured, and changes in charge performance per 1° C. of this temperature change were measured. A change of 2 V/degree or below was judged to be acceptable. To evaluate the exposure memory, images reproduced were visually judged, and the sensitivity was evaluated on the basis of a conventional level judged as rank 3 (practical), which were both judged according to five ranks of 1: very good, 2: good, 3: practical, 4: no problem in practical use, and 5: a little problematic in practical use. When it was difficult to make a clear distinction between the ranks, e.g., between ranks 1 and 2, it was noted as 1.5.

Meanwhile, on glass substrates (7059; available from Corning Glass Works) and silicon (Si) wafers which were provided on a cylindrical sample holder, several kinds of a-Si films were deposited under the same conditions as in forming the photoconductive layer. On the deposited films formed on the glass substrates, Al comb electrodes were formed by vacuum deposition, and the characteristic energy at the exponential tail (Eu) and the density of states of localization (DOS) were measured by CPM. In respect of the films on the silicon wafers, the hydrogen content was measured by FTIR.

Electrophotographic light-receiving members were produced in the same manner as in Example 9 except that the photoconductive layer was formed under conditions not changed (i.e., under fixed conditions) in the layer thickness direction. The conditions under which such electrophotographic light-receiving members were produced here were as shown in Table 11.

Except for the foregoing, Example 9 was repeated.

Results of evaluation on the light-receiving members produced in Example 9 are shown in FIGS. 8 to 15.

Figure 8:
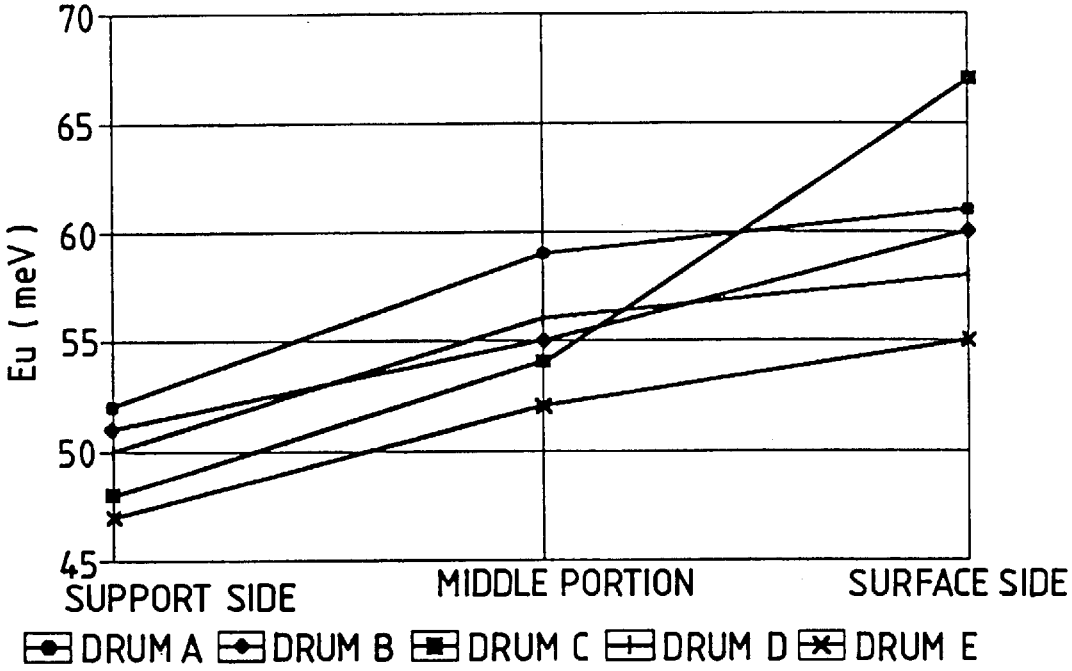
FIGS. 8 and 22 each show the relationship between positions in layer thickness direction and characteristic energy at Urbach tail (Eu) of photoconductive layers in various electrophotographic light-receiving members.
Figure 9:
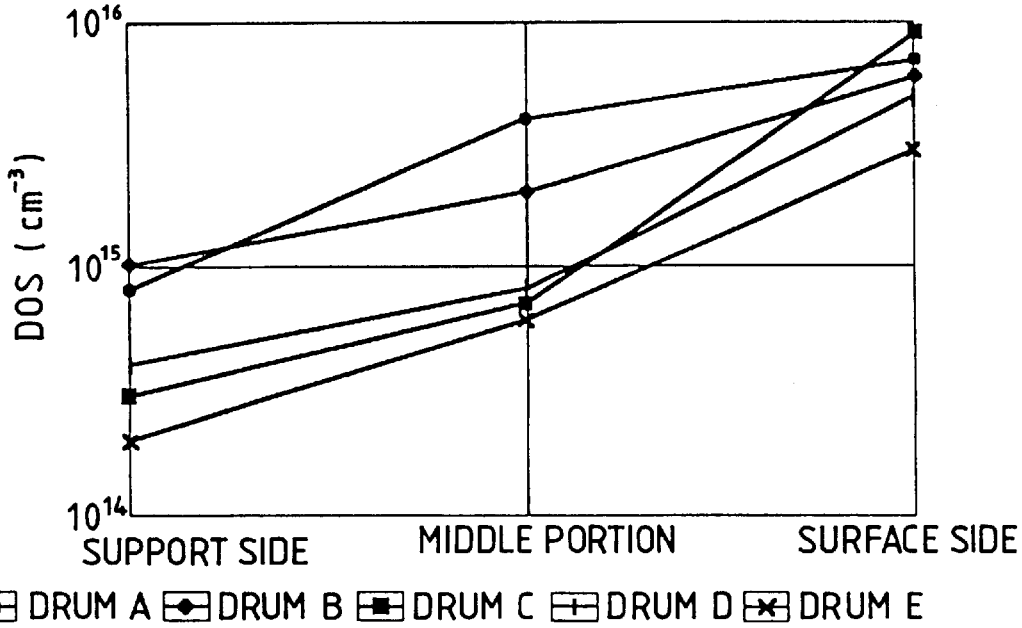
FIGS. 9 and 23 each show the relationship between positions in layer thickness direction and density of states of localization (DOS) of photoconductive layers in various electrophotographic light-receiving members.
Figure 10:
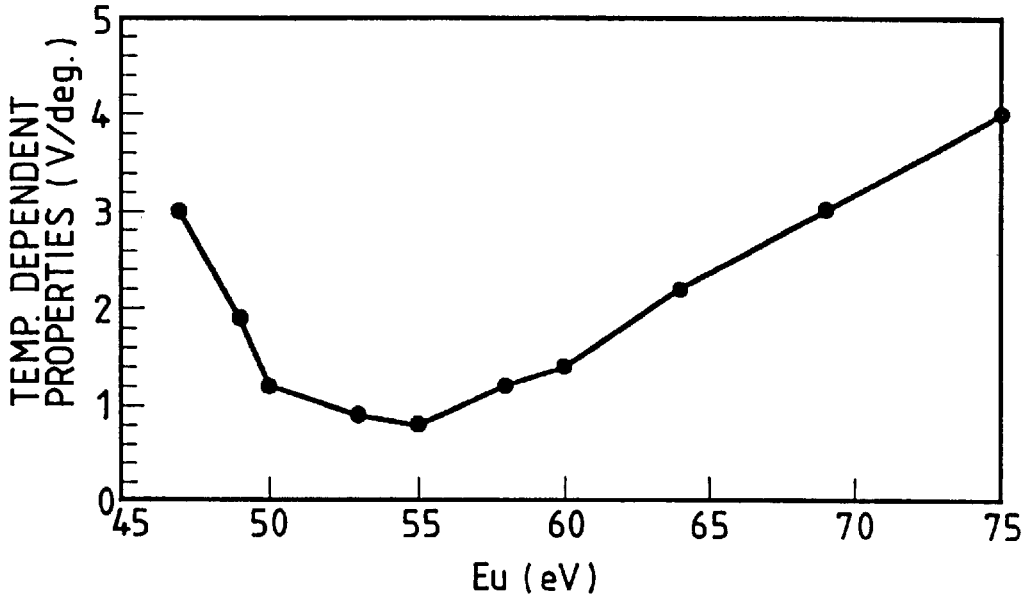
Figure 11:
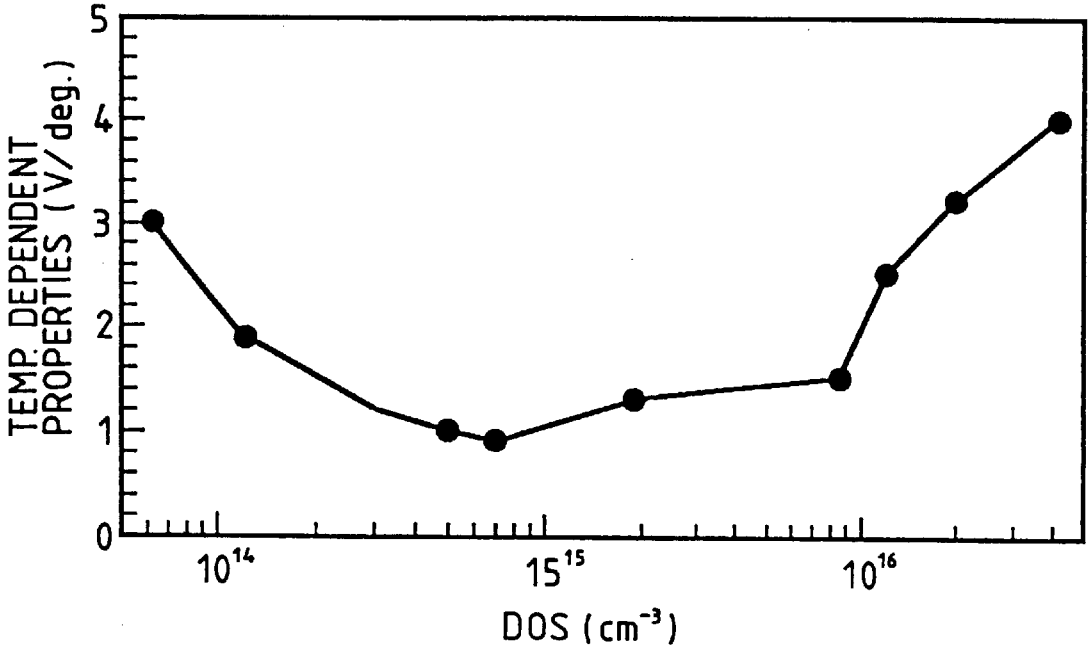
FIGS. 11, 17, 25 and 29 each show the relationship between the density of states of localization (DOS) and temperature-dependent properties of photoconductive layers in various electrophotographic light-receiving members.
Figure 12:
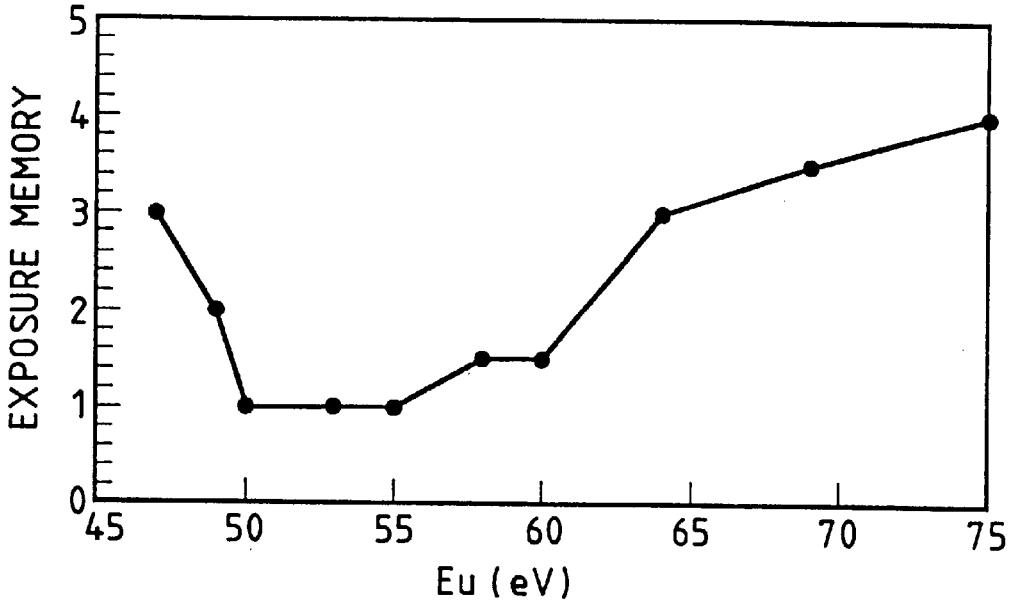
FIGS. 12 and 18 each show the relationship between characteristic energy at Urbach tail (Eu) and exposure memory evaluation ranks of photoconductive layers in various electrophotographic light-receiving members.
Figure 13:
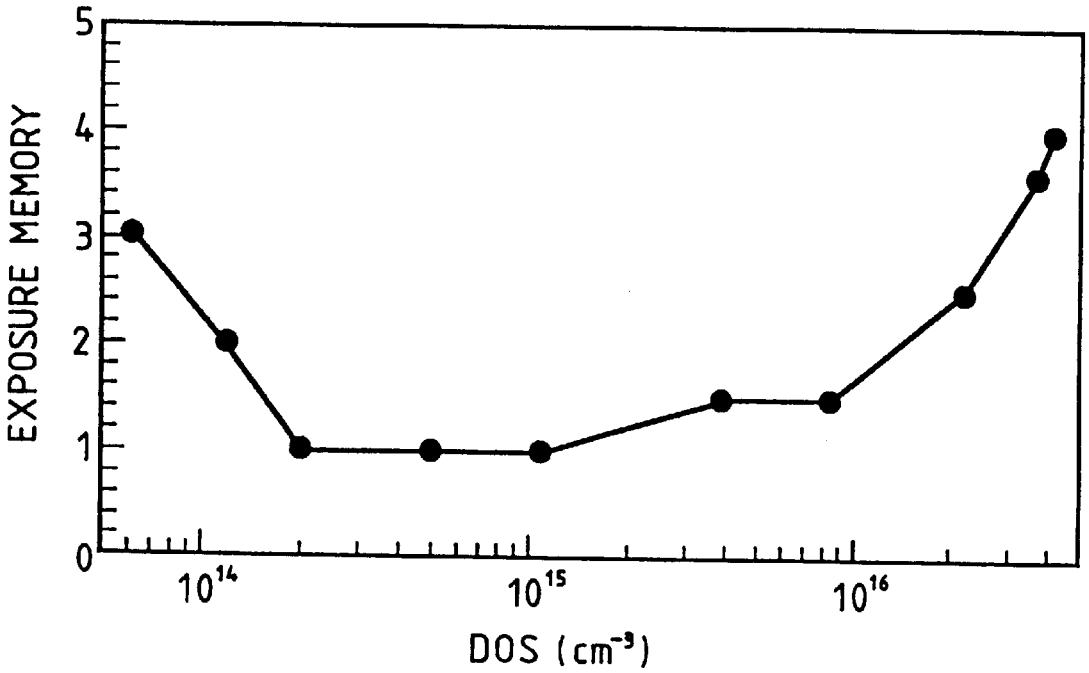
FIGS. 13 and 19 each show the relationship between the density of states of localization (DOS) and exposure memory evaluation ranks of photoconductive layers in various electrophotographic light-receiving members.
Figure 14:
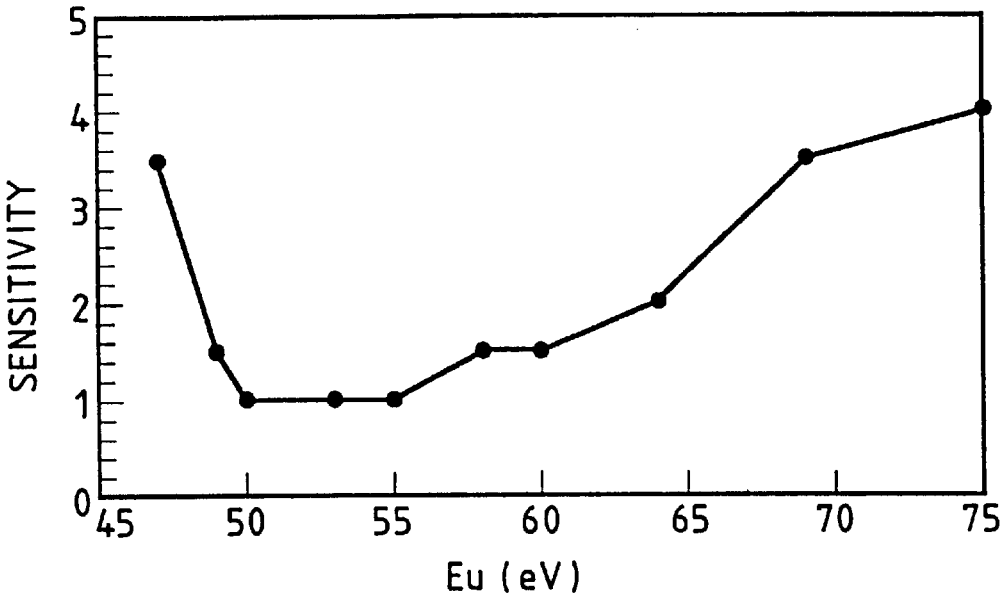
FIGS. 14 and 20 each show the relationship between characteristic energy at Urbach tail (Eu) and sensitivity evaluation ranks of photoconductive layers in various electrophotographic light-receiving members.
Figure 15:
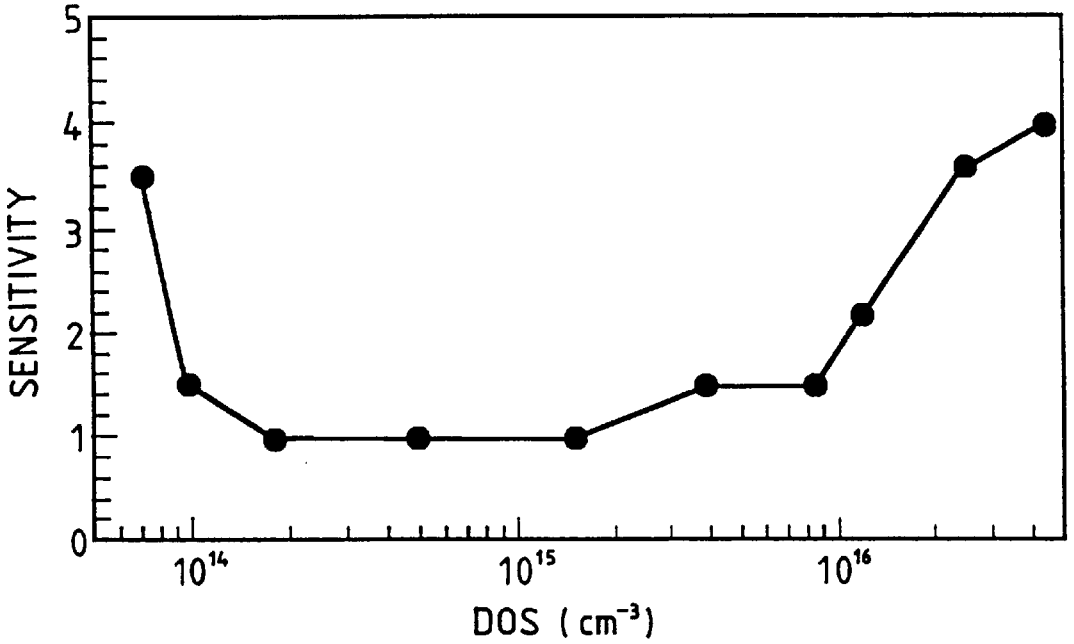
FIGS. 15 and 21 each show the relationship between the density of states of localization (DOS) and sensitivity ranks of photoconductive layers in various electrophotographic light-receiving members.

FIG. 8 shows the distribution of Eu in layer thickness direction in the photoconductive layers. FIG. 9 shows the distribution of DOS in layer thickness direction in the photoconductive layers. FIG. 10 shows the dependence of charge performance on temperature (temperature-dependent properties) in its relationship with average Eu in the photoconductive layers. FIG. 11 shows the dependence of charge performance on temperature (temperature-dependent properties) in its relationship with average DOS in the photoconductive layers. FIG. 12 shows the exposure memory in its relationship with average Eu in the photoconductive layers. FIG. 13 shows the exposure memory in its relationship with average DOS in the photoconductive layers. FIG. 14 shows the sensitivity in its relationship with average Eu in the photoconductive layers. FIG. 15 shows the sensitivity in its relationship with average DOS in the photoconductive layers.

Results of evaluation on the light-receiving members in which the Eu and DOS were not changed in the layer thickness direction are shown in FIGS. 16 to 21. As to the Eu and DOS in the photoconductive layers, values of samples were simply averaged to obtain averages in film.

Figure 16:
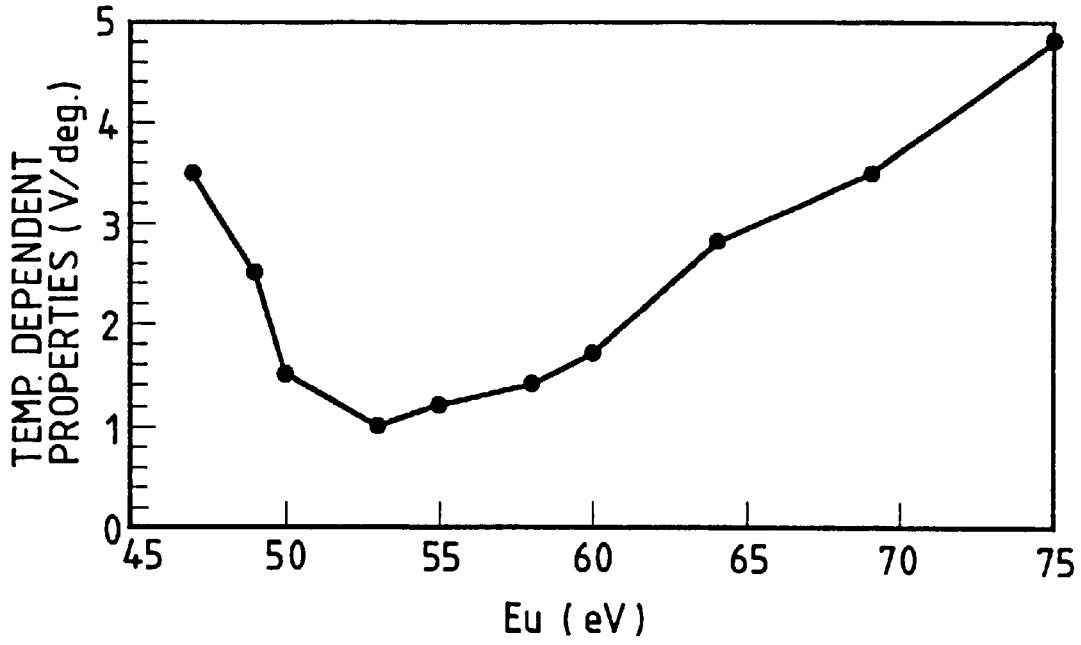
Figure 17:
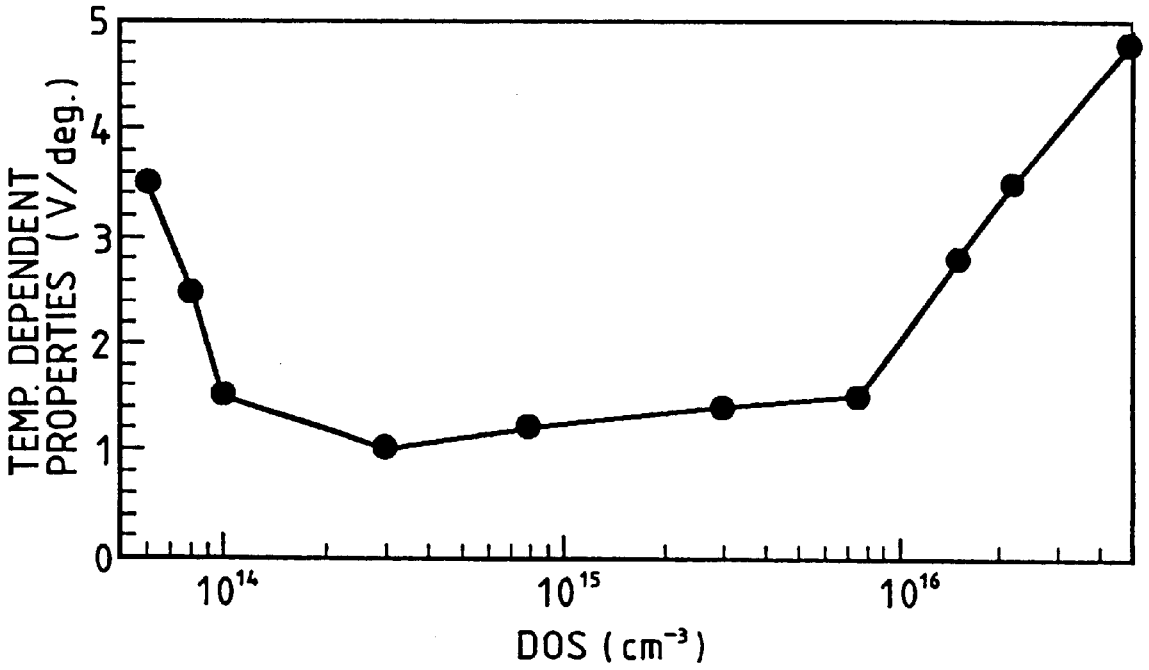
Figure 18:
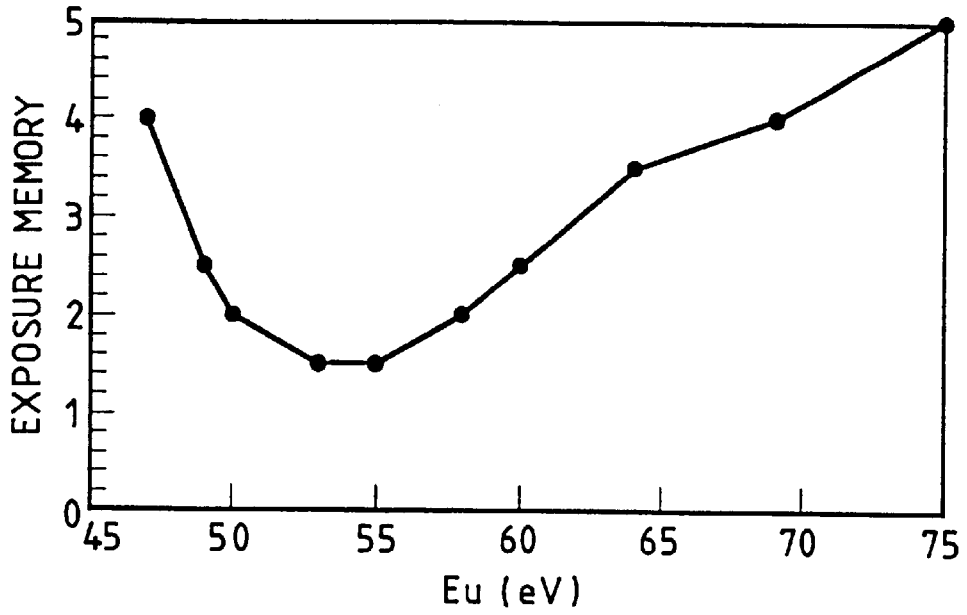
Figure 19:
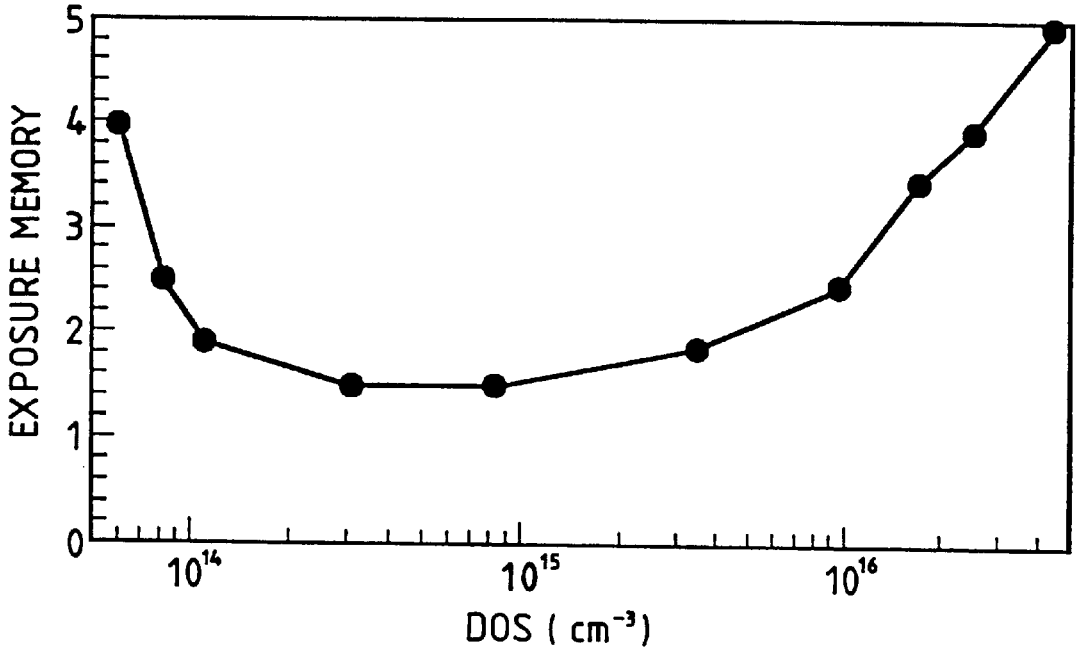
Figure 20:
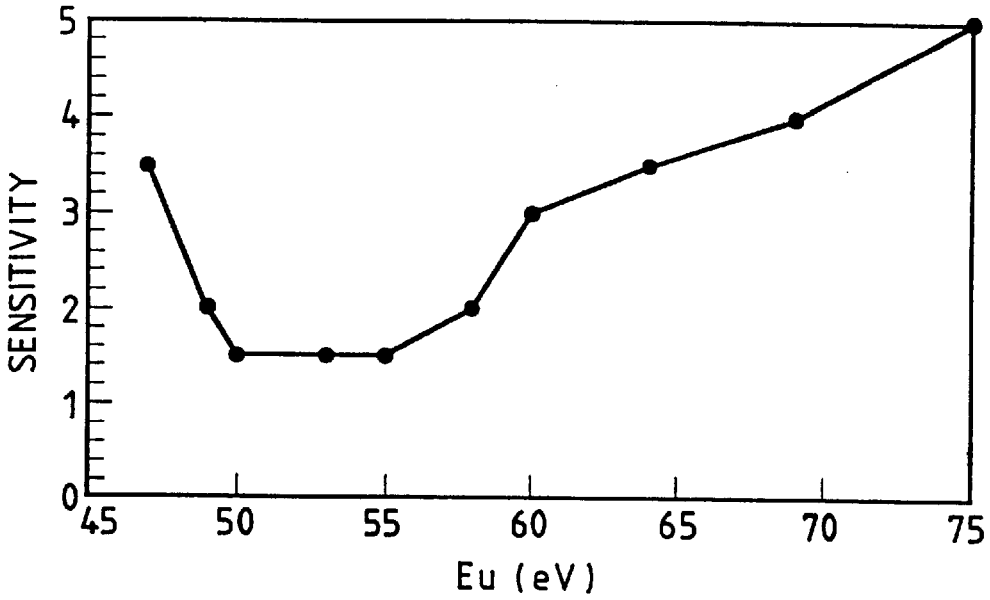
Figure 21:
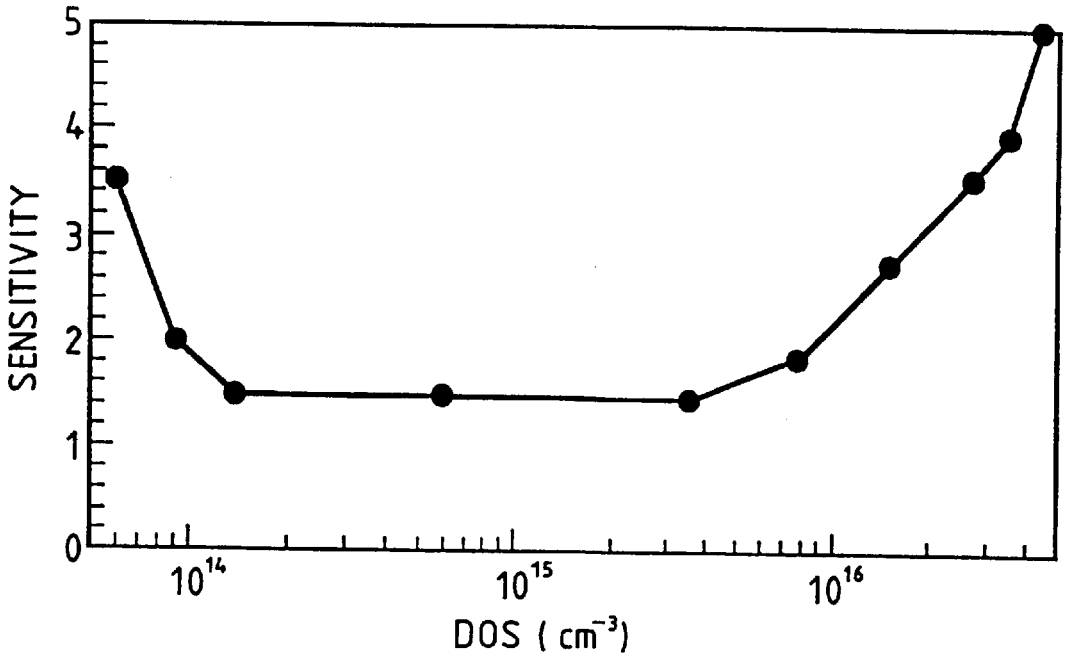

FIG. 16 shows the dependence of charge performance on temperature (temperature-dependent properties) in its relationship with average Eu in the photoconductive layers. FIG. 17 shows the dependence of charge performance on temperature (temperature-dependent properties) in its relationship with average DOS in the photoconductive layers. FIG. 18 shows the exposure memory in its relationship with average Eu in the photoconductive layers. FIG. 19 shows the exposure memory in its relationship with average DOS in the photoconductive layers. FIG. 20 shows the sensitivity in its relationship with average Eu in the photoconductive layers. FIG. 21 shows the sensitivity in its relationship with average DOS in the photoconductive layers.

As is seen from the above results, it was found more preferable to continuously change the Eu and DOS of the photoconductive layer in its thickness direction (FIGS. 8 to 15) so as for the Eu to be not less than 50 meV to not more than 60 meV, and the DOS not less than $1\times10^{14}$ $cm^{-3}$ to less than $1\times10^{16}$ $cm^{-3}$, on the average in film, than to make no such change (FIGS. 16 to 21), in order to obtain better electrophotographic performances. In particular, it was found preferable to do so for the sake of temperature-dependent properties, exposure memory and sensitivity. In all samples, the hydrogen content was between 10 atoms % and 30 atom %.

In the same manner as in Example 1, the light-receiving members produced were each set in the electrophotographic apparatus NP6150, manufactured by Canon Inc., modified for testing, and images were reproduced through a process comprised of charging, exposure, development, transfer and cleaning. As a result, it was possible to obtain very good images.

Example 10

In the present Example, the support temperature and power changed in Example 9 were changed in different ranges. Conditions under which an electrophotographic light-receiving member was produced here were as shown in Table 12.

Except for the foregoing, Example 9 was repeated.

In the present Example, the Eu and DOS of the photoconductive layer formed under the conditions shown in Table 12 were 49 meV and $2.2\times10^{14}$ $cm^{-3}$, respectively, on the support side of the layer (initial); 55 meV and $9.8\times10^{14}$ $cm^{-3}$, respectively, at the middle portion of the layer; 63 meV and $1.3\times10^{16}$ $cm^{-3}$, respectively, on the surface side of the layer; and 56 meV and $4.7\times10^{15}$ $cm^{-3}$, respectively, on the average in film. The electrophotographic light-receiving members similarly produced were also evaluated in the same manner as in Example 9. As a result, good electrophotographic performances like those in Example 9 were obtained.

As is seen from the foregoing, better electrophotographic performances were obtained even if the Eu and DOS were partly outside the above ranges on the surface side, so long as the Eu was controlled to be not less than 50 meV to not more than 60 meV, and the DOS not less than $1\times10^{14}$ $cm^{-3}$ to less than $1\times10^{16}$ $cm^{-3}$, on the average in film.

In the same manner as in Example 1, the light-receiving members produced were each set in the electrophotographic apparatus NP6150, manufactured by Canon Inc., modified for testing, and images were reproduced through a process comprised of charging, exposure, development, transfer and cleaning. As a result, it was possible to obtain very good images.

Example 11

In the present Example, an intermediate layer (a lower surface layer) made to have a smaller carbon atom content than the surface layer was provided between the photoconductive layer and the surface layer. Conditions under which an electrophotographic light-receiving member was produced here were as shown in Table 13.

Except for the foregoing, Example 9 was repeated.

In the present Example, the Eu and DOS of the photoconductive layer formed under the conditions shown in Table 13 were 55 meV and $2.2\times10^{15}$ $cm^{-3}$, respectively, on the average in film. The electrophotographic light-receiving members similarly produced were also evaluated in the same manner as in Example 9. As a result, good electrophotographic performances like those in Example 9 were obtained.

That is, also in the case when the intermediate layer (a lower surface layer) was provided, good electrophotographic performances were found to be obtained so long as the photoconductive layer had the Eu controlled to be not less than 50 meV to not more than 60 meV, and the DOS not less than $1\times10^{14}$ $cm^{-3}$ to less than $1\times10^{16}$ $cm^{-3}$, on the average in film.

In the same manner as in Example 1, the light-receiving members produced were each set in the electrophotographic apparatus NP6150, manufactured by Canon Inc., modified for testing, and images were reproduced through a process comprised of charging, exposure, development, transfer and cleaning. As a result, it was possible to obtain very good images.

Example 12

In the present Example, a surface layer containing silicon atoms and carbon atoms in the state they were distributed non-uniformly in the layer thickness direction was provided in place of the surface layer in Example 9. Conditions under which an electrophotographic light-receiving member was produced here were as shown in Table 14.

Except for the foregoing, Example 9 was repeated.

In the present Example, the Eu and DOS of the photoconductive layer formed under the conditions shown in Table 14 were 52 meV and $5.7\times10^{14}$ $cm^{-3}$, respectively, on the average in film. The electrophotographic light-receiving members similarly produced were also evaluated in the same manner as in Example 9. As a result, good electrophotographic performances like those in Example 9 were obtained.

That is, also in the case when the surface layer containing silicon atoms and carbon atoms in the state they were distributed non-uniformly in the layer thickness direction was provided, good electrophotographic performances were found to be obtained so long as the photoconductive layer had the Eu controlled to be not less than 50 meV to not more than 60 meV, and the DOS not less than $1\times10^{14}$ $cm^{-3}$ to less than $1\times10^{16}$ $cm^{-3}$, on the average in film.

In the same manner as in Example 1, the light-receiving members produced were each set in the electrophotographic apparatus NP6150, manufactured by Canon Inc., modified for testing, and images were reproduced through a process comprised of charging, exposure, development, transfer and cleaning. As a result, it was possible to obtain very good images.

Example 13

In the present Example, as a light absorbing layer for preventing occurrence of interference fringes due to light reflected from the support, an IR absorbing layer formed of amorphous silicon germanium was provided between the support and the charge injection blocking layer. Conditions under which an electrophotographic light-receiving member was produced here were as shown in Table 15.

Except for the foregoing, Example 9 was repeated.

In the present Example, the Eu and DOS of the photoconductive layer formed under the conditions shown in Table 15 were 57 meV and $4.8\times10^{15}$ $cm^{-3}$, respectively, on the average in film. The electrophotographic light-receiving members similarly produced were also evaluated in the same manner as in Example 9. As a result, good electrophotographic performances like those in Example 9 were obtained.

That is, also in the case when, as a light absorbing layer for preventing occurrence of interference fringes due to light reflected from the support, the IR absorbing layer was provided between the support and the charge injection blocking layer, good electrophotographic performances were found to be obtained so long as the photoconductive layer had the Eu controlled to be not less than 50 meV to not more than 60 meV, and the DOS not less than $1\times10^{14}$ $cm^{-3}$ to less than $1\times10^{16}$ $cm^{-3}$, on the average in film.

In the same manner as in Example 1, the light-receiving members produced were each set in the electrophotographic apparatus NP6150, manufactured by Canon Inc., modified for testing, and images were reproduced through a process comprised of charging, exposure, development, transfer and cleaning. As a result, it was possible to obtain very good images.

Example 14

In the present Example, the apparatus shown in FIG. 3, for producing electrophotographic light-receiving members by VHF-PCVD in place of the RF-PCVD in Example 9 was used. A light-receiving layer comprised of a charge injection blocking layer, a photoconductive layer and a surface layer was formed on a mirror-finished cylindrical aluminum support of 108 mm diameter under conditions as shown in Table 16, to produce a light-receiving member. In that course, the conditions for forming the photoconductive layer were continuously changed in the layer thickness direction as shown in Table 17. The discharge power in the conditions for forming the photoconductive layer was also continuously changed in the layer thickness direction at powers 3 to 8 times the flow rate of $SiH_4$. Thus, several kinds of light-receiving members were produced. Here, the Eu and DOS of the photoconductive layer were measured at three points in the film forming conditions, i.e., at the support side, the middle portion and the surface side, to take sample values, which were simply averaged to obtain averages in film.

Except for the foregoing, Example 9 was repeated.

Then, on glass substrates (7059; available from Corning Glass Works) and a silicon (Si) wafer which were provided on a cylindrical sample holder, several kinds of a-Si films were deposited under the same constant conditions as those shown in Table 17. On the deposited films formed on the glass substrates, Al comb electrodes were formed by vapor deposition, and the characteristic energy at the exponential tail (Eu) and the density of states of localization (DOS) were measured by CPM. In respect of the films on the silicon wafers, the hydrogen content was measured by FTIR.

In the same manner as in Example 9, the light-receiving members produced were each set in an electrophotographic apparatus (a copying machine NP6150, manufactured by Canon Inc., modified for testing), and images were reproduced to evaluate the dependence of charge performance on temperature (temperature-dependent properties), the exposure memory (blank memory and ghost) and the sensitivity.

As the result, the relationship between the discharge power and the support temperature and the relationship between the Eu or DOS and the temperature-dependent properties, exposure memory or sensitivity were the same as those in Example 9, and it was found preferable to change the Eu and DOS in the layer thickness direction so as to be not less than 50 meV to not more than 60 meV and not less than $1\times10^{14}$ $cm^{-3}$ to less than $1\times10^{16}$ $cm^{-3}$, respectively, on the average in film, in order to obtain good electrophotographic performances.

In the same manner as in Example 1, the light-receiving members produced were each set in the electrophotographic apparatus NP6150, manufactured by Canon Inc., modified for testing, and images were reproduced through a process comprised of charging, exposure, development, transfer and cleaning. As a result, it was possible to obtain very good images.

Example 15

In the present Example, as atoms capable of controlling conductivity type, nitrogen atoms were provided in the surface layer in place of carbon atoms. Conditions under which an electrophotographic light-receiving member was produced here were as shown in Table 18.

Except for the foregoing, Example 14 was repeated.

In the present Example, the Eu and DOS of the photoconductive layer formed under the conditions shown in Table 18 were 51 meV and $3.8\times10^{14}$ $cm^{-3}$, respectively, on the support side of the layer (initial); 55 meV and $1.3\times10^{15}$ $cm^{-3}$, respectively, at the middle portion of the layer; 59 meV and $3.7\times10^{15}$ $cm^{-3}$, respectively, on the surface side of the layer; and 55 meV and $1.8\times10^{15}$ $cm^{-3}$, respectively, on the average in film. The electrophotographic light-receiving members similarly produced were also evaluated in the same manner as in Example 9. As a result, good electrophotographic performances like those in Example 9 were obtained.

That is, also in the case when, as atoms capable of controlling conductivity type, nitrogen atoms were provided in the surface layer in place of carbon atoms, good electrophotographic performances were found to be obtained so long as the photoconductive layer had the Eu controlled to be not less than 50 meV to not more than 60 meV, and the DOS not less than $1\times10^{14}$ $cm^{-3}$ to less than $1\times10^{16}$ $cm^{-3}$, on the average in film.

In the same manner as in Example 1, the light-receiving members produced were each set in the electrophotographic apparatus NP6150, manufactured by Canon Inc., modified for testing, and images were reproduced through a process comprised of charging, exposure, development, transfer and cleaning. As a result, it was possible to obtain very good images.

Example 16

In the present Example, the charge injection blocking layer was omitted and the photoconductive layer was constituted of a first layer region containing carbon atoms in the state they were distributed non-uniformly in the layer thickness direction and a second layer region containing substantially no carbon atoms. Conditions under which an electrophotographic light-receiving member was produced here were as shown in Table 19.

Except for the foregoing, Example 13 was repeated.

In the present Example, the Eu and DOS of the photoconductive layer formed under the conditions shown in Table 19 were 59 meV and $2.3\times10^{15}$ $cm^{-3}$, respectively, on the average in film. The electrophotographic light-receiving members similarly produced were also evaluated in the same manner as in Example 9. As a result, good electrophotographic performances like those in Example 9 were obtained.

That is, also in the case when the charge injection blocking layer was omitted and the photoconductive layer was constituted of a first layer region containing carbon atoms in the state they were distributed non-uniformly in the layer thickness direction and a second layer region containing substantially no carbon atoms, good electrophotographic performances were found to be obtained so long as the photoconductive layer had the Eu controlled to be not less than 50 meV to not more than 60 meV, and the DOS not less than $1\times10^{14}$ $cm^{-3}$ to less than $1\times10^{16}$ $cm^{-3}$, on the average in film.

In the same manner as in Example 1, the light-receiving members produced were each set in the electrophotographic apparatus NP6150, manufactured by Canon Inc., modified for testing, and images were reproduced through a process comprised of charging, exposure, development, transfer and cleaning. As a result, it was possible to obtain very good images.

Example 17

In the present Example, an intermediate layer (a lower surface layer) made to have a smaller carbon atom content than the surface layer was provided between the photoconductive layer and the surface layer and at the same time the photoconductive layer was functionally separated into two layers comprised of a charge generation layer and a charge transport layer. Conditions under which an electrophotographic light-receiving member was produced here were as shown in Table 20.

Except for the foregoing, Example 13 was repeated.

In the present Example, the Eu and DOS of the photoconductive layer formed under the conditions shown in Table 20 were 55 meV and $2\times10^{15}$ $cm^{-3}$, respectively, on the average in film. The electrophotographic light-receiving members similarly produced were also evaluated in the same manner as in Example 9. As a result, good electrophotographic performances like those in Example 9 were obtained.

That is, also in the case when the intermediate layer (a lower surface layer) made to have a smaller carbon atom content than the surface layer was provided between the photoconductive layer and the surface layer and at the same time the photoconductive layer was functionally separated into two layers comprised of a charge generation layer and a charge transport layer, good electrophotographic performances were found to be obtained so long as the photoconductive layer had the Eu controlled to be not less than 50 meV to not more than 60 meV, and the DOS not less than $1\times10^{14}$ $cm^{-3}$ to less than $1\times10^{16}$ $cm^{-3}$, on the average in film.

In the same manner as in Example 1, the light-receiving members produced were each set in the electrophotographic apparatus NP6150, manufactured by Canon Inc., modified for testing, and images were reproduced through a process comprised of charging, exposure, development, transfer and cleaning. As a result, it was possible to obtain very good images.

Example 18

Using the apparatus shown in FIG. 2, for producing electrophotographic light-receiving members by RF-PCVD, a light-receiving layer comprised of a charge injection blocking layer, a photoconductive layer and a surface layer was formed on a mirror-finished cylindrical aluminum support of 108 mm diameter under conditions as shown in Table 21, to produce a light-receiving member. In that course, the conditions for forming the photoconductive layer were continuously changed in the layer thickness direction as shown in Table 22. The discharge power in the conditions for forming the photoconductive layer was also continuously changed in the layer thickness direction at powers 3 to 8 times the flow rate of $SiH_4$. Thus, several kinds of light-receiving members were produced. Here, the Eu and DOS of the photoconductive layer were measured at three points in the film forming conditions, i.e., at the support side, the middle portion and the surface side, to take sample values, which were simply averaged to obtain averages in film.

The light-receiving members thus produced were each set in an electrophotographic apparatus (a copying machine NP6150, manufactured by Canon Inc., modified for testing), and images were reproduced to evaluate the dependence of charge performance on temperature (temperature-dependent properties) and the smeared images in intense exposure. To evaluate the temperature-dependent properties, the temperature of the light-receiving member was changed to range from room temperature to about 45° C., at which the charge performance was measured, and changes in charge performance per 1° C. of this temperature change were measured. A change of 2 V/degree or below was judged to be acceptable. To evaluate the smeared images in intense exposure, images reproduced were visually. judged according to five ranks of 1: very good, 2: good, 3: practical, 4: no problem in practical use, and 5: a little problematic in practical use in some instances. When it was difficult to make a clear distinction between the ranks, e.g., between ranks 1 and 2, it was noted as 1.5.

Meanwhile, on glass substrates (7059; available from Corning Glass Works) and silicon (Si) wafers which were provided on a cylindrical sample holder, several kinds of a-Si films were deposited under the same conditions as in forming the photoconductive layer. On the deposited films formed on the glass substrates, Al comb electrodes were formed by vapor deposition, and the characteristic energy at the exponential tail (Eu) and the density of states of localization (DOS) were measured by CPM. In respect of the films on the silicon wafers, the hydrogen content was measured by FTIR.

Electrophotographic light-receiving members were produced in the same manner as in Example 9 except that the photoconductive layer was formed under conditions not changed (i.e., under fixed conditions) in the layer thickness direction. The conditions under which such an electrophotographic light-receiving member was produced here were as shown in Table 23.

Except for the foregoing, Example 9 was repeated.

Results of evaluation on the light-receiving members produced in Example 9 are shown in FIGS. 22 to 27.

Figure 22:
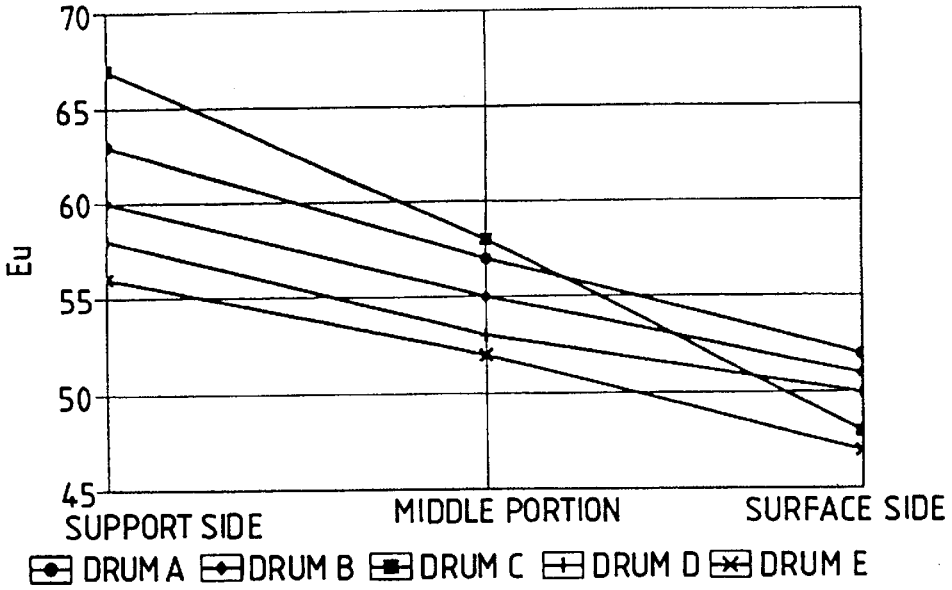
Figure 23:
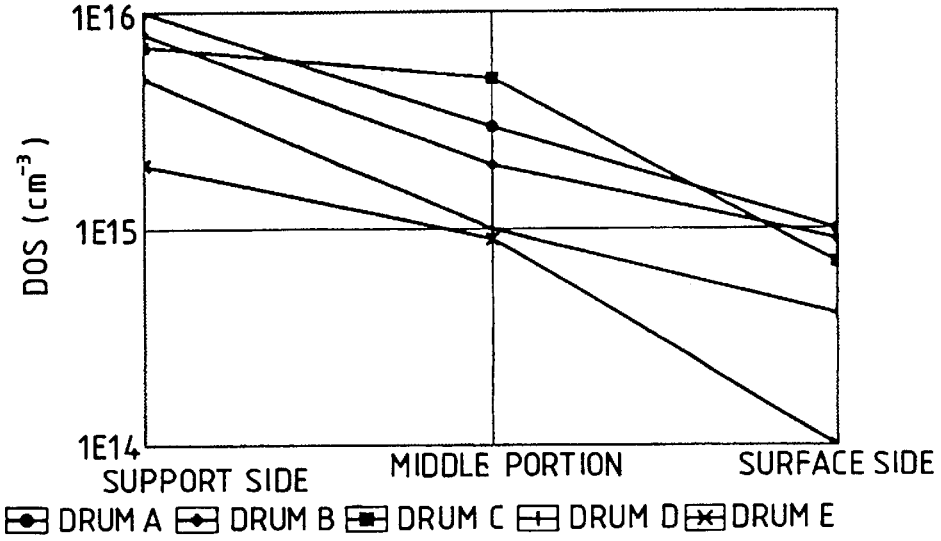
Figure 24:
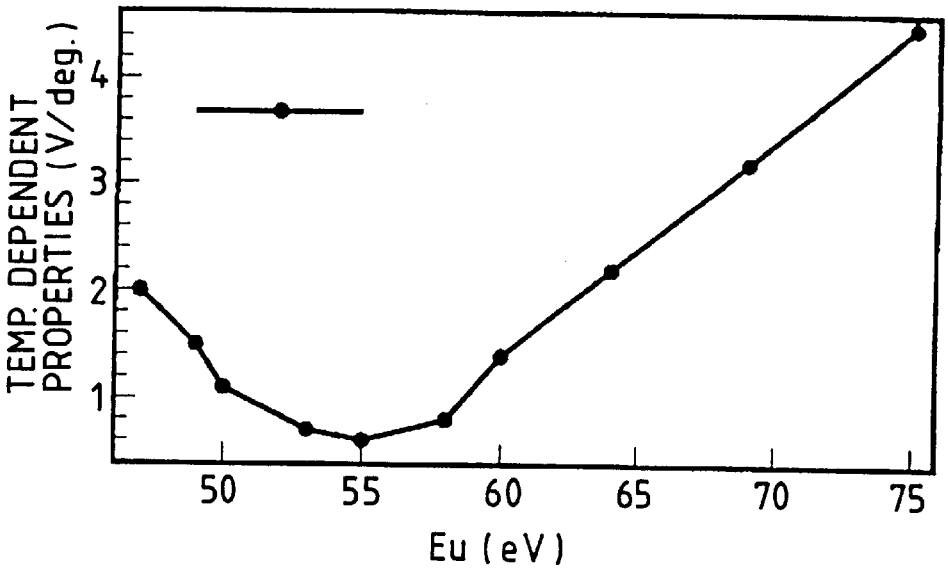
Figure 25:
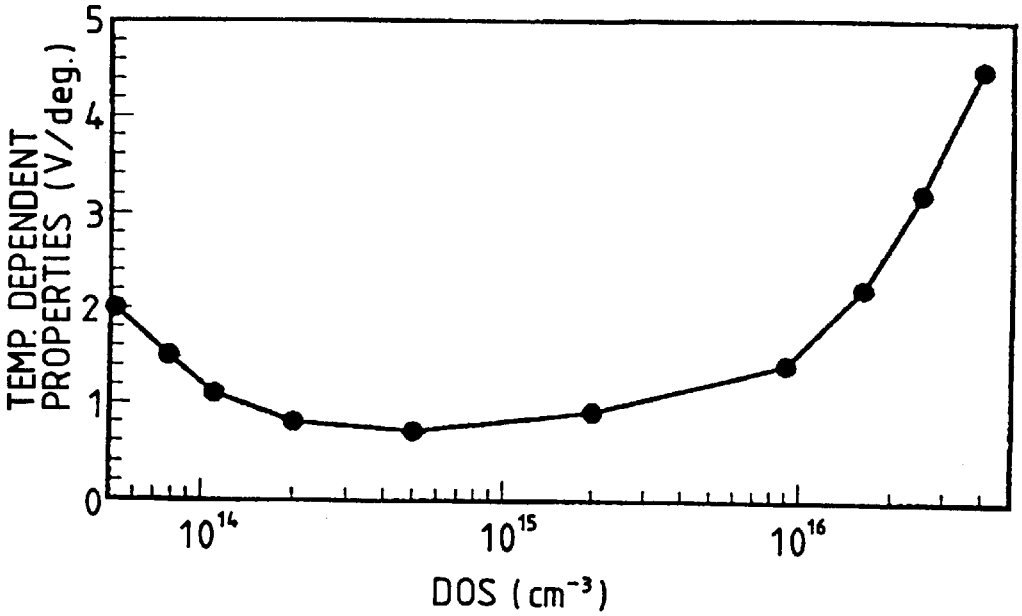
Figure 26:
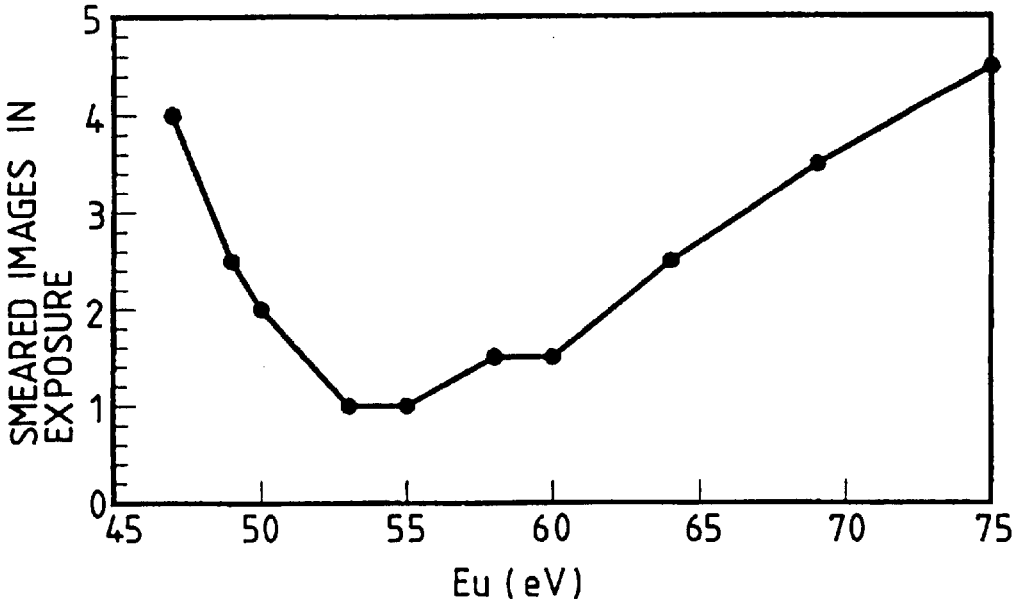
FIG. 26 shows the relationship between characteristic energy at Urbach tail (Eu) and smeared images in intense exposure, of photoconductive layers in various electrophotographic light-receiving members.
Figure 27:
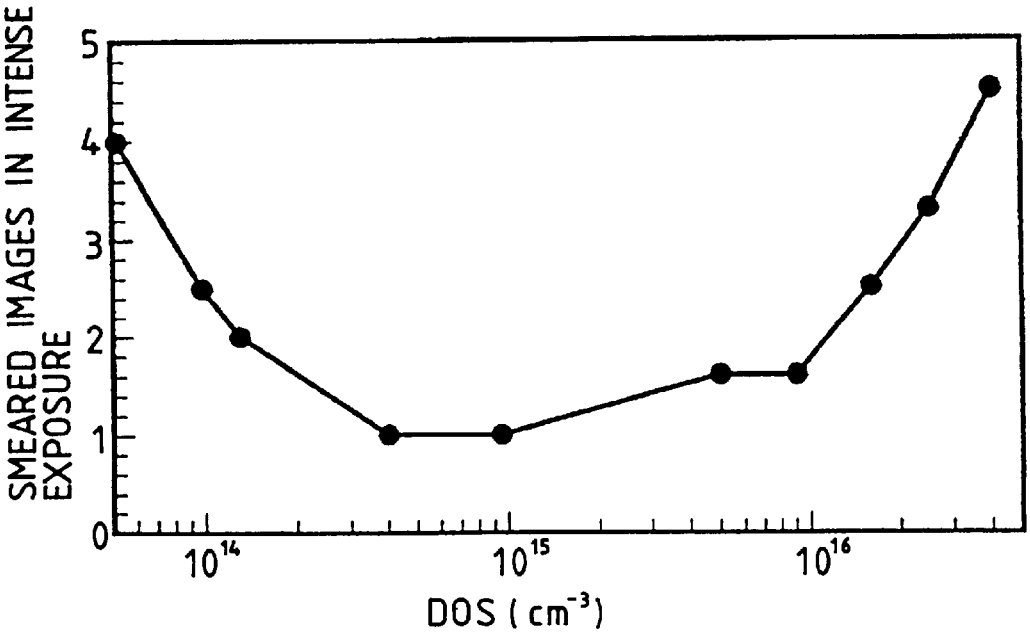
FIG. 27 shows the relationship between the density of states of localization (DOS) and smeared images in intense exposure, of photoconductive layers in various electrophotographic light-receiving members.

FIG. 22 shows the distribution of Eu in layer thickness direction in the photoconductive layers. FIG. 23 shows the distribution of DOS in layer thickness direction in the photoconductive layers. FIG. 24 shows the dependence of charge performance on temperature (temperature-dependent properties) in its relationship with average Eu in the photoconductive layers. FIG. 25 shows the dependence of charge performance on temperature (temperature-dependent properties) in its relationship with average DOS in the photoconductive layers. FIG. 26 shows the smeared images in intense exposure in its relationship with average Eu in the photoconductive layers. FIG. 27 shows the smeared images in intense exposure in its relationship with average DOS in the photoconductive layers.

Results of evaluation on the light-receiving members in which the Eu and DOS were not changed in the layer thickness direction are shown in FIGS. 28 to 31. As to the Eu and DOS in the photoconductive layers, values of samples were simply averaged to obtain averages in film.

Figure 28:
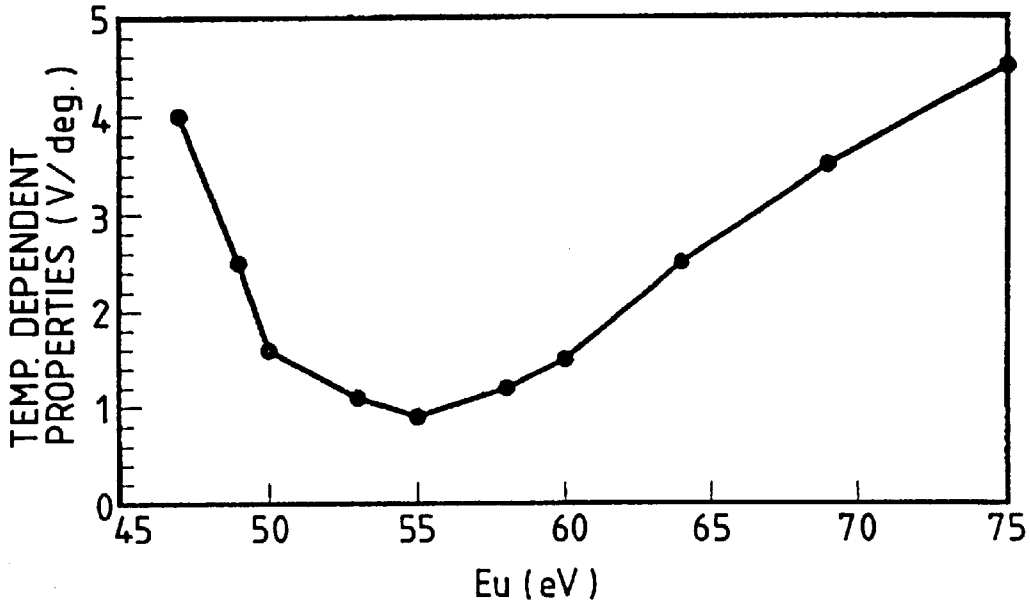
Figure 29:
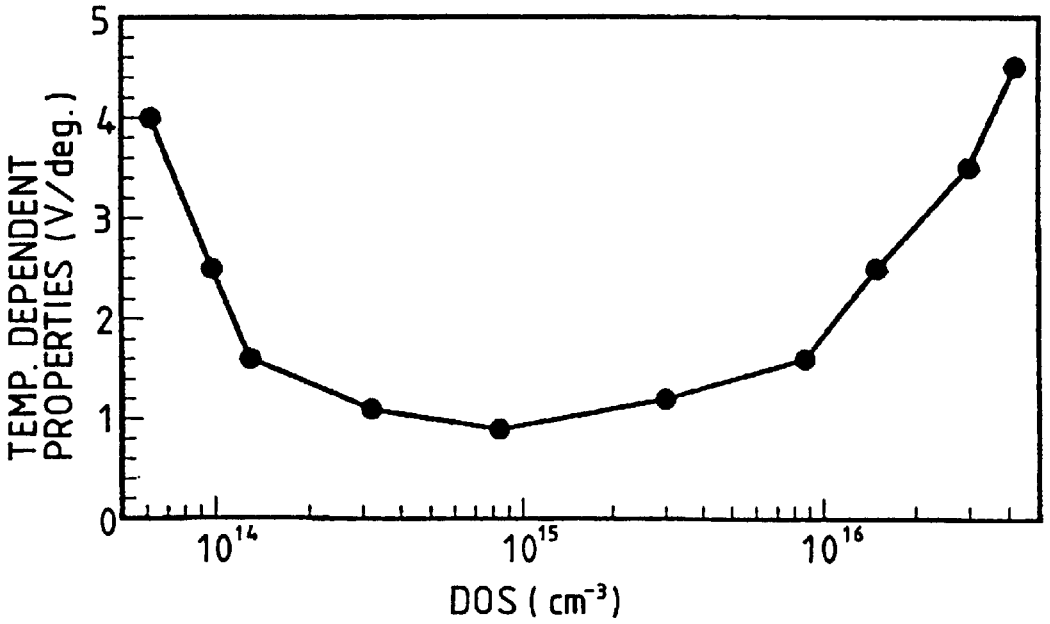
Figure 30:
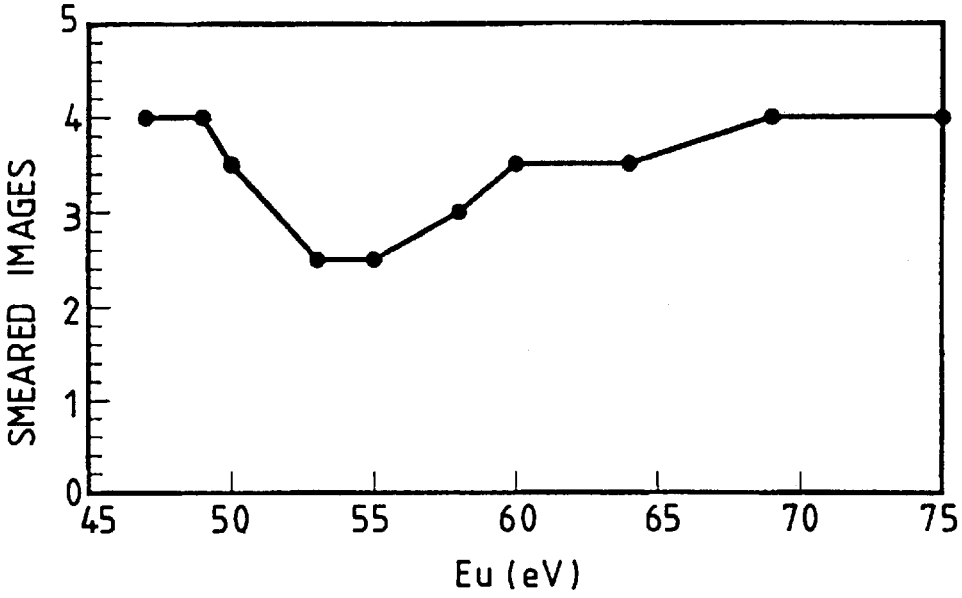
FIG. 30 shows the relationship between characteristic energy at Urbach tail (Eu) and smeared images in intense exposure, of photoconductive layers in various electrophotographic light-receiving members.
Figure 31:
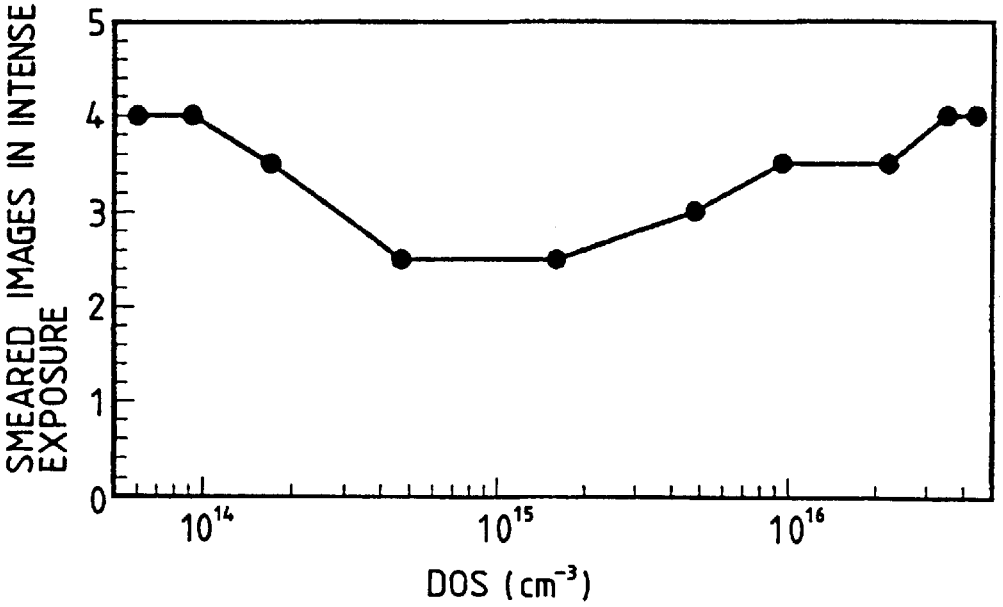
FIG. 31 shows the relationship between the density of states of localization (DOS) and smeared images in intense exposure, of photoconductive layers in various electrophotographic light-receiving members.

FIG. 28 shows the dependence of charge performance on temperature (temperature-dependent properties) in its relationship with average Eu in the photoconductive layers. FIG. 29 shows the dependence of charge performance on temperature (temperature-dependent properties) in its relationship with average DOS in the photoconductive layers. FIG. 30 shows the smeared images in intense exposure in its relationship with average Eu in the photoconductive layers. FIG. 31 shows the smeared images in intense exposure in its relationship with average DOS in the photoconductive layers.

As is seen from the above results, it was found more preferable to continuously change the Eu and DOS of the photoconductive layer in its thickness direction (FIGS. 22 to 25) so as for the Eu to be not less than 50 meV to not more than 60 meV, and the DOS not less than $1\times10^{14}$ $cm^{-3}$ to less than $1\times10^{16}$ $cm^{-3}$, on the average in film, than to make no such change (FIGS. 28 to 31), in order to obtain better electrophotographic performances. In particular, it was found preferable to do so for the sake of temperature-dependent properties and the smeared images in intense exposure. In all samples, the hydrogen content was between 10 atoms % and 30 atom %.

In the same manner as in Example 1, the light-receiving members produced were each set in the electrophotographic apparatus NP6150, manufactured by Canon Inc., modified for testing, and images were reproduced through a process comprised of charging, exposure, development, transfer and cleaning. As a result, it was possible to obtain very good images.

Example 19

In the present Example, the support temperature and power changed in Example 18 were changed in different ranges. Conditions under which an electrophotographic light-receiving member was produced here were as shown in Table 24.

Except for the foregoing, Example 18 was repeated.

In the present Example, the Eu and DOS of the photoconductive layer formed under the conditions shown in Table 24 were 64 meV and $2.0\times10^{16}$ $cm^{-3}$, respectively, on the support side of the layer (initial); 53 meV and $7.8\times10^{14}$ $cm^{-3}$, respectively, at the middle portion of the layer; 48 meV and $2.2\times10^{14}$ $cm^{-3}$, respectively, on the surface side of the layer; and 55 meV and $7.0\times10^{15}$ $cm^{-3}$, respectively, on the average in film. The electrophotographic light-receiving members similarly produced were also evaluated in the same manner as in Example 18. As a result, good electrophotographic performances like those in Example 18 were obtained.

As is seen from the foregoing, better electrophotographic performances were found to be obtained even if the Eu and DOS were partly outside the above ranges on the support side, so long as the Eu was controlled to be not less than 50 meV to not more than 60 mev, and the DOS not less than $1\times10^{14}$ $cm^{-3}$ to less than $1\times10^{16}$ $cm^{-3}$, on the average in film.

In the same manner as in Example 1, the light-receiving members produced were each set in the electrophotographic apparatus NP6150, manufactured by Canon Inc., modified for testing, and images were reproduced through a process comprised of charging, exposure, development, transfer and cleaning. As a result, it was possible to obtain very good images.

Example 20

In the present Example, an intermediate layer (a lower surface layer) made to have a smaller carbon atom content than the surface layer was provided between the photoconductive layer and the surface layer. Conditions under which an electrophotographic light-receiving member was produced here were as shown in Table 25.

Except for the foregoing, Example 18 was repeated.

In the present Example, the Eu and DOS of the photoconductive layer formed under the conditions shown in Table 25 were 53 meV and $1.2\times10^{15}$ $cm^{-3}$, respectively, on the average in film. The electrophotographic light-receiving members similarly produced were also evaluated in the same manner as in Example 18. As a result, good electrophotographic performances like those in Example 18 were obtained.

That is, also in the case when the intermediate layer (a lower surface layer) was provided, good electrophotographic performances were found to be obtained so long as the photoconductive layer had the Eu controlled to be not less than 50 meV to not more than 60 meV, and the DOS not less than $1\times10^{14}$ $cm^{-3}$ to less than $1\times10^{16}$ $cm^{-3}$, on the average in film.

In the same manner as in Example 1, the light-receiving members produced were each set in the electrophotographic apparatus NP6150, manufactured by Canon Inc., modified for testing, and images were reproduced through a process comprised of charging, exposure, development, transfer and cleaning. As a result, it was possible to obtain very good images.

Example 21

In the present Example, a surface layer containing silicon atoms and carbon atoms in the state they were distributed non-uniformly in the layer thickness direction was provided in place of the surface layer in Example 18. Conditions under which an electrophotographic light-receiving member was produced here were as shown in Table 26.

Except for the foregoing, Example 18 was repeated.

In the present Example, the Eu and DOS of the photoconductive layer formed under the conditions shown in Table 26 were 51 meV and $6.7\times10^{14}$ $cm^{-3}$, respectively, on the average in film. The electrophotographic light-receiving members similarly produced were also evaluated in the same manner as in Example 18. As a result, good electrophotographic performances like those in Example 18 were obtained.

That is, also in the case when the surface layer containing silicon atoms and carbon atoms in the state they were distributed non-uniformly in the layer thickness direction was provided, good electrophotographic performances were found to be obtained so long as the photoconductive layer had the Eu controlled to be not less than 50 meV to not more than 60 meV, and the DOS not less than $1\times10^{14}$ $cm^{-3}$ to less than $1\times10^{16}$ $cm^{-3}$, on the average in film.

In the same manner as in Example 1, the light-receiving members produced were each set in the electrophotographic apparatus NP6150, manufactured by Canon Inc., modified for testing, and images were reproduced through a process comprised of charging, exposure, development, transfer and cleaning. As a result, it was possible to obtain very good images.

Example 22

In the present Example, as a light absorbing layer for preventing occurrence of interference fringes due to light reflected from the support, an IR absorbing layer formed of amorphous silicon germanium was provided between the support and the charge injection blocking layer. Conditions under which an electrophotographic light-receiving member was produced here were as shown in Table 27.

Except for the foregoing, Example 18 was repeated.

In the present Example, the Eu and DOS of the photoconductive layer formed under the conditions shown in Table 27 were 58 meV and $4.2\times10^{15}$ $cm^{-3}$, respectively, on the average in film. The electrophotographic light-receiving members similarly produced were also evaluated in the same manner as in Example 18. As a result, good electrophotographic performances like those in Example 18 were obtained.

That is, also in the case when, as a light absorbing layer for preventing occurrence of interference fringes due to light reflected from the support, the IR absorbing layer was provided between the support and the charge injection blocking layer, good electrophotographic performances were found to be obtained so long as the photoconductive layer had the Eu controlled to be not less than 50 meV to not more than 60 meV, and the DOS not less than $1\times10^{14}$ $cm^{-3}$ to less than $1\times10^{16}$ $cm^{-3}$, on the average in film.

In the same manner as in Example 1, the light-receiving members produced were each set in the electrophotographic apparatus NP6150, manufactured by Canon Inc., modified for testing, and images were reproduced through a process comprised of charging, exposure, development, transfer and cleaning. As a result, it was possible to obtain very good images.

Example 23

In the present Example, the apparatus shown in FIG. 3, for producing electrophotographic light-receiving members by VHF-PCVD in place of the RF-PCVD in Example 18 was used. A light-receiving layer comprised of a charge injection blocking layer, a photoconductive layer and a surface layer was formed on a mirror-finished cylindrical aluminum support of 108 mm diameter under conditions as shown in Table 28, to produce a light-receiving member. In that course, the conditions for forming the photoconductive layer were continuously changed in the layer thickness direction as shown in Table 29. The discharge power in the conditions for forming the photoconductive layer was also continuously changed in the layer thickness direction at powers 3 to 8 times the flow rate of $SiH_4$. Thus, several kinds of light-receiving members were produced. Here, the Eu and DOS of the photoconductive layer were measured at three points in the film forming conditions, i.e., at the support side, the middle portion and the surface side, to take sample values, which were simply averaged to obtain averages in film.

Except for the foregoing, Example 18 was repeated.

Then, on glass substrates (7059; available from Corning Glass Works) and a silicon (Si) wafer which were provided on a cylindrical sample holder, several kinds of a-Si films were deposited under the same constant conditions as those shown in Table 29. On the deposited films formed on the glass substrates, Al comb electrodes were formed by vapor deposition, and the characteristic energy at the exponential tail (Eu) and the density of states of localization (DOS) were measured by CPM. In respect of the films on the silicon wafers, the hydrogen content was measured by FTIR.

In the same manner as in Example 18, the light-receiving members produced were each set in an electrophotographic apparatus (a copying machine NP6150, manufactured by Canon Inc., modified for testing), and images were reproduced to evaluate the dependence of charge performance on temperature (temperature-dependent properties) and the smeared images in intense exposure.

As the result, the relationship between the discharge power and the support temperature and the relationship between the Eu or DOS and the temperature-dependent properties or smeared images in intense exposure were the same as those in Example 18, and it was found preferable to change the Eu and DOS in the layer thickness direction so as to be not less than 50 meV to not more than 60 meV and not less than $1\times10^{14}$ $cm^{-3}$ to less than $1\times10^{16}$ $cm^{-3}$, respectively, on the average in film, in order to obtain good electrophotographic performances.

In the same manner as in Example 1, the light-receiving members produced were each set in the electrophotographic apparatus NP6150, manufactured by Canon Inc., modified for testing, and images were reproduced through a process comprised of charging, exposure, development, transfer and cleaning. As a result, it was possible to obtain very good images.

Example 24

In the present Example, as atoms capable of controlling conductivity type, nitrogen atoms were provided in the surface layer in place of carbon atoms. Conditions under which an electrophotographic light-receiving member was produced here were as shown in Table 30.

Except for the foregoing, Example 23 was repeated.

In the present Example, the Eu and DOS of the photoconductive layer formed under the conditions shown in Table 30 were 62 meV and $5.8\times10^{15}$ $cm^{-3}$, respectively, on the support side of the layer (initial); 57 meV and $6.3\times10^{14}$ $cm^{-3}$, respectively, at the middle portion of the layer; 47 meV and $1.7\times10^{14}$ $cm^{-3}$, respectively, on the surface side of the layer; and 52 meV and $2.2\times10^{15}$ $cm^{-3}$, respectively, on the average in film. The electrophotographic light-receiving members similarly produced were also evaluated in the same manner as in Example 18. As a result, good electrophotographic performances like those in Example 18 were obtained.

That is, also in the case when, as atoms capable of controlling conductivity type, nitrogen atoms were provided in the surface layer in place of carbon atoms, good electrophotographic performances were found to be obtained so long as the photoconductive layer had the Eu controlled to be not less than 50 meV to not more than 60 meV, and the DOS not less than $1\times10^{14}$ $cm^{-3}$ to less than $1\times10^{16}$ $cm^{-3}$, on the average in film.

In the same manner as in Example 1, the light-receiving members produced were each set in the electrophotographic apparatus NP6150, manufactured by Canon Inc., modified for testing, and images were reproduced through a process comprised of charging, exposure, development, transfer and cleaning. As a result, it was possible to obtain very good images.

Example 25

In the present Example, the charge injection blocking layer was omitted and the photoconductive layer was constituted of a first layer region containing carbon atoms in the state they were distributed non-uniformly in the layer thickness direction and a second layer region containing substantially no carbon atoms. Conditions under which an electrophotographic light-receiving member was produced here were as shown in Table 31.

Except for the foregoing, Example 22 was repeated.

In the present Example, the Eu and DOS of the photoconductive layer formed under the conditions shown in Table 31 were 56 meV and $1.3\times10^{15}$ $cm^{-3}$, respectively, on the average in film. The electrophotographic light-receiving members similarly produced were also evaluated in the same manner as in Example 18. As a result, good electrophotographic performances like those in Example 18 were obtained.

That is, also in the case when the charge injection blocking layer was omitted and the photoconductive layer was constituted of a first layer region containing carbon atoms in the state they were distributed non-uniformly in the layer thickness direction and a second layer region containing substantially no carbon atoms, good electrophotographic performances were found to be obtained so long as the photoconductive layer had the Eu controlled to be not less than 50 meV to not more than 60 meV, and the DOS not less than $1\times10^{14}$ $cm^{-3}$ to less than $1\times10^{16}$ $cm^{-3}$, on the average in film.

In the same manner as in Example 1, the light-receiving members produced were each set in the electrophotographic apparatus NP6150, manufactured by Canon Inc., modified for testing, and images were reproduced through a process comprised of charging, exposure, development, transfer and cleaning. As a result, it was possible to obtain very good images.

Example 26

In the present Example, an intermediate layer (a lower surface layer) made to have a smaller carbon atom content than the surface layer was provided between the photoconductive layer and the surface layer and at the same time the photoconductive layer was functionally separated into two layers comprised of a charge generation layer and a charge transport layer. Conditions under which an electrophotographic light-receiving member was produced here were as shown in Table 32.

Except for the foregoing, Example 22 was repeated.

In the present Example, the Eu and DOS of the photoconductive layer formed under the conditions shown in Table 32 were 57 meV and $3\times10^{15}$ $cm^{-3}$, respectively, on the average in film. The electrophotographic light-receiving members similarly produced were also evaluated in the same manner as in Example 18. As a result, good electrophotographic performances like those in Example 18 were obtained.

That is, also in the case when the intermediate layer (a lower surface layer) made to have a smaller carbon atom content than the surface layer was provided between the photoconductive layer and the surface layer and at the same time the photoconductive layer was functionally separated into two layers comprised of a charge generation layer and ax charge transport layer, good electrophotographic performances were found to be obtained so long as the photoconductive layer had the Eu controlled to be not less than 50 meV to not more than 60 meV, and the DOS not less than $1\times10^{14}$ $cm^{-3}$ to less than $1\times10^{16}$ $cm^{-3}$, on the average in film.

In the same manner as in Example 1, the light-receiving members produced were each set in the electrophotographic apparatus NP6150, manufactured by Canon Inc., modified for testing, and images were reproduced through a process comprised of charging, exposure, development, transfer and cleaning. As a result, it was possible to obtain very good images.

Example 27

Using the apparatus shown in FIG. 2, for producing electrophotographic light-receiving members by RF-PCVD, light-receiving layers each comprised of a charge injection blocking layer, a photoconductive layer and a surface layer were formed on mirror-finished cylindrical aluminum supports of 108 mm diameter under conditions as shown in Tables 33 and 34, to produce light-receiving members. Especially with regard to the conditions for forming the photoconductive layer, the discharge power (A×B) was fixed at 450 W by selecting 900 sccm as the total A of the flow rates of material gas and dilute gas and 0.5 as the constant B, where the constant C was changed with respect to the total A, 900 sccm, of the flow rates of material gas and dilute gas to produce a plurality of light-receiving members with different flow rates (A×C) of a gas containing the element belonging to Group IIIb of the periodic table.

The light-receiving members thus produced were each set in an electrophotographic apparatus (a copying machine NP6150, manufactured by Canon Inc., modified for testing), and images were reproduced to evaluate the charge performance, the sensitivity, the dependence of charge performance on temperature (temperature-dependent properties), the exposure memory and the charge potential shift in continuous charging.

The charge performance is indicated by a value of measurement of charging voltage applied when the quantity of charging currents flowing to a corona assembly is kept constant. The charge performance was evaluated according to three ranks of 1: good, 2: no problem in practical use, and 3: a little problematic in practical use in some instances. Here, the rank 1 is an instance where the charge performance is 550 V or more. In the case of rank 1, it becomes possible to expand the freedom, and also save energy, of devices attached as functional members, e.g., to save power of charging currents and to make the corona assembly smaller in size. The rank 2 is an instance where the charge performance is not less than 400 V to less than 550 V and there is no problem in practical use. The rank 3 is an instance where the charge performance is less than 400 V. In the case of rank 3, the charging currents tend to be excessive to cause a lowering of sensitivity, tending to result in photosensitive members with a low contrast.

The sensitivity is indicated by a value of measurement of the amount of exposure required when the charge potential comes to stand at 200 V when the light-receiving member is exposed to light after the value of charging currents flowing to a corona assembly has been determined so as to give a charge potential of 400 V. The sensitivity was evaluated according to four ranks of 1: 85% or less (very good), 2: 95% or less (good), 3: 110% or less (no problem in practical use), and 4: 120% or more (a little problematic in practical use in some instances), assuming the amount of exposure of a conventional light-receiving member as 100.

The temperature-dependent properties are indicated as an absolute value corresponding to the amount of changes in charge performance per 1° C. of temperature change measured when the temperature of the light-receiving member is changed to range from room temperature to 45° C., at which the charge performance is measured. The temperature-dependent properties were evaluated according to three ranks of A: within 2 V/degree (good), B: 2 to 3 V/degree (no problem in practical use), and C: more than 3 V/degree (a little problematic in practical use in some instances).

The exposure memory is indicated by a light memory potential measured in the following way. First, the charging current of a main corona assembly is adjusted so that the dark portion potential at a development position comes to be 400 V, and the voltage at which a halogen lamp for irradiating an original is lighted is adjusted so that the light portion potential comes to be +50 V when transfer paper (A3 size) is used as an original. In that state, between the case when the halogen lamp is lighted only on the image leading part and the case when the halogen lamp is not lighted, a potential difference at the same portion of the electrophotographic light-receiving member, i.e., a potential at the image leading part, is further measured to determine the light memory potential. The exposure memory was evaluated according to four ranks of 1: 5 V or less (very good), 2: 10 V or less (good), 3: 15 V or less (no problem in practical use), and 4: more than 15 V (a little problematic in practical use in some instances).

The charge potential shift in continuous charging is indicated as an absolute value corresponding to the amount of changes in charge performance when continuously driven for 5 minutes. The charge potential shift in continuous charging was evaluated according to four ranks of 1: 5 V or less (very good), 2: 5 to 10 V (good), 3: 10 to 15 V (no problem in practical use), and 4: more than 15 V (a little problematic in practical use in some instances).

Results of the evaluation on the above five items are shown in Table 35.

As is seen from the evaluation results (Table 35) in Example 27, the condition necessary for the dependence of charge performance on temperature (temperature-dependent properties) to be within ±2 V/degree is to control the constant C in the range between $5\times10^{-4}$ and $5\times10^{-3}$. This determines the flow rate (A×C) of the gas containing the element belonging to Group IIIb of the periodic table, with respect to the total A, 900 sccm, of the flow rates of material gas and dilute gas. It has also been found that light-receiving members having good charge performance, sensitivity, exposure memory and charge potential shift in continuous charging can be produced when this constant C is limited to that range.

In the same manner as in Example 1, the light-receiving members produced were each set in the electrophotographic apparatus NP6150, manufactured by Canon Inc., modified for testing, and images were reproduced through a process comprised of charging, exposure, development, transfer and cleaning. As a result, it was possible to obtain very good images.

Example 28

In the present Example, in place of the conditions for forming the photoconductive layers in Example 27 in which the gas species and the gas flow rates were changed, photoconductive layers were formed under conditions in which the discharge power (A×B) was set variable by changing the constant B in the range of from 0.2 to 0.7. Conditions under which the electrophotographic light-receiving members thus produced were as shown in Tables 36 and 37.

Except for the foregoing, Example 27 was repeated.

On the electrophotographic light-receiving members produced, evaluation was made in the same manner as in Example 27. Results obtained are shown in Table 38.

As is seen from the evaluation results (Table 38) in Example 28, the condition necessary for the dependence of charge performance on temperature (temperature-dependent properties) to be within ±2 V/degree is to control the constant B in the range between 0.2 and 0.7. This determines the power, i.e., discharge power (A×B) with respect to the total A, 900 sccm, of the flow rates of material gas and dilute gas. It has been also found that light-receiving members having good charge performance, sensitivity, exposure memory and charge potential shift in continuous charging can be produced when this constant B is limited to that range. It has been still also found that light-receiving members more improved in exposure memory can be produced when the constant B is 0.5 or more.

In the same manner as in Example 1, the light-receiving members produced were each set in the electrophotographic apparatus NP6150, manufactured by Canon Inc., modified for testing, and images were reproduced through a process comprised of charging, exposure, development, transfer and cleaning. As a result, it was possible to obtain very good images.

Example 29

In the present Example, a surface layer containing silicon atoms and carbon atoms in the state they were distributed non-uniformly in the layer thickness direction was provided in place of the surface layer in Example 27. Conditions under which an electrophotographic light-receiving member was produced here were as shown in Table 39.

Except for the foregoing, Example 27 was repeated.

On the electrophotographic light-receiving members produced, evaluation was made in the same manner as in Example 27. As a result, good electrophotographic performances were confirmed on all the temperature-dependent properties, exposure memory and charge potential shift in continuous charging.

That is, also in the case when the surface layer containing silicon atoms and carbon atoms in the state they were distributed non-uniformly in the layer thickness direction was provided, the good electrophotographic performances that the dependence of charge performance on temperature (temperature-dependent properties) is within ±2 V/degree were found to be exhibited.

In the same manner as in Example 1, the light-receiving members produced were each set in the electrophotographic apparatus NP6150, manufactured by Canon Inc., modified for testing, and images were reproduced through a process comprised of charging, exposure, development, transfer and cleaning. As a result, it was possible to obtain very good images.

Example 30

In the present Example, as a light absorbing layer for preventing occurrence of interference fringes due to light reflected from the support, an IR absorbing layer formed of amorphous silicon germanium was provided between the support and the charge injection blocking layer. Conditions under which an electrophotographic light-receiving member was produced here were as shown in Table 40.

Except for the foregoing, Example 27 was repeated.

On the electrophotographic light-receiving members produced, evaluation was made in the same manner as in Example 27. As a result, good electrophotographic performances were confirmed on all the temperature-dependent properties, exposure memory and charge potential shift in continuous charging.

That is, also in the case when, as a light absorbing layer for preventing occurrence of interference fringes due to light reflected from the support, the IR absorbing layer was provided between the support and the charge injection blocking layer, the good electrophotographic performances that the dependence of charge performance on temperature (temperature-dependent properties) is within ±2 V/degree were found to be exhibited.

In the same manner as in Example 1, the light-receiving members produced were each set in the electrophotographic apparatus NP6150, manufactured by Canon Inc., modified for testing, and images were reproduced through a process comprised of charging, exposure, development, transfer and cleaning. As a result, it was possible to obtain very good images.

Example 31

In the present Example, the charge injection blocking layer was omitted and the photoconductive layer was functionally separated into two layers comprised of a charge generation layer and a charge transport layer. Conditions under which an electrophotographic light-receiving member was produced here were as shown in Table 41.

Except for the foregoing, Example 27 was repeated.

On the electrophotographic light-receiving members produced, evaluation was made in the same manner as in Example 27. As a result, good electrophotographic performances were confirmed on all the temperature-dependent properties, exposure memory and charge potential shift in continuous charging.

That is, also in the case when the charge injection blocking layer was omitted and the photoconductive layer was functionally separated into two layers comprised of a charge generation layer and a charge transport layer, the good electrophotographic performances that the dependence of charge performance on temperature (temperature-dependent properties) is within ±2 V/degree were found to be exhibited.

In the same manner as in Example 1, the light-receiving members produced were each set in the electrophotographic apparatus NP6150, manufactured by Canon Inc., modified for testing, and images were reproduced through a process comprised of charging, exposure, development, transfer and cleaning. As a result, it was possible to obtain very good images.

Example 32

In the present Example, leaving the charge injection blocking layer, the photoconductive layer was functionally separated into two layers comprised of a charge generation layer and a charge transport layer. Conditions under which an electrophotographic light-receiving member was produced here were as shown in Table 42.

Except for the foregoing, Example 27 was repeated.

On the electrophotographic light-receiving members produced, evaluation was made in the same manner as in Example 27. As a result, good electrophotographic performances were confirmed on all the temperature-dependent properties, exposure memory and charge potential shift in continuous charging.

That is, also in the case when the photoconductive layer was functionally separated into two layers comprised of a charge generation layer and a charge transport layer while leaving the charge injection blocking layer, the good electrophotographic performances that the dependence of charge performance on temperature (temperature-dependent properties) is within ±2 V/degree were found to be exhibited.

In the same manner as in Example 1, the light-receiving members produced were each set in the electrophotographic apparatus NP6150, manufactured by Canon Inc., modified for testing, and images were reproduced through a process comprised of charging, exposure, development, transfer and cleaning. As a result, it was possible to obtain very good images.

Example 33

In the present Example, an intermediate layer (a lower surface layer) made to have a smaller carbon atom content than the surface layer was provided between the photoconductive layer and the surface layer and at the same time the photoconductive layer was functionally separated into two layers comprised of a charge generation layer and a charge transport layer. Conditions under which an electrophotographic light-receiving member was produced here were as shown in Table 43.

Except for the foregoing, Example 27 was repeated.

On the electrophotographic light-receiving members produced, evaluation was made in the same manner as in Example 27. As a result, good electrophotographic performances were confirmed on all the temperature-dependent properties, exposure memory and charge potential shift in continuous charging.

That is, also in the case when the intermediate layer (a lower surface layer) made to have a smaller carbon atom content than the surface layer was provided between the photoconductive layer and the surface layer and at the same time the photoconductive layer was functionally separated into two layers comprised of a charge generation layer and a charge transport layer, the good electrophotographic performances that the dependence of charge performance on temperature (temperature-dependent properties) is within ±2 V/degree were found to be exhibited.

In the same manner as in Example 1, the light-receiving members produced were each set in-the electrophotographic apparatus NP6150, manufactured by Canon Inc., modified for testing, and images were reproduced through a process comprised of charging, exposure, development, transfer and cleaning. As a result, it was possible to obtain very good images.

Example 34

In the present Example, the apparatus shown in FIG. 3, for producing electrophotographic light-receiving members by VHF-PCVD in place of the RF-PCVD in Example 27 was used. A light-receiving layer was formed on a mirror-finished cylindrical aluminum support of 108 mm diameter under conditions as shown in Table 44, to produce a light-receiving member.

Except for the foregoing, Example 27 was repeated.

On the electrophotographic light-receiving members produced, evaluation was made in the same manner as in Example 27. As a result, good electrophotographic performances were confirmed on all the temperature-dependent properties, exposure memory and charge potential shift in continuous charging.

That is, also in the case when the apparatus for producing electrophotographic light-receiving members by VHF-PCVD was used, the good electrophotographic performances that the dependence of charge performance on temperature (temperature-dependent properties) is within ±2 V/degree were found to be exhibited.

In the same manner as in Example 1, the light-receiving members produced were each set in the electrophotographic apparatus NP6150, manufactured by Canon Inc., modified for testing, and images were reproduced through a process comprised of charging, exposure, development, transfer and cleaning. As a result, it was possible to obtain very good images.

Example 35

In the present Example, as a light absorbing layer for preventing occurrence of interference fringes due to light reflected from the support, an IR absorbing layer formed of amorphous silicon germanium was provided between the support and the charge injection blocking layer. Conditions under which an electrophotographic light-receiving member was produced here were as shown in Table 45.

Except for the foregoing, Example 27 was repeated.

On the electrophotographic light-receiving members produced, evaluation was made in the same manner as in Example 27. As a result, good electrophotographic performances were confirmed on all the temperature-dependent properties, exposure memory and charge potential shift in continuous charging.

That is, also in the case when, as a light absorbing layer for preventing occurrence of interference fringes due to light reflected from the support, the IR absorbing layer was provided between the support and the charge injection blocking layer, the good electrophotographic performances that the dependence of charge performance on temperature (temperature-dependent properties) is within ±2 V/degree were found to be exhibited.

In the same manner as in Example 1, the light-receiving members produced were each set in the electrophotographic apparatus NP6150, manufactured by Canon Inc., modified for testing, and images were reproduced through a process comprised of charging, exposure, development, transfer and cleaning. As a result, it was possible to obtain very good images.

Example 36

In the present Example, the charge injection blocking layer was omitted and the photoconductive layer was constituted of a first layer region containing carbon atoms in the state they were distributed non-uniformly in the layer thickness direction and a second layer region containing substantially no carbon atoms. Conditions under which an electrophotographic light-receiving member was produced here were as shown in Table 46.

Except for the foregoing, Example 34 was repeated.

On the electrophotographic light-receiving members produced, evaluation was made in the same manner as in Example 27. As a result, good electrophotographic performances were confirmed on all the temperature-dependent properties, exposure memory and charge potential shift in continuous charging.

That is, also in the case when the charge injection blocking layer was omitted and the photoconductive layer was constituted of a first layer region containing carbon atoms in the state they were distributed non-uniformly in the layer thickness direction and a second layer region containing substantially no carbon atoms, the good electrophotographic performances that the dependence of charge performance on temperature (temperature-dependent properties) is within ±2 V/degree were found to be exhibited.

In the same manner as in Example 1, the light-receiving members produced were each set in the electrophotographic apparatus NP6150, manufactured by Canon Inc., modified for testing, and images were reproduced through a process comprised of charging, exposure, development, transfer and cleaning. As a result, it was possible to obtain very good images.

Example 37

In the present Example, leaving the charge injection blocking layer, the photoconductive layer was functionally separated into two layers comprised of a charge generation layer and a charge transport layer. Conditions under which an electrophotographic light-receiving member was produced here were as shown in Table 47.

Except for the foregoing, Example 34 was repeated.

On the electrophotographic light-receiving members produced, evaluation was made in the same manner as in Example 27. As a result, good electrophotographic performances were confirmed on all the temperature-dependent properties, exposure memory and charge potential shift in continuous charging.

That is, also in the case when the photoconductive layer was functionally separated into two layers comprised of a charge generation layer and a charge transport layer while leaving the charge injection blocking layer, the good electrophotographic performances that the dependence of charge performance on temperature (temperature-dependent properties) is within ±2 V/degree were found to be exhibited.

In the same manner as in Example 1, the light-receiving members produced were each set in the electrophotographic apparatus NP6150, manufactured by Canon Inc., modified for testing, and images were reproduced through a process comprised of charging, exposure, development, transfer and cleaning. As a result, it was possible to obtain very good images.

Example 38

In the present Example, an intermediate layer (a lower surface layer) made to have a smaller carbon atom content than the surface layer was provided between the photoconductive layer and the surface layer and at the same time the photoconductive layer was functionally separated into two layers comprised of a charge generation layer and a charge transport layer. Conditions under which an electrophotographic light-receiving member was produced here were as shown in Table 48.

Except for the foregoing, Example 34 was repeated.

On the electrophotographic light-receiving members produced, evaluation was made in the same manner as in Example 27. As a result, good electrophotographic performances were confirmed on all the temperature-dependent properties, exposure memory and charge potential shift in continuous charging.

That is, also in the case when the intermediate layer (a lower surface layer) made to have a smaller carbon atom content than the surface layer was provided between the photoconductive layer and the surface layer and at the same time the photoconductive layer was functionally separated into two layers comprised of a charge generation layer and a charge transport layer, the good electrophotographic performances that the dependence of charge performance on temperature (temperature-dependent properties) is less than ±2 V/degree were found to be exhibited.

In the same manner as in Example 1, the light-receiving members produced were each set in the electrophotographic apparatus NP6150, manufactured by Canon Inc., modified for testing, and images were reproduced through a process comprised of charging, exposure, development, transfer and cleaning. As a result, it was possible to obtain very good images.

TABLE 1

| | Charge injection blocking layer | Photo-conductive layer | Surface layer |
|---|---|---|---|
| Material gas & flow rate: | | | |
| $SiH_4$ (sccm) | 100 | 200 | 10 |
| $H_2$ (sccm) | 300 | 800 | |
| $B_2H_6$ (ppm) (based on $SiH_4$) | 2,000 | 2 | |
| NO (sccm) | 50 | | |
| $CH_4$ (sccm) | | | 500 |
| Support temperature: (° C.) | 290 | 290 | 290 |
| Internal pressure: (Torr) | 0.5 | 0.5 | 0.5 |
| Power: (W) | 500 | 800 | 300 |
| Layer thickness: (μm) | 3 | 30 | 0.5 |

TABLE 2

| | Charge injection blocking layer | Photo-conductive layer | Inter-mediate layer | Surface layer |
|---|---|---|---|---|
| Material gas & flow rate: | | | | |
| $SiH_4$ (sccm) | 150 | 200 | 100 | 10 |
| $H_2$ (sccm) | 500 | 800 | | |
| $PH_3$ (ppm)* | 1,000 | | | |
| $B_2H_6$ (ppm)* | | 0.5 | 500 | |
| $CH_4$ (sccm) | 20 | | 300 | 500 |
| Support temperature: (° C.) | 250 | 250 | 250 | 250 |
| Internal pressure: (Torr) | 0.3 | 0.3 | 0.2 | 0.1 |
| Power: (W) | 300 | 600 | 300 | 200 |
| Layer thickness: (μm) | 2 | 30 | 0.1 | 0.5 |

*(based on $SiH_4$)

TABLE 3

| | Charge injection blocking layer | Photo-conductive layer | Surface layer |
|---|---|---|---|
| Material gas & flow rate: | | | |
| $SiH_4$ (sccm) | 150 | 200 | 200→10→10 |
| $SiF_4$ (sccm) | 2 | 1 | 5 |
| $H_2$ (sccm) | 500 | 1,000 | |
| $B_2H_6$ (ppm) (based on $SiH_4$) | 1,500 | 2 | 10 |
| NO (sccm) | 10 | 1 | 3 |
| $CH_4$ (sccm) | 5 | 1 | 50→600→700 |
| Support temperature: (° C.) | 270 | 260 | 250 |
| Internal pressure: (Torr) | 0.1 | 0.3 | 0.5 |
| Power: (W) | 200 | 600 | 100 |
| Layer thickness: (μm) | 2 | 30 | 0.5 |

TABLE 4

| | IR-absorb-ing layer | Charge injection blocking layer | Photo-conduc-tive layer | Surface layer |
|---|---|---|---|---|
| Material gas & flow rate: | | | | |
| $SiH_4$ (sccm) | 150 | 150 | 150 | 150→15→10 |
| $GeH_4$ (sccm) | 50 | | | |
| $H_2$ (sccm) | 500 | 500 | 800 | |
| $B_2H_6$ (ppm) (based on $SiH_4$) | 3,000 | 2,000 | 1 | |
| NO (sccm) | 15→10 | 10 | 5 | |
| $CH_4$ (sccm) | | | | 0→500→600 |
| Support temperature: (° C.) | 250 | 250 | 280 | 250 |
| Internal pressure: (Torr) | 0.3 | 0.3 | 0.5 | 0.5 |
| Power: (W) | 100 | 200 | 600 | 100 |
| Layer thickness: (μm) | 1 | 2 | 25 | 0.5 |

TABLE 5

| | Charge injection blocking layer | Photo-conductive layer | Surface layer |
|---|---|---|---|
| Material gas & flow rate: | | | |
| $SiH_4$ (sccm) | 150 | 200 | 200→10→10 |
| $SiF_4$ (sccm) | 5 | 3 | 10 |
| $H_2$ (sccm) | 500 | 800 | |
| $B_2H_6$ (ppm) (based on $SiH_4$) | 1,500 | 3 | |
| NO (sccm) | 10 | | |
| $CH_4$ (sccm) | 5 | | 0→500→500 |
| Support temperature: (° C.) | 300 | 300 | 300 |
| Internal pressure: (Torr) | 30 | 10 | 20 |
| Power: (W) | 200 | 600 | 100 |
| Layer thickness: (μm) | 2 | 30 | 0.5 |

TABLE 6

| | Charge injection blocking layer | Photo-conductive layer | Surface layer |
|---|---|---|---|
| Material gas & flow rate: | | | |
| $SiH_4$ (sccm) | 300 | 100 | 20 |
| $H_2$ (sccm) | 500 | 600 | |
| $B_2H_6$ (ppm) (based on $SiH_4$) | 3,000 | 5 | |
| NO (sccm) | 5 | 1 | |
| $NH_3$ (sccm) | | | 400 |
| Support temperature: (° C.) | 290 | 310 | 250 |
| Internal pressure: (Torr) | 20 | 15 | 10 |
| Power: (W) | 300 | 800 | 100 |
| Layer thickness: (μm) | 3 | 25 | 0.3 |

TABLE 7

| | Photoconductive layer | | |
|---|---|---|---|
| | First region | Second region | Surface layer |
| Material gas & flow rate: | | | |
| $SiH_4$ (sccm) | 150 | 150 | 100→10→8 |
| $SiF_4$ (sccm) | 5 | 5 | 1 |
| $H_2$ (sccm) | 500 | 500 | |
| $B_2H_6$ (ppm) (based on $SiH_4$) | 10→2 | 2 | |
| NO (sccm) | 1 | | |
| $CH_4$ (sccm) | 100→0 | | 0→500→550 |
| Support temperature: (° C.) | 280 | 250 | 250 |
| Internal pressure: (Torr) | 20 | 20 | 20 |
| Power: (W) | 600 | 400 | 100 |
| Layer thickness: (μm) | 25 | 3 | 0.5 |

TABLE 8

| | Charge injection blocking layer | Charge transport layer | Charge generation layer | Intermediate layer | Surface layer |
|---|---|---|---|---|---|
| Material gas & flow rate: | | | | | |
| $SiH_4$ (sccm) | 200 | 300 | 100 | 30 | 10 |
| $H_2$ (sccm) | 500 | 1,000 | 600 | | |
| $B_2H_6$ (ppm) (based on $SiH_4$) | 1,500 | 5→1 | 1 | | 5 |
| $CO_2$ (sccm) | 0.5 | 0.5 | 0.1 | 0.1 | 0.1 |
| $CH_4$ (sccm) | 20 | 100→0 | 0.1 | 200 | 500 |
| Support temperature: (° C.) | 250 | 250 | 250 | 250 | 250 |
| Internal pressure: (Torr) | 10 | 15 | 15 | 5 | 5 |
| Power: (W) | 100 | 600 | 500 | 200 | 300 |
| Layer thickness: (μm) | 3 | 30 | 2 | 0.1 | 0.5 |

TABLE 9

| | Charge injection blocking layer | Photoconductive layer | Surface layer |
|---|---|---|---|
| Material gas & flow rate: | | | |
| $SiH_4$ (sccm) | 100 | Under conditions as shown in Table 10 | 10 |
| $H_2$ (sccm) | 300 | | |
| $B_2H_6$ (ppm) (based on $SiH_4$) | 2,000 | . . | |
| NO (sccm) | 50 | . | |
| $CH_4$ (sccm) | | . | 500 |
| Support temperature: (° C.) | 300 | Continuously changed in thickness direction | 300 |

TABLE 9-continued

| | Charge injection blocking layer | Photoconductive layer | Surface layer |
|---|---|---|---|
| Internal pressure: (Torr) | 0.5 | 0.5 | 0.2 |
| Power: (W) | 500 | Continuously changed in thickness direction | 300 |
| Layer thickness: (μm) | 3 | 30 | 0.5 |

TABLE 10

| | Drum A | Drum B | Drum C | Drum D | Drum E |
|---|---|---|---|---|---|
| Material gas & flow rate: | | | | | |
| $SiH_4$ (sccm) | 100 | ← | ← | ← | ← |
| $H_2$ (sccm) | 800 | ← | ← | ← | ← |
| $B_2H_6$ (ppm) (based on $SiH_4$) | 2 | ← | ← | ← | ← |
| Support temperature: (° C.) | 300→200 | 350→200 | 350→250 | 350→300 | 370→250 |
| Internal pressure: (Torr) | 0.5 | ← | ← | ← | ← |
| *Power: (W) | 500→300 | 800→500 | 800→300 | 600→400 | 600→500 |
| Layer thickness: (μm) | 30 | ← | ← | ← | ← |

*3 to 8 times the flow rate of $SiH_4$ (herein 300 to 800 W)
Power changes are shown as representative values.

TABLE 11

| | Charge injection blocking layer | Photoconductive layer | Surface layer |
|---|---|---|---|
| Material gas & flow rate: | | | |
| $SiH_4$ (sccm) | 100 | Kept constant the conditions shown in Table 10 | 10 |
| $H_2$ (sccm) | 300 | | |
| $B_2H_6$ (ppm) (based on $SiH_4$) | 2,000 | . . | |
| NO (sccm) | 50 | . | |
| $CH_4$ (sccm) | | . | 500 |
| Support temperature: (° C.) | 300 | Constant (200, 220, 250 270, 300 330, 350, 370) | 300 |
| Internal pressure: (Torr) | 0.5 | 0.5 | 0.2 |
| Power: (W) | 500 | Constant (300, 400, 500 600, 700, 800) | 300 |
| Layer thickness: (μm) | 3 | 30 | 0.5 |

TABLE 12

| | Charge injection blocking layer | Photo-conductive layer | Surface layer |
|---|---|---|---|
| Material gas & flow rate: | | | |
| $SiH_4$ (sccm) | 100 | 100 | 10 |
| $H_2$ (sccm) | 300 | 800 | |
| $B_2H_6$ (ppm) (based on $SiH_4$) | 2,000 | 2 | |
| NO (sccm) | 50 | | |
| $CH_4$ (sccm) | | | 500 |
| Support temperature: (° C.) | 300 | 350→250 | 300 |
| Internal pressure: (Torr) | 0.5 | 0.5 | 0.2 |
| Power: (W) | 500 | 700→400 | 300 |
| Layer thickness: (μm) | 3 | 30 | 0.5 |

TABLE 13

| | Charge injection blocking layer | Photo-conductive layer | Inter-mediate layer | Surface layer |
|---|---|---|---|---|
| Material gas & flow rate: | | | | |
| $SiH_4$ (sccm) | 150 | 200 | 100 | 10 |
| $H_2$ (sccm) | 500 | 800 | | |
| $PH_3$ (ppm)* | 1,000 | | | |
| $B_2H_6$ (ppm)* | | 0.5 | 500 | |
| $CH_4$ (sccm) | 20 | | 300 | 500 |
| Support temperature: (° C.) | 250 | 350→250 | 250 | 250 |
| Internal pressure: (Torr) | 0.3 | 0.3 | 0.2 | 0.1 |
| Power: (W) | 300 | 1,000→700 | 300 | 200 |
| Layer thickness: (μm) | 2 | 30 | 0.1 | 0.5 |

*(based on $SiH_4$)

TABLE 14

| | Charge injection blocking layer | Photo-conductive layer | Surface layer |
|---|---|---|---|
| Material gas & flow rate: | | | |
| $SiH_4$ (sccm) | 150 | 100 | 200→10→10 |
| $SiF_4$ (sccm) | 2 | 1 | 5 |
| $H_2$ (sccm) | 500 | 800 | |
| $B_2H_6$ (ppm) (based on $SiH_4$) | 1,500 | 2 | 10 |
| NO (sccm) | 10 | 1 | 3 |
| $CH_4$ (sccm) | 5 | 1 | 50→600→700 |
| Support temperature: (° C.) | 270 | 350→280 | 250 |
| Internal pressure: (Torr) | 0.1 | 0.3 | 0.5 |
| Power: (W) | 200 | 800→400 | 100 |
| Layer thickness: (μm) | 2 | 30 | 0.5 |

TABLE 15

| | IR-absorb-ing layer | Charge injection blocking layer | Photo-conduc-tive layer | Surface layer |
|---|---|---|---|---|
| Material gas & flow rate: | | | | |
| $SiH_4$ (sccm) | 150 | 150 | 100 | 150→15→10 |
| $GeH_4$ (sccm) | 50 | | | |
| $H_2$ (sccm) | 500 | 500 | 800 | |
| $B_2H_6$ (ppm) (based on $SiH_4$) | 3,000 | 2,000 | 2 | |
| NO (sccm) | 15→10 | 10 | | 5 |
| $CH_4$ (sccm) | | | | 0→500→600 |
| Support temperature: (° C.) | 250 | 250 | 350→250 | 250 |
| Internal pressure: (Torr) | 0.3 | 0.3 | 0.5 | 0.5 |
| Power: (W) | 100 | 200 | 600→300 | 100 |
| Layer thickness: (μm) | 1 | 2 | 25 | 0.5 |

TABLE 16

| | Charge injection blocking layer | Photo-conductive layer | Surface layer |
|---|---|---|---|
| Material gas & flow rate: | | | |
| $SiH_4$ (sccm) | 150 | Under conditions as shown in Table 17 | 200→10→10 |
| $SiF_4$ (sccm) | 5 | | 10 |
| $H_2$ (sccm) | 500 | | |
| $B_2H_6$ (ppm) (based on $SiH_4$) | 1,500 | . | |
| NO (sccm) | 10 | . | |
| $CH_4$ (sccm) | 5 | . | 0→500→500 |
| Support temperature: (° C.) | 300 | Continuously changed in thickness direction | 300 |
| Internal pressure: (Torr) | 30 | 20 | 20 |
| Power: (W) | 200 | Continuously changed in thickness direction* | 100 |
| Layer thickness: (μm) | 2 | 30 | 0.5 |

*3 to 8 times the flow rate of $SiH_4$ (herein 150 to 400 W)

TABLE 17

| | Drum A | Drum B | Drum C | Drum D | Drum E |
|---|---|---|---|---|---|
| Material gas & flow rate: | | | | | |
| $SiH_4$ (sccm) | 50 | ← | ← | ← | ← |
| $H_2$ (sccm) | 400 | ← | ← | ← | ← |
| $B_2H_6$ (ppm) (based on $SiH_4$) | 1.5 | ← | ← | ← | ← |

TABLE 17-continued

| | Drum A | Drum B | Drum C | Drum D | Drum E |
|---|---|---|---|---|---|
| Support temperature: (° C.) | 300→200 | 350→200 | 350→250 | 350→300 | 370→250 |
| Internal pressure: (Torr) | 20 | ← | ← | ← | ← |
| Power: (W) | 250→150 | 400→250 | 400→150 | 300→200 | 300→250 |
| Layer thickness: (μm) | 30 | ← | ← | ← | ← |

Power changes are shown as representative values.

TABLE 18

| | Charge injection blocking layer | Photo-conductive layer | Surface layer |
|---|---|---|---|
| Material gas & flow rate: | | | |
| $SiH_4$ (sccm) | 300 | 50 | 20 |
| $H_2$ (sccm) | 500 | 350 | |
| $B_2H_6$ (ppm) (based on $SiH_4$) | 3,000 | 0.5 | |
| NO (sccm) | 5 | 1 | |
| $NH_3$ (sccm) | | | 400 |
| Support temperature: (° C.) | 290 | 350 → 280 | 250 |
| Internal pressure: (Torr) | 20 | 20 | 10 |
| Power: (W) | 300 | 400 → 200 | 100 |
| Layer thickness: (μm) | 3 | 25 | 0.3 |

TABLE 19

| | Charge transport layer | Charge generation layer | Surface layer |
|---|---|---|---|
| Material gas & flow rate: | | | |
| $SiH_4$ (sccm) | 100 | 100 | 100 → 10 → 8 |
| $SiF_4$ (sccm) | 5 | 5 | 1 |
| $H_2$ (sccm) | 500 | 500 | |
| $B_2H_6$ (ppm) (based on $SiH_4$) | 10 → 1.5 | 1.5 | |
| NO (sccm) | 1 | | |
| $CH_4$ (sccm) | 100 → 0 | | 0 → 500 → 550 |
| Support temperature: (° C.) | 350 → 260 | 350 | 250 |
| Internal pressure: (Torr) | 20 | 20 | 20 |
| Power: (W) | 800 → 300 | 1,400 | 100 |
| Layer thickness: (μm) | 25 | 3 | 0.5 |

TABLE 20

| | Charge injection blocking layer | Charge transport layer | Charge generation layer | Intermediate layer | Surface layer |
|---|---|---|---|---|---|
| Material gas & flow rate: | | | | | |
| $SiH_4$ (sccm) | 200 | 100 | 100 | 30 | 30 |
| $H_2$ (sccm) | 500 | 800 | 600 | | |
| $B_2H_6$ (ppm)* | | 5 → 1 | 1 | 300 | 5 |
| $PH_3$ (ppm)* | 500 | | | | |
| $CO_2$ (sccm) | 0.5 | 0.5 | 0.1 | 0.1 | 0.1 |
| $CH_4$ (sccm) | 20 | 100 → 0 | 0.1 | 200 | 500 |
| *(based on $SiH_4$) | | | | | |
| Support temperature: (° C.) | 250 | 330 → 250 | 350 | 320 | 250 |
| Internal pressure: (Torr) | 10 | 15 | 15 | 5 | 5 |
| Power: (W) | 100 | 800 → 500 | 800 | 200 | 300 |
| Layer thickness: (μm) | 3 | 30 | 2 | 0.1 | 0.5 |

TABLE 21

| | Charge injection blocking layer | Photo-conductive layer | Surface layer |
|---|---|---|---|
| Material gas & flow rate: | | | |
| $SiH_4$ (sccm) | 100 | Under conditions as shown in Table 22 | 10 |
| $H_2$ (sccm) | 300 | | |
| $B_2H_6$ (ppm) (based on $SiH_4$) | 2,000 | . | |
| NO (sccm) | 50 | . | |
| $CH_4$ (sccm) | | . | 500 |
| Support temperature: (° C.) | 300 | Continuously changed in thickness direction | 300 |
| Internal pressure: (Torr) | 0.5 | 0.5 | 0.2 |
| Power: (W) | 500 | Continuously changed in thickness direction | 300 |
| Layer thickness: (μm) | 3 | 30 | 0.5 |

TABLE 22

| | Drum A | Drum B | Drum C | Drum D | Drum E |
|---|---|---|---|---|---|
| Material gas & flow rate: | | | | | |
| $SiH_4$ (sccm) | 100 | ← | ← | ← | ← |
| $H_2$ (sccm) | 800 | ← | ← | ← | ← |
| $B_2H_6$ (ppm) (based on $SiH_4$) | 2 | ← | ← | ← | ← |
| Support temperature: (° C.) | 200 → 350 | 220 → 350 | 250 → 350 | 270 → 350 | 270 → 370 |
| Internal pressure: (Torr) | 0.5 | ← | ← | ← | ← |

TABLE 22-continued

| | Drum A | Drum B | Drum C | Drum D | Drum E |
|---|---|---|---|---|---|
| *Power: (W) | 300 → 500 | 500 → 800 | 300 → 800 | 400 → 600 | 500 → 600 |
| Layer thickness: (μm) | 30 | ← | ← | ← | ← |

*3 to 8 times the flow rate of $SiH_4$ (herein 300 to 800 W)

Power changes are shown as representative values.

TABLE 23

| | Charge injection blocking layer | Photo-conductive layer | Surface layer |
|---|---|---|---|
| Material gas & flow rate: | | | |
| $SiH_4$ (sccm) | 100 | Kept constant the conditions shown in Table 22 | 10 |
| $H_2$ (sccm) | 300 | | |
| $B_2H_6$ (ppm) (based on $SiH_4$) | 2,000 | . . | |
| NO (sccm) | 50 | . | |
| $CH_4$ (sccm) | | . | 500 |
| Support temperature: (° C.) | 300 | Constant (200, 220, 250 270, 300, 330, 350, 370) | 300 |
| Internal pressure: (Torr) | 0.5 | 0.5 | 0.2 |
| Power: (W) | 500 | Constant (300, 400, 500 600, 700, 800) | 300 |
| Layer thickness: (μm) | 3 | 30 | 0.5 |

TABLE 24

| | Charge injection blocking layer | Photo-conductive layer | Surface layer |
|---|---|---|---|
| Material gas & flow rate: | | | |
| $SiH_4$ (sccm) | 100 | 100 | 10 |
| $H_2$ (sccm) | 300 | 800 | |
| $B_2H_6$ (ppm) (based on $SiH_4$) | 2,000 | 2 | |
| NO (sccm) | 50 | | |
| $CH_4$ | | | 500 |
| Support temperature: (° C.) | 300 | 250 → 350 | 300 |
| Internal pressure: (Torr) | 0.5 | 0.5 | 0.2 |
| Power: (W) | 500 | 400 → 700 | 300 |
| Layer thickness: (μm) | 3 | 30 | 0.5 |

TABLE 25

| | Charge injection blocking layer | Photo-conductive layer | Inter-mediate layer | Surface layer |
|---|---|---|---|---|
| Material gas & flow rate: | | | | |
| $SiH_4$ (sccm) | 150 | 200 | 100 | 10 |
| $H_2$ (sccm) | 500 | 800 | | |
| $PH_3$ (ppm)* | 1,000 | | | |
| $B_2H_6$ (ppm)* | | 0.5 | 500 | |
| $CH_4$ (sccm) * (based on $SiH_4$) | 20 | | 300 | 500 |
| Support temperature: (° C.) | 250 | 250 → 350 | 250 | 250 |
| Internal pressure: (Torr) | 0.3 | 0.3 | 0.2 | 0.1 |
| Power: (W) | 300 | 600 → 1,000 | 300 | 200 |
| Layer thickness: (μm) | 2 | 30 | 0.1 | 0.5 |

TABLE 26

| | Charge injection blocking layer | Photo-conductive layer | Surface layer |
|---|---|---|---|
| Material gas & flow rate: | | | |
| $SiH_4$ (sccm) | 150 | 100 | 200 → 10 → 10 |
| $SiF_4$ (sccm) | 2 | 1 | 5 |
| $H_2$ (sccm) | 500 | 800 | |
| $B_2H_6$ (ppm) (based on $SiH_4$) | 1,500 | 2 | 10 |
| NO (sccm) | 10 | 1 | 3 |
| $CH_4$ (sccm) | 5 | 1 | 50 → 600 → 700 |
| Support temperature: (° C.) | 270 | 280 → 350 | 250 |
| Internal pressure: (Torr) | 0.1 | 0.3 | 0.5 |
| Power: (W) | 200 | 400 → 800 | 100 |
| Layer thickness: (μm) | 2 | 30 | 0.5 |

TABLE 27

| | IR-absorb-ing layer | Charge injection blocking layer | Photo-conduc-tive layer | Surface layer |
|---|---|---|---|---|
| Material gas & flow rate: | | | | |
| $SiH_4$ (sccm) | 150 | 150 | 100 | 150 → 15 → 10 |
| $GeH_4$ (sccm) | 50 | | | |
| $H_2$ (sccm) | 500 | 500 | 800 | |
| $B_2H_6$ (ppm) (based on $SiH_4$) | 3,000 | 2,000 | 2 | |
| NO (sccm) | 15 → 10 | 10 | 5 | |
| $CH_4$ (sccm) | | | | 0 → 500 → 600 |
| Support temperature: (° C.) | 250 | 250 | 250 → 350 | 250 |
| Internal pressure: (Torr) | 0.3 | 0.3 | 0.5 | 0.5 |

TABLE 27-continued

| | IR-absorbing layer | Charge injection blocking layer | Photoconductive layer | Surface layer |
|---|---|---|---|---|
| Power: (W) | 100 | 200 | 300 → 600 | 100 |
| Layer thickness: (μm) | 1 | 2 | 25 | 0.5 |

TABLE 28

| | Charge injection blocking layer | Photoconductive layer | Surface layer |
|---|---|---|---|
| Material gas & flow rate: | | | |
| $SiH_4$ (sccm) | 150 | Under conditions as shown in Table 29 | 200 → 10 → 10 |
| $SiF_4$ (sccm) | 5 | | 10 |
| $H_2$ (sccm) | 500 | | |
| $B_2H_6$ (ppm) (based on $SiH_4$) | 1,500 | | |
| NO (sccm) | 10 | | |
| $CH_4$ (sccm) | 5 | | 0 → 500 → 500 |
| Support temperature: (° C.) | 300 | Continuously changed in thickness direction | 300 |
| Internal pressure: (Torr) | 30 | 20 | 20 |
| Power: (W) | 200 | Continuously changed in thickness direction* | 100 |
| Layer thickness: (μm) | 2 | 30 | 0.5 |

*3 to 8 times the flow rate of $SiH_4$ (herein 150 to 400 W)

TABLE 29

| | Drum A | Drum B | Drum C | Drum D | Drum E |
|---|---|---|---|---|---|
| Material gas & flow rate: | | | | | |
| $SiH_4$ (sccm) | 50 | ← | ← | ← | ← |
| $H_2$ (sccm) | 400 | ← | ← | ← | ← |
| $B_2H_6$ (ppm) (based on $SiH_4$) | 1.5 | ← | ← | ← | ← |
| Support temperature: (° C.) | 200 → 350 | 220 → 350 | 250 → 350 | 270 → 350 | 270 → 370 |
| Internal pressure: (Torr) | 20 | ← | ← | ← | ← |
| Power: (W) | 150 → 250 | 250 → 400 | 150 → 400 | 200 → 300 | 200 → 400 |
| Layer thickness: (μm) | 30 | ← | ← | ← | ← |

Power changes are shown as representative values.

TABLE 30

| | Charge injection blocking layer | Photoconductive layer | Surface layer |
|---|---|---|---|
| Material gas & flow rate: | | | |
| $SiH_4$ (sccm) | 300 | 50 | 20 |
| $H_2$ (sccm) | 500 | 350 | |
| $B_2H_6$ (ppm) (based on $SiH_4$) | 3,000 | 0.5 | |
| NO (sccm) | 5 | 1 | |
| $NH_3$ (sccm) | | | 400 |
| Support temperature: (° C.) | 290 | 280 → 350 | 250 |
| Internal pressure: (Torr) | 20 | 20 | 10 |
| Power: (W) | 300 | 200 → 400 | 100 |
| Layer thickness: (μm) | 3 | 25 | 0.3 |

TABLE 31

| | Charge transport layer | Charge generation layer | Surface layer |
|---|---|---|---|
| Material gas & flow rate: | | | |
| $SiH_4$ (sccm) | 100 | 100 | 100 → 10 → 8 |
| $SiF_4$ (sccm) | 5 | 5 | 1 |
| $H_2$ (sccm) | 500 | 500 | |
| $B_2H_6$ (ppm) (based on $SiH_4$) | 10 → 1.5 | 1.5 | |
| NO (sccm) | 1 | | |
| $CH_4$ (sccm) | 100 → 0 | | 0 → 500 → 550 |
| Support temperature: (° C.) | 260 → 350 | 350 | 250 |
| Internal pressure: (Torr) | 20 | 20 | 20 |
| Power: (W) | 300 → 800 | 1,400 | 100 |
| Layer thickness: (μm) | 25 | 3 | 0.5 |

TABLE 32

| | Charge injection blocking layer | Charge transport layer | Charge generation layer | Intermediate layer | Surface layer |
|---|---|---|---|---|---|
| Material gas & flow rate: | | | | | |
| $SiH_4$ (sccm) | 200 | 100 | 100 | 30 | 30 |
| $H_2$ (sccm) | 500 | 800 | 600 | | |
| $B_2H_6$ (ppm)* | | 5 → 1 | 1 | 300 | 5 |
| $PH_3$ (ppm)* | 500 | | | | |
| $CO_2$ (sccm) | 0.5 | 0.5 | 0.1 | 0.1 | 0.1 |
| $CH_4$ (sccm) *(based on $SiH_4$) | 20 | 100 → 0 | 0.1 | 200 | 500 |
| Support temperature: (° C.) | 250 | 250 → 330 | 350 | 320 | 250 |
| Internal pressure: (Torr) | 10 | 15 | 15 | 5 | 5 |
| Power: (W) | 100 | 500 → 800 | 800 | 200 | 300 |
| Layer thickness: (μm) | 3 | 30 | 2 | 0.1 | 0.5 |

TABLE 33

| | Charge injection blocking layer | Photo-conductive layer | Surface layer |
|---|---|---|---|
| Material gas & flow rate: | | | |
| $SiH_4$ (sccm) | 100 | Under conditions as shown in Table 34 | 10 |
| $H_2$ (sccm) | 300 | | |
| $B_2H_6$ (ppm) (based on $SiH_4$) | 2,000 | . . | |
| NO (sccm) | 50 | . | |
| $CH_4$ (sccm) | | . | 500 |
| Support temperature: (° C.) | 290 | 290 | 290 |
| Internal pressure: (Torr) | 0.5 | 0.5 | 0.5 |
| Power: (W) | 500 | 450 | 300 |
| Layer thickness: (μm) | 3 | 30 | 0.5 |

TABLE 34

| Photoconductive layer: | 1-A | 1-B | 1-C | 1-D | 1-E | 1-F | 1-G |
|---|---|---|---|---|---|---|---|
| Material gas & flow rate: | | | | | | | |
| $SiH_4$ (sccm) | 100 | ← | ← | ← | ← | ← | ← |
| $H_2$ (sccm) | 800 | ← | ← | ← | ← | ← | ← |
| $B_2H_6$ (ppm) (based on $SiH_4$) | 0.4 | 0.45 | 0.7 | 1.0 | 2.5 | 4.5 | 4.8 |
| Support temperature: (° C.) | 290 | ← | ← | ← | ← | ← | ← |
| Internal pressure: (Torr) | 0.5 | ← | ← | ← | ← | ← | ← |
| Power: (W) | 450 | ← | ← | ← | ← | ← | ← |
| Layer thickness: (μm) | 30 | ← | ← | ← | ← | ← | ← |

TABLE 35

| | 1-A | 1-B | 1-C | 1-D | 1-E | 1-F | 1-G |
|---|---|---|---|---|---|---|---|
| Constant C ($\times 10^{-4}$): | 4.4 | 5.0 | 7.78 | 11.1 | 27.8 | 50 | 53.3 |
| Charge performance: | 1 | 1 | 1 | 1 | 1 | 2 | 3 |
| Sensitivity: | 2 | 2 | 2 | 1 | 2 | 3 | 4 |
| Temperature-dependent properties: | B | A | A | A | A | A | B |
| Exposure memory: | 4 | 3 | 2 | 1 | 1 | 1 | 1 |
| Charge potential shift in intense exposure: | 3 | 2 | 1 | 1 | 2 | 3 | 4 |

TABLE 36

| | Charge injection blocking layer | Photo-conductive layer | Surface layer |
|---|---|---|---|
| Material gas & flow rate: | | | |
| $SiH_4$ (sccm) | 100 | 100 | 10 |
| $H_2$ (sccm) | 300 | 800 | |
| $B_2H_6$ (ppm) (based on $SiH_4$) | 2,000 | 1.0 | |
| NO (sccm) | 50 | | |
| $CH_4$ (sccm) | | | 500 |

TABLE 36-continued

| | Charge injection blocking layer | Photo-conductive layer | Surface layer |
|---|---|---|---|
| Support temperature: (° C.) | 290 | 290 | 290 |
| Internal pressure: (Torr) | 0.5 | 0.5 | 0.5 |
| Power: (W) | 500 | Under conditions as shown in Table 37 | 300 |
| Layer thickness: (μm) | 3 | | 0.5 |

TABLE 37

| Photoconductive layer: | 2-A | 2-B | 2-C | 2-D | 2-E | 2-F | 2-G |
|---|---|---|---|---|---|---|---|
| Material gas & flow rate: | | | | | | | |
| $SiH_4$ (sccm) | 100 | ← | ← | ← | ← | ← | ← |
| $H_2$ (sccm) | 800 | ← | ← | ← | ← | ← | ← |
| $B_2H_6$ (ppm) (based on $SiH_4$) | 1.0 | ← | ← | ← | ← | ← | ← |
| Support temperature: (° C.) | 290 | | | | | | |
| Internal pressure: (Torr) | 0.5 | ← | ← | ← | ← | ← | ← |
| Power: (W) | 100 | 150 | 180 | 450 | 600 | 700 | 1,000 |
| Layer thickness: (μm) | 30 | ← | ← | ← | ← | ← | ← |

TABLE 38

| | 2-A | 2-B | 2-C | 2-D | 2-E | 2-F | 2-G |
|---|---|---|---|---|---|---|---|
| Constant B: | 0.11 | 0.167 | 0.2 | 0.5 | 0.7 | 0.78 | 1.11 |
| Charge performance: | 1 | 2 | 1 | 1 | 1 | 2 | 2 |
| Sensitivity: | 2 | 3 | 2 | 1 | 1 | 2 | 3 |
| Temperature-dependent properties: | B | B | A | A | A | B | B |
| Exposure memory: | 4 | 2 | 2 | 1 | 1 | 1 | 1 |
| Charge potential shift in intense exposure: | 3 | 2 | 1 | 1 | 1 | 2 | 2 |

TABLE 39

| | Charge injection blocking layer | Photo-conductive layer | Surface layer |
|---|---|---|---|
| Material gas & flow rate: | | | |
| $SiH_4$ (sccm) | 150 | 200 | 200→10→10 |
| $SiF_4$ (sccm) | 2 | 1 | 5 |
| $H_2$ (sccm) | 500 | 1,000 | |
| $B_2H_6$ (ppm) (based on $SiH_4$) | 1,500 | 4 | 10 |
| NO (sccm) | 10 | 1 | 3 |
| $CH_4$ (sccm) | 5 | 1 | 50→600→700 |
| Support temperature: (° C.) | 270 | 260 | 250 |
| Internal pressure: (Torr) | 0.1 | 0.3 | 0.5 |

TABLE 39-continued

| | Charge injection blocking layer | Photo-conductive layer | Surface layer |
|---|---|---|---|
| Power: (W) | 200 | 800 | 100 |
| Layer thickness: (μm) | 2 | 30 | 0.5 |

TABLE 40

| | IR-absorb-ing layer | Charge injection blocking layer | Photo-conduc-tive layer | Surface layer |
|---|---|---|---|---|
| Material gas & flow rate: | | | | |
| $SiH_4$ (sccm) | 150 | 150 | 300 | 150→15→10 |
| $GeH_4$ (sccm) | 50 | | | |
| $H_2$ (sccm) | 500 | 500 | 1,500 | |
| $B_2H_6$ (ppm) (based on $SiH_4$) | 3,000 | 2,000 | 3 | |
| NO (sccm) | 15→10 | 10 | | 5 |
| $CH_4$ (sccm) | | | | 0→500→600 |
| Support temperature: (° C.) | 250 | 250 | 300 | 250 |
| Internal pressure: (Torr) | 0.3 | 0.3 | 0.5 | 0.5 |
| Power: (W) | 100 | 200 | 600 | 100 |
| Layer thickness: (μm) | 1 | 2 | 25 | 0.5 |

TABLE 41

| | Photoconductive layer | | |
|---|---|---|---|
| | Charge trans-port layer | Charge genera-tion layer | Surface layer |
| Material gas & flow rate: | | | |
| $SiH_4$ (sccm) | 300 | 300 | 200→10→10 |
| $SiF_4$ (sccm) | 3 | 1 | 5 |
| $H_2$ (sccm) | 3,000 | 3,000 | |
| $B_2H_6$ (ppm) (based on $SiH_4$) | 16 | 10 | 10 |
| NO (sccm) | 20 | | 3 |
| $CH_4$ (sccm) | 50 | 5 | 50→600→700 |
| Support temperature: (° C.) | 270 | 260 | 250 |
| Internal pressure: (Torr) | 0.3 | 0.3 | 0.5 |
| Power: (W) | 700 | 1,200 | 100 |
| Layer thickness: (μm) | 30 | 2 | 0.5 |

TABLE 42

| | Charge | Photoconductive layer | | |
|---|---|---|---|---|
| | injec-tion blocking layer | Charge trans-port layer | Charge genera-tion layer | Surface layer |
| Material gas & flow rate: | | | | |
| $SiH_4$ (sccm) | 150 | 300 | 300 | 150→15→10 |
| $GeH_4$ (sccm) | | | | |
| $H_2$ (sccm) | 500 | 1,500 | 1,500 | |
| $B_2H_6$ (ppm) (based on $SiH_4$) | 2,000 | 9 | 6 | |
| NO (sccm) | 10 | | | 5 |
| $CH_4$ (sccm) | | | | 0→500→600 |
| Support temperature: (° C.) | 250 | 280 | 300 | 250 |
| Internal pressure: (Torr) | 0.3 | 0.5 | 0.3 | 0.5 |
| Power: (W) | 200 | 1,200 | 600 | 100 |
| Layer thickness: (μm) | 2 | 25 | 2 | 0.5 |

TABLE 43

| | Charge | Photoconductive layer | | | |
|---|---|---|---|---|---|
| | injec-tion blocking layer | Charge trans-port layer | Charge genera-tion layer | Inter-medi-ate layer | Sur-face layer |
| Material gas & flow rate: | | | | | |
| $SiH_4$ (sccm) | 220 | 200 | 100 | 30 | 30 |
| $H_2$ (sccm) | 600 | 1,200 | 700 | | |
| $B_2H_6$ (ppm)* | | 5→1 | 1 | 280 | 4 |
| $PH_3$ (ppm)* | 400 | | | | |
| $CO_2$ (sccm) | 0.8 | | 0.1 | 0.1 | 0.1 |
| $CH_4$ (sccm) | 30 | 200→0.1 | 0.1 | 200 | 500 |
| *(based on $SiH_4$) | | | | | |
| Support temperature: (° C.) | 250 | 250 | 250 | 250 | 250 |
| Internal pressure: (Torr) | 0.1 | 0.35 | 0.5 | 0.45 | 0.23 |
| Power: (W) | 100 | 600 | 450 | 200 | 300 |
| Layer thickness: (μm) | 3 | 30 | 2 | 0.1 | 0.5 |

TABLE 44

| | Charge injection blocking layer | Photo-conductive layer | Surface layer |
|---|---|---|---|
| Material gas & flow rate: | | | |
| $SiH_4$ (sccm) | 150 | 200 | 200→10→10 |
| $SiF_4$ (sccm) | 5 | 3 | 10 |
| $H_2$ (sccm) | 500 | 800 | |
| $B_2H_6$ (ppm) (based on $SiH_4$) | 1,500 | 3 | |
| NO (sccm) | 10 | | |
| $CH_4$ (sccm) | 5 | | 0→500→500 |

TABLE 44-continued

| | Charge injection blocking layer | Photo-conductive layer | Surface layer |
|---|---|---|---|
| Support temperature: (° C.) | 300 | 300 | 300 |
| Internal pressure: (Torr) | 30 | 10 | 20 |
| Power: (W) | 200 | 600 | 100 |
| Layer thickness: (μm) | 2 | 30 | 0.5 |

TABLE 45

| | IR-absorb-ing layer | Charge injection blocking layer | Photo-conduc-tive layer | Surface layer |
|---|---|---|---|---|
| Material gas & flow rate: | | | | |
| $SiH_4$ (sccm) | 120 | 120 | 300 | 150→15→10 |
| $GeH_4$ (sccm) | 30 | | | |
| $H_2$ (sccm) | 600 | 600 | 1,800 | |
| $B_2H_6$ (ppm) (based on $SiH_4$) | 3,000 | 1,800 | 5 | |
| NO (sccm) | 15→10 | 10 | | 5 |
| $CH_4$ (sccm) | | | | 0→500→600 |
| Support temperature: (° C.) | 270 | 270 | 300 | 270 |
| Internal pressure: (Torr) | 12 | 20 | 8 | 10 |
| Power: (W) | 100 | 200 | 600 | 100 |
| Layer thickness: (μm) | 1 | 2 | 25 | 0.5 |

TABLE 46

| | Photoconductive layer | | |
|---|---|---|---|
| | Charge trans-port layer | Charge genera-tion layer | Surface layer |
| Material gas & flow rate: | | | |
| $SiH_4$ (sccm) | 200 | 80 | 75→10→8 |
| $SiF_4$ (sccm) | 5 | 5 | 1 |
| $H_2$ (sccm) | 400 | 400 | |
| $B_2H_6$ (ppm) (based on $SiH_4$) | 10→2 | 2 | |
| NO (sccm) | 1 | | |
| $CH_4$ (sccm) | 100→0 | | 0→500→550 |
| Support temperature: (° C.) | 280 | 260 | 250 |
| Internal pressure: (Torr) | 15 | 22 | 12 |
| Power: (W) | 400 | 300 | 100 |
| Layer thickness: (μm) | 25 | 3 | 0.5 |

TABLE 47

| | Charge | Photoconductive layer | | |
|---|---|---|---|---|
| | injec-tion blocking layer | Charge trans-port layer | Charge genera-tion layer | Surface layer |
| Material gas & flow rate: | | | | |
| $SiH_4$ (sccm) | 150 | 350 | 350 | 250→15→10 |
| $GeH_4$ (sccm) | | | | |
| $H_2$ (sccm) | 500 | 1,800 | 1,800 | |
| $B_2H_6$ (ppm) (based on $SiH_4$) | 2,000 | 9 | 4 | |
| NO (sccm) | 10 | | | 5 |
| $CH_4$ (sccm) | | | | 0→500→600 |
| Support temperature (° C.) | 250 | 280 | 300 | 250 |
| Internal pressure: (Torr) | 25 | 20 | 20 | 15 |
| Power: (W) | 200 | 1,200 | 700 | 100 |
| Layer thickness: (μm) | 2 | 25 | 2 | 0.5 |

TABLE 48

| | Charge | Photoconductive layer | | | |
|---|---|---|---|---|---|
| | injec-tion blocking layer | Charge trans-port layer | Charge genera-tion layer | Inter-medi-ate layer | Sur-face layer |
| Material gas & flow rate: | | | | | |
| $SiH_4$ (sccm) | 200 | 300 | 100 | 30 | 30 |
| $H_2$ (sccm) | 500 | 1,000 | 600 | | |
| $B_2H_6$ (ppm)* | | 5→1 | 1 | 300 | 5 |
| $PH_3$ (ppm)* | 500 | | | | |
| $CO_2$ (sccm) | 0.5 | 0.5 | 0.1 | 0.1 | 0.1 |
| $CH_4$ (sccm) | 20 | 100→0 | 0.1 | 200 | 500 |
| * (based on $SiH_4$) | | | | | |
| Support temperature: (° C.) | 250 | 250 | 250 | 250 | 250 |
| Internal pressure: (Torr) | 10 | 15 | 15 | 5 | 5 |
| Power: (W) | 100 | 600 | 450 | 200 | 300 |
| Layer thickness: (μm) | 3 | 30 | 2 | 0.1 | 0.5 |

As having been described above, according to the present invention, the temperature-dependent properties in the service temperature range of the electrophotographic light-receiving member can be remarkably decreased and at the same time the occurrence of exposure memory can be prevented. Hence, it is possible to obtain an electrophotographic light-receiving member in which the stability of electrophotographic light-receiving members to service environment has been improved and by which high-quality images affording a sharp halftone and having a high resolution can be stably obtained.

According to the present invention, the temperature-dependent properties in the service temperature range of the electrophotographic light-receiving member can be remarkably decreased and at the same time a decrease in exposure memory and an improvement in photosensitivity can be achieved. Hence, it is also possible to obtain an electrophotographic light-receiving member in which the stability of electrophotographic light-receiving members to service environment has been improved and by which high-quality images affording a sharp halftone and having a high resolution can be stably obtained.

According to the present invention, the intensity ratio of absorption peaks ascribable to Si—$H_2$ bonds and Si—H bonds is further specified, whereby the mobility of carriers through layers of light-receiving members can be made uniform. As the result, it is still also possible to obtain an electrophotographic light-receiving member by which the fine density difference in halftone images, what is called coarse images, can be more decreased.

Hence, the electrophotographic light-receiving member of the present invention, designed to have the specific constitution as previously described, can settle the problems involved in conventional electrophotographic light-receiving members constituted of a-Si and exhibits very good electrical, optical and photoconductive properties, image quality, running performance and service environmental properties.

In particular, since in the light-receiving member of the present invention the photoconductive layer is constituted of a-Si greatly decreased in its gap levels, any changes in surface potential which correspond with surrounding environmental variations can be prevented and in addition the exposure fatigue or exposure memory may occur only a little enough to be substantially negligible. Thus, the light-receiving member has very superior potential characteristics and image characteristics.

Moreover, since in the light-receiving member of the present invention the photoconductive layer is so constituted that a-Si greatly decreased in its gap levels is continuously distributed, any changes in surface potential which correspond with surrounding environmental variations can be prevented and in addition the smeared images in intense exposure may occur only a little enough to be substantially negligible. Thus, the light-receiving member of the present invention has very superior potential characteristics and image characteristics.

According to the present invention, since also the temperature-dependent properties in the service temperature range of the electrophotographic light-receiving member is remarkably improved, it is possible to obtain an electrophotographic light-receiving member having a light-receiving layer formed of a non-monocrystalline material mainly composed of silicon atoms, that has attained a remarkable decrease in temperature-dependent properties to achieve a dramatic improvement in environmental resistance (resistance to the effects of the temperature inside copying machines and the outermost surface temperature of the light-receiving member), whereby images can be made highly stable even in continuous copying, and also has attained a decrease in exposure memory and charge potential shift in continuous charging to achieve a dramatic improvement in image quality.

In addition, according to the present invention, since the light-receiving member is produced by a process in which the gas flow rate, doping gas flow rate and discharge power are limited, it is possible to provide a process for producing an electrophotographic light-receiving member greatly improved in electrophotographic performances as stated above.

Hence, the employment of the production process for the electrophotographic light-receiving member of the present invention can settle the problems involved in conventional electrophotographic light-receiving members constituted of a-Si. In particular, very good electrical, optical and photoconductive properties, image quality, running performance and service environmental properties can be achieved.

The employment of such a light-receiving member in electrophotographic apparatus also makes it possible to provide an electrophotographic apparatus which is not affected by surrounding environmental variations, may cause potential shift or exposure memory only a little enough to be substantially negligible, and has very superior potential characteristics and image characteristics.

Specifying the Eu and DOS as previously described above specifies, so to speak, the manner of structural disorder and the number of defects or imperfections. This solves the problems caused by the entrapped carriers.

Needless to say, the present invention can be appropriately modified and combined within the scope of the gist of the present invention.

What is claimed is:

1. An electrophotographic light-receiving member comprising a conductive support and a light-receiving layer having a photoconductive layer showing a photoconductivity, formed on the conductive support and formed of a non-monocrystalline material mainly composed of a silicon atom and containing at least one of a hydrogen atom and a halogen atom; wherein said photoconductive layer contains from 10 atomic % to 30 atomic % of hydrogen, the characteristic energy of exponential tail obtained from light absorption spectra at light-incident portions at least of the photoconductive layer is from 50 meV to 60 meV, and the density of states of localization in the photoconductive layer is from $1\times10^{14}$ $cm^{-3}$ to $1\times10^{16}$ $cm^{-3}$.

2. The electrophotographic light-receiving member according to claim 1, wherein said photoconductive layer contains at least one of Group IIIb of the periodic table element selected from B, Al, Ga, In or Tl and Group Vb of the periodic table element selected from P, As, Sb or Bi.

3. The electrophotographic light-receiving member according to claim 1, wherein said photoconductive layer contains at least one of carbon, oxygen and nitrogen.

4. The electrophotographic light-receiving member according to claim 1, wherein said light-receiving layer comprises a photoconductive layer formed of a non-monocrystalline material mainly composed of a silicon atom, and a surface layer provided on said photoconductive layer and formed of a silicon type non-monocrystalline material containing at least one of carbon, oxygen and nitrogen.

5. The electrophotographic light-receiving member according to claim 1, wherein said light-receiving layer comprises a charge injection blocking layer formed of a non-monocrystalline material mainly composed of a silicon atom and containing at least one of carbon, oxygen and nitrogen and at least one of Group IIIb of the periodic table element selected from B, Al, Ga, In or Tl and Group Vb of the periodic table element selected from P, As, Sb or Bi, a photoconductive layer provided on said charge injection blocking layer and formed of a non-monocrystalline material mainly composed of a silicon atom, and a surface layer provided on said photoconductive layer and formed of a silicon type non-monocrystalline material containing at least one of carbon, oxygen and nitrogen.

6. The electrophotographic light-receiving member according to claim 1, wherein said photoconductive layer has a layer thickness of from 20 $\mu$m to 50 $\mu$m.

7. The electrophotographic light-receiving member according to claim 4, wherein said surface layer has a layer thickness of from 0.01 $\mu$m to 3 $\mu$m.

8. The electrophotographic light-receiving member according to claim 5, wherein said charge injection blocking layer has a layer thickness of from 0.1 μm to 5 μm.

9. The electrophotographic light-receiving member according to any one of claims 1 to 8, wherein the intensity ratio of absorption peaks ascribable to Si—$H_2$ bonds and Si—H bonds obtained from light absorption spectra of said photoconductive layer is from 0.1 to 0.5.

10. The electrophotographic light-receiving member according to claim 9, wherein said photoconductive layer contains at least one of Group IIIb of the periodic table element selected from B, Al, Ga, In or Tl and Group Vb of the periodic table element selected from P, As, Sb or Bi.

11. The electrophotographic light-receiving member according to claim 9, wherein said photoconductive layer contains at least one of carbon, oxygen and nitrogen.

12. The electrophotographic light-receiving member according to claim 9, wherein said light-receiving layer comprises a photoconductive layer formed of a non-monocrystalline material mainly composed of a silicon atom, and a surface layer provided on said photoconductive layer and formed of a silicon type non-monocrystalline material containing at least one of carbon, oxygen and nitrogen.

13. The electrophotographic light-receiving member according to claim 9, wherein said light-receiving layer comprises a charge injection blocking layer formed of a non-monocrystalline material mainly composed of a silicon atom and containing at least one of carbon, oxygen and nitrogen and at least one of Group IIIb of the periodic table element selected from B, Al, Ga, In or Tl and Group Vb of the periodic table element selected from P, As, Sb or Bi, a photoconductive layer provided on said charge injection blocking layer and formed of a non-monocrystalline material mainly composed of a silicon atom, and a surface layer provided on said photoconductive layer and formed of a silicon type non-monocrystalline material containing at least one of carbon, oxygen and nitrogen.

14. The electrophotographic light-receiving member according to claim 9, wherein said photoconductive layer has a layer thickness of from 20 μm to 50 μm.

15. The electrophotographic light-receiving member according to claim 12, wherein said surface layer has a layer thickness of from 0.01 μm to 3 μm.

16. The electrophotographic light-receiving member according to claim 13, wherein said charge injection blocking layer has a layer thickness of from 0.1 μm to 5 μm.

17. The electrophotographic light-receiving member according to claim 1, wherein said characteristic energy at the exponential tail and said density of states of localization are changed in the layer thickness direction.

18. The electrophotographic light-receiving member according to claim 17, wherein said characteristic energy at the exponential tail and said density of states of localization continuously increase from the support side toward the surface side.

19. The electrophotographic light-receiving member according to claim 17, wherein said characteristic energy at the exponential tail and said density of states of localization continuously decrease from the support side toward the surface side.

20. An electrophotographic light-receiving member comprising a conductive support and a light-receiving layer having a photoconductive layer showing a photoconductivity, formed on said conductive support and formed of a non-monocrystalline material mainly composed of a silicon atom and containing at least one of a hydrogen atom and a halogen atom; wherein the temperature dependence of charge performance in said light-receiving layer is within ±2 V/degree.

21. The electrophotographic light-receiving member according to claim 20, wherein the temperature dependence of charge performance in said light-receiving layer is within ±2 V/degree, the exposure memory in said light-receiving layer is 10 V or less, and the charge potential shift in continuous charging is within ±10 V.

22. The electrophotographic light-receiving member according to claim 20, wherein said photoconductive layer contains at least one of Group IIIb of the periodic table element selected from B, Al, Ga, In or Ti and Group Vb of the periodic table element selected from P, As, Sb or Bi.

23. The electrophotographic light-receiving member according to claim 20, wherein said photoconductive layer contains at least one of carbon, oxygen and nitrogen.

24. The electrophotographic light-receiving member according to claim 20, wherein said light-receiving layer comprises a photoconductive layer formed of a non-monocrystalline material mainly composed of a silicon atom, and a surface layer provided on said photoconductive layer and formed of a silicon type non-monocrystalline material containing at least one of carbon, oxygen and nitrogen.

25. The electrophotographic light-receiving member according to claim 20, wherein said light-receiving layer comprises a charge injection blocking layer formed of a non-monocrystalline material mainly composed of a silicon atom and containing at least one of carbon, oxygen and nitrogen and at least one of Group IIIb of the periodic table element selected from B, Al, Ga, In or Tl and Group Vb of the periodic table element selected from P, As, Sb or Bi, a photoconductive layer provided on said charge injection blocking layer and formed of a non-monocrystalline material mainly composed of a silicon atom, and a surface layer provided on said photoconductive layer and formed of a silicon type non-monocrystalline material containing at least one of carbon, oxygen and nitrogen.

26. The electrophotographic light-receiving member according to claim 20, wherein said photoconductive layer has a layer thickness of from 20 μm to 50 μm.

27. The electrophotographic light-receiving member according to claim 24, wherein said surface layer has a layer thickness of from 0.01 μm to 3 μm.

28. The electrophotographic light-receiving member according to claim 25, wherein said charge injection blocking layer has a layer thickness of from 0.1 μm to 5 μm.

29. A process for producing an electrophotographic light-receiving member comprising a conductive support and a light-receiving layer having a photoconductive layer showing a photoconductivity, formed on said conductive support and formed of a non-monocrystalline material mainly composed of a silicon atom and containing at least one of a hydrogen atom and a halogen atom; wherein said process comprising forming the photoconductive layer while controlling a discharge power so as to be A×B watt, and controlling the flow rate of a gas containing at least one of Group IIIb of the periodic table element selected from B, Al, Ga, In or Tl and Group Vb of the periodic table element selected from P, As, Sb or Bi so as to be A×C ppm, where A represents the total of the flow rates of a material gas and a dilute gas, B represents a constant of from 0.2 to 0.7 and C represents a constant of from $5\times10^{-4}$ to $5\times10^{-3}$, to thereby afford a temperature dependence of charge performance in said photoconductive layer, within ±2 V/degree.

30. The process for producing an electrophotographic light-receiving member according to claim 29, wherein the dilute gas used to form said light-receiving layer comprises $H_2$ gas and/or He gas introduced alone or in the form of a mixture.

31. The process for producing an electrophotographic light-receiving member according to claim 29, wherein at least one of gases containing elements belonging to Group IIIb or Group Vb of the periodic table is introduced when said photoconductive layer is formed.

32. The process for producing an electrophotographic light-receiving member according to claim 29, wherein a gas or gases containing at least one of carbon, oxygen and nitrogen is/are introduced alone or in the form of a mixture when said photoconductive layer is formed.

33. The process for producing an electrophotographic light-receiving member according to claim 29, wherein said light-receiving layer comprises a photoconductive layer formed of a non-monocrystalline material mainly composed of a silicon atom, and a surface layer provided on said photoconductive layer and formed of a silicon type non-monocrystalline material containing at least one of carbon, oxygen and nitrogen.

34. The process for producing an electrophotographic light-receiving member according to claim 29, wherein said light-receiving layer comprises a charge injection blocking layer formed of a non-monocrystalline material mainly composed of a silicon atom and containing at least one of carbon, oxygen and nitrogen and at least one of Group IIIb of the periodic table element selected from B, Al, Ga, In or Tl and Group Vb of the periodic table element selected from P, As, Sb or Bi, a photoconductive layer provided on said charge injection blocking layer and formed of a non-monocrystalline material mainly composed of a silicon atom, and a surface layer provided on said photoconductive layer and formed of a silicon type non-monocrystalline material containing at least one of carbon, oxygen and nitrogen.

35. The process for producing an electrophotographic light-receiving member according to claim 29, wherein said photoconductive layer is formed in a layer thickness of from 20 $\mu$m to 50 $\mu$m.

36. The process for producing an electrophotographic light-receiving member according to claim 33, wherein said surface layer is formed in a layer thickness of from 0.01 $\mu$m to 3 $\mu$m.

37. The process for producing an electrophotographic light-receiving member according to claim 34, wherein said charge injection blocking layer is formed in a layer thickness of from 0.1 $\mu$m to 5 $\mu$m.

* * * * *

UNITED STATES PATENT AND TRADEMARK OFFICE

CERTIFICATE OF CORRECTION

PATENT NO. : 6,090,513
DATED : July 18, 2000
INVENTOR(S) : Hiroaki Nino et al.

It is certified that error appears in the above-identified patent and that said Letters Patent is hereby corrected as shown below:

Title page, Item [56],
Title, "ECLECTROPHOTOGRAPHIC LIGHT-" should read
-- ELECTROPHOTOGRAPHIC LIGHT --
Other Publications, "Kanoh et al., "Chemical Vapor Deposition of Amorphous Silicaon..." should read -- Kanoh, et al, "Chemical Vapor Deposition of Amorphous Silicon..."

Column 4,
Line 16, "to solve of" should read -- to solve --.

Column 8,
Line 28, "very" should be deleted.

Column 11,
Line 57, "that is" should read -- that is, --.

Column 17,
Line 37, "$NH_2O$," should read -- $N_2O$ --.

Column 41,
Line 60, "the" (first occurrence) should read -- a --.

Column 45,
Line 65, "still" should be deleted.

Column 52,
Table 4, in columns entitled "Photoconductive layer" and "Surface layer" respectively:

" 5
0→500→600
280 250 "

should read

-- 5
0→500→600
280 250 --.

UNITED STATES PATENT AND TRADEMARK OFFICE

CERTIFICATE OF CORRECTION

PATENT NO. : 6,090,513
DATED : July 18, 2000
INVENTOR(S) : Hiroaki Nino et al.

It is certified that error appears in the above-identified patent and that said Letters Patent is hereby corrected as shown below:

Column 59,
Table 24, "$CH_4$" should read -- $CH_4$ (sccm) --

Signed and Sealed this

Thirteenth Day of November, 2001

*Attest:*

Nicholas P. Godici

NICHOLAS P. GODICI
*Acting Director of the United States Patent and Trademark Office*

*Attesting Officer*